US012371232B2

(12) United States Patent
Ahn

(10) Patent No.: US 12,371,232 B2
(45) Date of Patent: Jul. 29, 2025

(54) CONTAINER CAP AND CONTAINER HAVING SAME COUPLED THERETO

(71) Applicant: Jin Hee Ahn, Yongin-si (KR)

(72) Inventor: Jin Hee Ahn, Yongin-si (KR)

( * ) Notice: Subject to any disclaimer, the term of this patent is extended or adjusted under 35 U.S.C. 154(b) by 0 days.

(21) Appl. No.: 17/766,191

(22) PCT Filed: Oct. 12, 2020

(86) PCT No.: PCT/KR2020/013891

§ 371 (c)(1),
(2) Date: Apr. 1, 2022

(87) PCT Pub. No.: WO2021/071348

PCT Pub. Date: Apr. 15, 2021

(65) Prior Publication Data

US 2024/0051714 A1 Feb. 15, 2024

(30) Foreign Application Priority Data

Oct. 10, 2019 (KR) ..... 10-2019-0127918
Oct. 17, 2019 (KR) ..... 10-2019-0129355
(Continued)

(51) Int. Cl.
*B65D 41/46* (2006.01)
*B65D 1/02* (2006.01)
*B65D 25/06* (2006.01)
*B65D 43/16* (2006.01)
(Continued)

(52) U.S. Cl.
CPC ..... *B65D 41/465* (2013.01); *B65D 1/023* (2013.01); *B65D 1/0261* (2013.01); *B65D 25/06* (2013.01);
(Continued)

(58) Field of Classification Search
CPC ..... B65D 41/465; B65D 1/023; B65D 43/16; B65D 2401/15
(Continued)

(56) References Cited

U.S. PATENT DOCUMENTS 4,732,293 A 3/1988 Landis
6,116,441 A 9/2000 Decelles et al.
(Continued)

FOREIGN PATENT DOCUMENTS

JP S63107955 U 7/1988
JP H03-75162 U 7/1991
(Continued)

OTHER PUBLICATIONS

European Search Report mailed on Oct. 31, 2023.

*Primary Examiner* — Orlando E Aviles
*Assistant Examiner* — Sanjidul Islam
(74) *Attorney, Agent, or Firm* — Rabin & Berdo, P.C.

(57) ABSTRACT

The present invention relates to a container cap and, more specifically, to: a container cap which is coupled to the mouth of a container in which contents are contained; and a container having same coupled thereto. The present invention provides a container cap comprising: a body part coupled to the mouth of a container in which contents are contained, and having an opening at the top thereof; a cover part coupled to the body part so as to open and close the top opening of the body part; and a separation part integrally connected to a first member, which is one of the body part and the cover part, by a first connection part, and integrally but detachably connected to a second member, which is the other of the body part and the cover part, by a second connection part, wherein the second connection part is detached by a user's manipulation so as to allow the cover part to be separated from the body part.

7 Claims, 49 Drawing Sheets

(30) Foreign Application Priority Data

| | | |
|---|---|---|
| Nov. 11, 2019 | (KR) | 10-2019-0147193 |
| Dec. 31, 2019 | (KR) | 10-2019-0180213 |
| Mar. 11, 2020 | (KR) | 10-2020-0031451 |
| Jun. 9, 2020 | (KR) | 10-2020-0070922 |
| Jul. 20, 2020 | (KR) | 10-2020-0090952 |
| Jul. 21, 2020 | (KR) | 10-2020-0090631 |
| Jul. 27, 2020 | (KR) | 10-2020-0092974 |
| Jul. 27, 2020 | (KR) | 10-2020-0092975 |
| Aug. 18, 2020 | (KR) | 10-2020-0104642 |

(51) Int. Cl.
*B65D 55/16* (2006.01)
*B65D 83/06* (2006.01)

(52) U.S. Cl.
CPC ..... *B65D 43/161* (2013.01); *B65D 55/16* (2013.01); *B65D 83/06* (2013.01); *B65D 2401/15* (2020.05); *B65D 2583/0445* (2013.01)

(58) Field of Classification Search
USPC ..... 215/216, 228, 250, 253; 220/212, 266
See application file for complete search history.

(56) References Cited

U.S. PATENT DOCUMENTS

| | | | | |
|---|---|---|---|---|
| 6,269,986 | B1 * | 8/2001 | Gross | B65D 47/0804 222/153.06 |
| 9,339,134 | B1 * | 5/2016 | Poole | B65D 43/162 |
| 2004/0069806 | A1 | 4/2004 | Benoit-Gonin et al. | |
| 2008/0169261 | A1 * | 7/2008 | Druitt | B65D 47/0809 215/253 |

FOREIGN PATENT DOCUMENTS

| | | | | |
|---|---|---|---|---|
| JP | H0534149 | U | | 5/1993 |
| JP | H07-4214 | Y2 | | 2/1995 |
| JP | 2002511041 | A | | 4/2002 |
| JP | 2005-193941 | A | | 7/2005 |
| JP | 2005193941 | | * | 7/2005 |
| JP | 2011-219110 | A | | 11/2011 |
| JP | 2011219110 | | * | 11/2011 |
| JP | 2019055816 | A | | 4/2019 |
| JP | 2019-142534 | A | | 8/2019 |

* cited by examiner

CONTAINER CAP AND CONTAINER HAVING SAME COUPLED THERETO

TECHNICAL FIELD

The present invention relates to a container cap, and more particularly, to a container cap coupled to a container inlet of a container containing contents, and a container to which the container cap is coupled.

BACKGROUND ART

A container cap is coupled to a container inlet of a container containing contents to seal the container, and various types of container caps are coupled according to the type of contents contained in the container and discharging and opening manners.

FIG. 1 is a perspective view illustrating a container to which a container cap is coupled according to the related art.

The container cap according to the related art may be a container cap coupled to a container 3 containing contents in the form of granules such as gum and be configured as illustrated in FIG. 1.

Particularly, the container cap 1 illustrated in FIG. 1 according to the related art includes a body part 7 coupled to a container inlet of the container 3 containing contents and opened upward, a cover part 5 coupled to the body part 7 to open and close an upper opening of the body part 7, and a use trace belt 9 coupled to a lower end of the cover part 5 and an upper end of the body part 7 and separated from the cover part 5 and the body part 7 by a user to allow the cover part 5 to open and close the upper opening of the body part 7.

Here, the use trace belt 9 is coupled to the lower end of the cover part 5 and the upper end of the body part 7 and is separated from the cover part 5 and the body part 7 by the user to allow the cover part 5 to open and close the upper opening of the body 7.

In addition, the use trace belt 9 is characterized in that the use trace belt 9 is formed together when the container cap 1 is formed by plastic injection molding, is coupled to the lower end of the cover part 5 and the upper end of the body part 7, and is removed after being separated from the lower end of the cover part 5 and the upper end of the body part 7 along cut structure made in the lower end of the cover part 5 and the upper end of the body part 7 or separation lines 7*a* and 7*b* such as a plurality of bridges.

However, as waste plastics are the main culprit of environmental pollution due to the recent rapid increase in amount of used plastics, there is a national or social demand to minimize or recycle the plastics.

In the container cap illustrated in FIG. 1 according to the related art, when the use trace belt 9 is used, the use trace belt 9 is separated from the container cap 1 and then discarded, and thus, there is a problem in that it is difficult to recycle the plastic materials while increasing in amount of plastic materials.

In addition, in the container cap illustrated in FIG. 1 according to the related art, since the user has to separate the use trace belt 9 along a circumferential direction of the container cap 1, there is a problem in that a separation operation of the use trace belt 9 is cumbersome.

DISCLOSURE OF THE INVENTION

Technical Problem

In order to solve the above problems, an object of the present invention is to provide a container cap that is easy to collect waste plastics so as to recycle the waste plastics and is easy to be used by implementing a structure for checking use traces such as opening as an integrated plastic container cap, and a container to which the container cap is coupled.

Technical Solution

The present invention is invented to achieve the object of the present invention as described above, and the present invention discloses a container cap including: a body part (100) coupled to a container inlet (20) of a container (30) containing contents and having an opening at an upper side thereof; a cover part (200) coupled to the body part (100) to open and close the upper opening of the body part (100); and a separation part (300) integrally connected to a first member that is any one of the body part (100) and the cover part (200) by a first connection part (510) and integrally and separably connected to a second member that is the other one of the body part (100) and the cover part (200) by a second connection part (520), wherein the second connection part (520) is separated by user's manipulation so that the cover part (200) is separable from the body part (100).

The separation part (300) may connect the body part (100) to the cover part (200) in a vertical direction.

The separation part (300) may connect the body part (100) to the cover part (200) in a circumferential direction.

The first member may be provided with a fixing part (400) fixed after the separation part (300) is separated from the second member.

The container cap may be made of a plastic material, and the first connection part (510) may be formed as a thin film, and the second connection part (520) is formed as a cut groove or a plurality of bridges.

The separation part (300) may be fitted into the fixing part (400) so as to be fixed to the fixing part (400).

In the separation part (300), the first connection part (510) may be folded vertically to be coupled to the fixing part (400).

The fixing part (400) may include one or more second fitting part (420) formed on an outer circumferential surface of the first member and fitted with one or more first fitting part (320) provided in the separation part (300).

The separation part (300) may move vertically to be coupled to the fixing part (400).

The fixing part (400) may include one or more second fitting part (420) formed on an outer circumferential surface of the first member and fitted with one or more first fitting part (320) provided in the separation part (300).

The cover part (200) may be integrally connected by a hinge part (530) so that the cover part (200) hingedly rotates when being separated from the body part (100).

At least one of the separation part (300) or the fixing part (400) may be disposed at a position opposite to the hinge part (530), and the cover part (200) may be used as a handle for opening the body part (100) by user's manipulation.

The separation part (300) may be separated from the second member in the circumferential direction so as to be fixedly coupled to the fixing part (400) formed on the first member.

The separation part (300) may have a belt structure coupled between the first member and the second member by a plurality of bridges and be inserted to be fixed to the fixing part 400 formed on an outer circumferential surface of the second member after being separated from the second member.

The cover part (200) may include a plurality of close contact parts that are in contact with the container inlet (20), wherein the close contact part may have a close curve surrounding the container inlet (20) to prevent external air from being introduced from the outside into the container (30).

The present invention also discloses a container including: a container (30) containing contents; and a container cap (10) having the configuration described above, which is coupled to a container inlet (20) of the container (30).

At least one of the cover part (200) or the container inlet (12) may include a plurality of close contact parts that are in close contact with the container inlet (20), wherein the close contact part may have a close curve surrounding the container inlet (20) to prevent external air from being introduced from the outside into the container (30).

Advantageous Effects

The container cap and the container to which the container is coupled according to the present invention, when checking the opening traces of the container, is coupled to the container inlet and consists of a body part having an opening formed on the upper side, and a cover part opening and closing the opening of the body part, and the body part And by further comprising a separation part integrally formed with any one of the cover part and detachably coupled to the other one, there is an advantage in that it is easy to collect and use the waste plastic for recycling.

MODE FOR CARRYING OUT THE INVENTION

Figure 1:
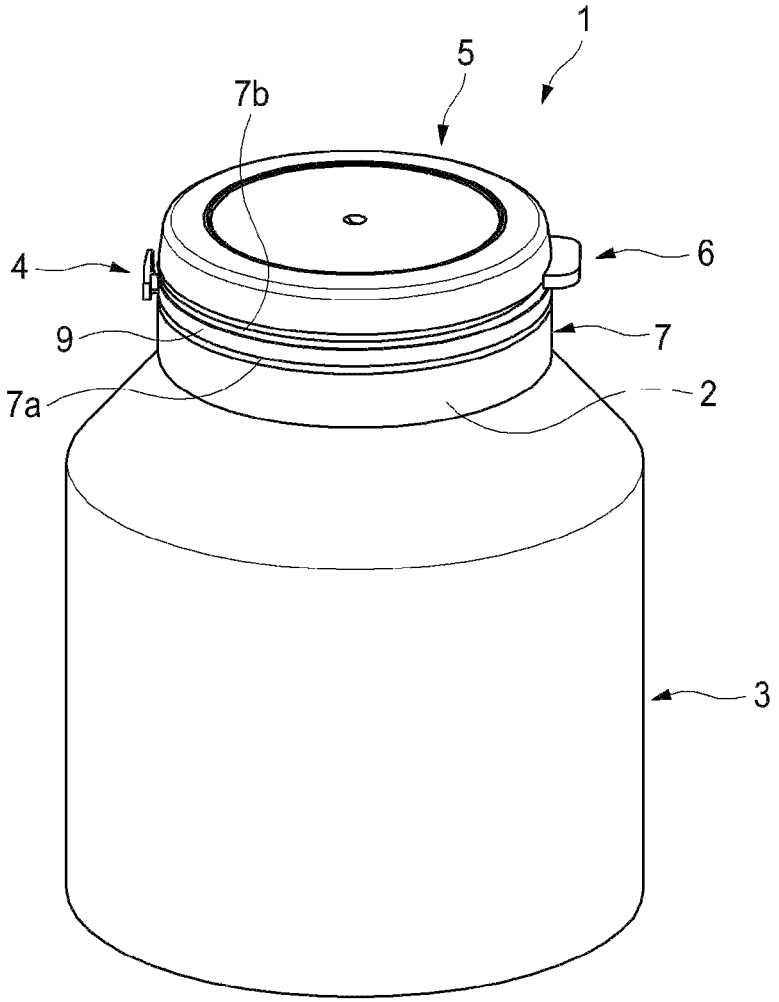
FIG. 1 is a perspective view illustrating a container to which a container cap is coupled according to the related art.
Figure 2:
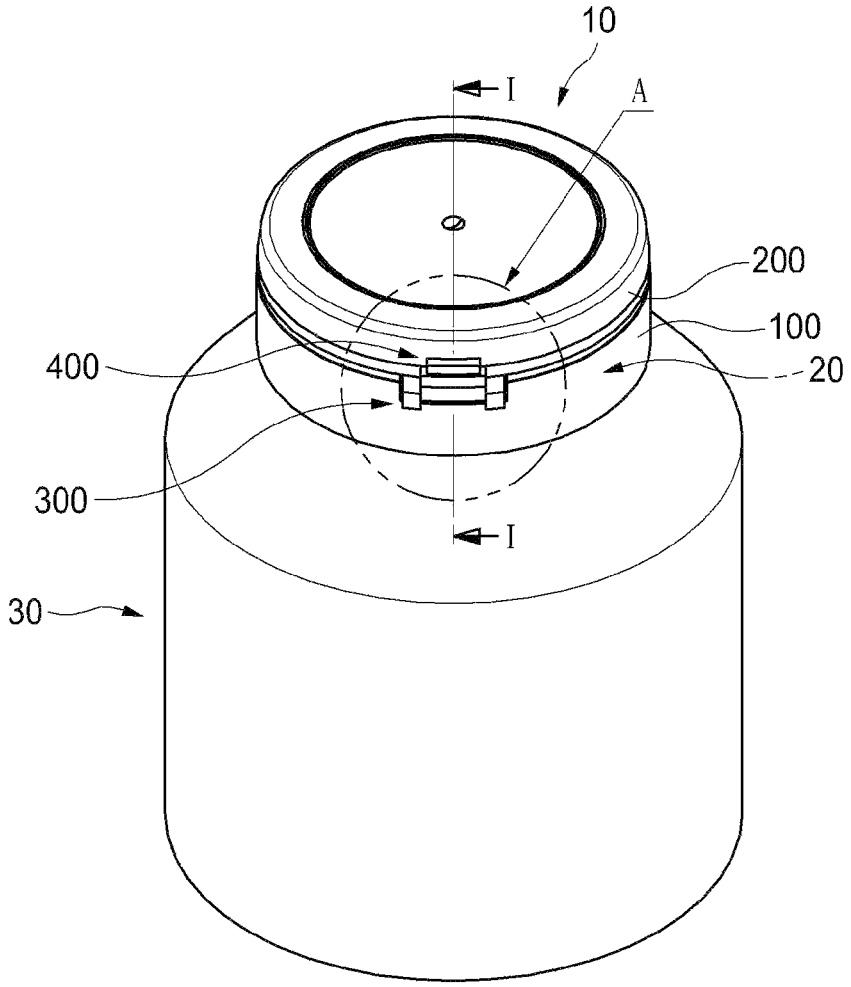
FIG. 2 is a perspective view illustrating a container to which a container cap is coupled according to a first embodiment of the present invention.
Figure 3:
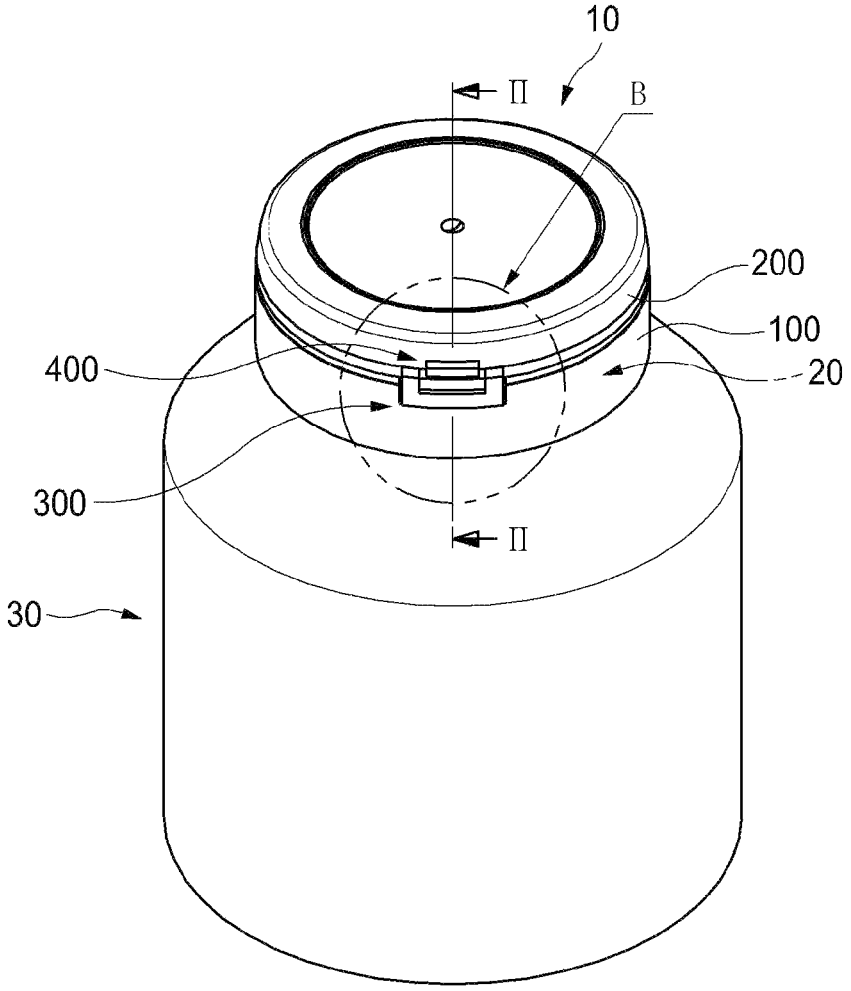
FIG. 3 is a perspective view illustrating a state in which a separation part is coupled to a fixing part in the container cap of FIG. 2.

Hereinafter, a container cap according to the present invention and a container (container assembly) to which the container cap is coupled will be described with reference to the accompanying drawings.

The container 30 may be a container containing contents that is provided in the form of granules or powder and may be variously configured as long as the container contains contents and also may have any shape and structure if a container inlet 20 to which a container cap 10 is coupled is formed.

Furthermore, the container 30 may contain contents that are provided in the form of granules or powder in consideration of coupling force of the container cap 10 according to the present invention and also may contain contents that are provided in a liquid phase.

In addition, in the container 30, a sealing member (not shown) may be coupled to an opening of the container inlet 20 to seal the container 30 in order to prevent deterioration of the contents before use.

The body part 100 may be a configuration that is coupled to the container inlet 20 of the container 30 containing the contents and may have various configurations according to the coupling structure with the container inlet 20.

For example, the body part 100 may have a ring shape corresponding to a horizontal cross-sectional shape of the container inlet 20 such as circular, oval, and polygonal shapes.

In addition, the body part 100 may be screw-coupled to a male screw formed on an outer circumferential surface of the container inlet 20. For this, a female screw that is screw-coupled to the male screw of the container inlet may be formed on an inner circumferential surface of the body part 100.

The cover part 200 may be a configuration that is coupled to the body part 100 to open and close an upper opening of the body part 100 and may have various configurations.

Particularly, the various configurations of the cover part 200 are possible according to the coupling structure with the body part 100.

Figure 4A:
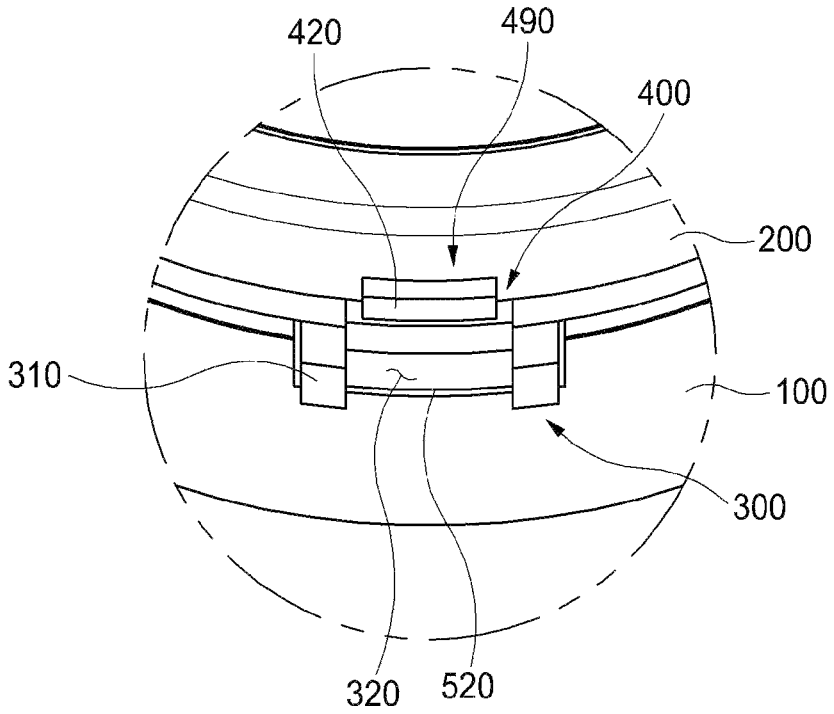
FIG. 4A is an enlarged perspective view of a portion A in FIG. 2.
Figure 4B:
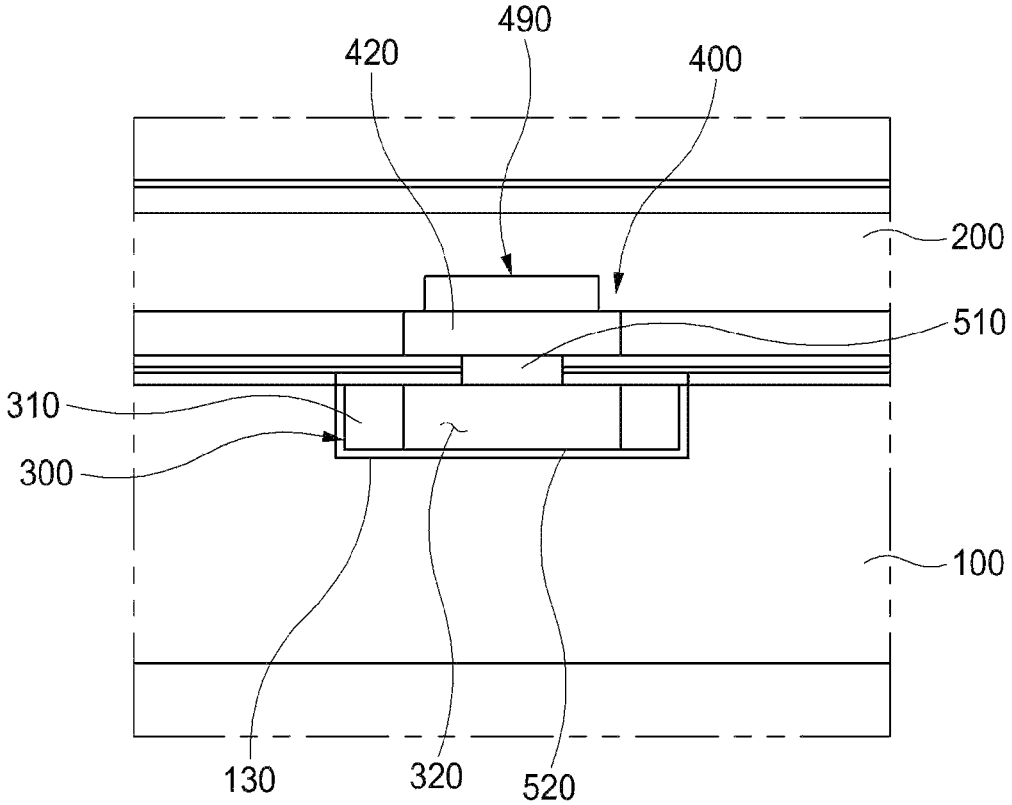
FIG. 4B is a partial front view when viewing the portion A illustrated in FIG. 4A from a front side.
Figure 4C:
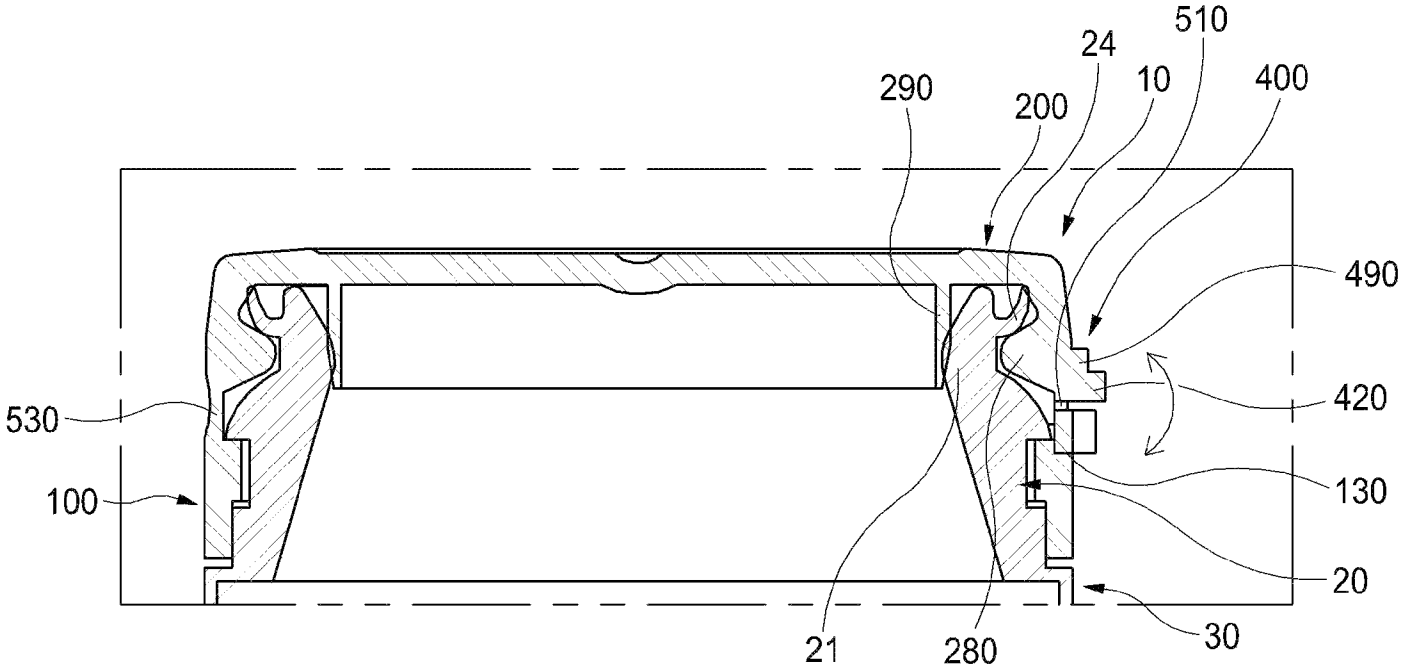
FIG. 4C is a cross-sectional view taken along line I-I in FIG. 2.

For example, the cover part 200 may be coupled to the body part 100 in a completely separable state—two piece structure, or as illustrated in FIG. 4C, may be integrally connected by a hinge part 530 so as to hingedly rotate when being separated with respect to the body part 100—two piece structure.

The hinge part 530 may be configured to integrally connect the cover part 200 to the body part 100 so that the cover part 200 hingedly rotates when the cover part 200 is separated with respect to the body part 100 and may have various configurations.

In addition, the cover part 200 may be connected vertically by a separating line (not shown) or a plurality of bridges (not shown) with respect to the body part 100 in consideration of the coupling force to the body part 100 before the opening.

For this configuration, the hinge part 530 may be integrally formed as in the case of the injection molding of the cover part 200 and the body part 100.

The cover part 200 may be coupled to the body part 100 in a state of being detachably coupled to the body part 100 except for a separation part 300 to be described later or in a state of being detachably coupled to the body part 100 except for the separation to be described later and the hinge part 530.

Here, the cover part 200 may be coupled to the body part 100 according to various conventional structures to close the upper opening of the body part 100 so as to maintain the coupled state with the body part 100 when the container 30 is not in use.

In addition, the cover part 200 may be coupled to a portion of an upper end of the container inlet 20 in addition to the coupling with the body part 100.

Here, the cover part 200 may be preferably coupled to the upper end of the cover part 200 so as to be separated from the body part 100 without rotation with respect to the container inlet 20.

Furthermore, it is preferable that the cover part 200 is coupled to the container inlet 20 by applying a blocking structure to be described later in order to prevent deterioration of the contents when being coupled to the upper end of the container inlet 20.

The container cap 10 according to the present invention may further include a configuration for checking use traces such as opening in a state of being initially coupled to the container inlet 20.

Specifically, the container cap 10 according to the present invention may further include a separation part 300 that is integrally connected to a first member, which is any one of the body part 100 and the cover part 200, by a first connection part 510 and that is integrally and separably connected to a second member, which is the other one of the body part 100 and the cover part 200, by a second connection part 520.

The separation part 300 may be a configuration that is integrally connected to the first member, which is any one of the body part 100 and the cover part 200, by the first connection part 510 and that is integrally and separably connected to the second member, which is the other one of the body part 100 and the cover part 200, by the second connection part 520 and also may have various configurations.

The first connection part 510 may be a configuration that integrally connects the first member, for example, the cover part 200 and the separation part 300 to be described later and may be preferably formed as a film (thin film) having a thickness less than that of a side surface of each of the cover part 200 and the body part 100 in consideration of movement of the separation part 300 after being separated.

In addition, the first connection part 510 may have various widths so that a width of the first connection part 510 in a circumferential direction is less than or equal to that of the separation part 300.

The second connection part 520 may be a configuration that detachably connects a second member, for example, the body part 100 and the separation part 300 to be described later, and may have various configurations.

Particularly, the second connection part 520 is characterized in that the second connection part 520 is separated by a user's manipulation so that the cover part 200 is separable from the body part 100.

Specifically, the second connection part 520 may have any configuration such as a cutting groove or a plurality of grooves so as to be easily separated by the user's manipulation as long as the second connection part 520 is separable by various manners such as easy separation, cutting, and the like by the user.

The second connection part 520 may be coupled to various structures and positions according to the formation structure of the separation part 300 and the second member, for example, the body part 100.

For example, the second connection part 520 may be connected horizontally and/or vertically along an edge of the separation part 300.

In addition, the second connection part 520 may be connected in a structure in which the separation part 300 is coupled to the separation part 300 and the second member, for example, an outer circumferential surface of the body part 100.

In addition, in the second connection part 520, the second member, for example, the body part 100 may be separably coupled to the first member, for example, the cover part 200.

The separation part 300 may be a configuration that is integrally connected to the first member and is separably connected to the second member and may be implemented in various embodiments according to the coupling and separation manners of the cover part 200 and the body part 100.

Here, the separation part 300 may vertically connect the body part 100 to the cover part 200 as illustrated in FIGS. 2 to 20B.

In addition, it is preferable that the first member, for example, the cover part 200 includes a fixing part 400 to which the separation part 300 is fixed after being separated from the second member.

The fixing part 400 may be a configuration formed on the first member, for example, the cover part 200, so that the separation part 300 is fixed after being separated from the second member and may have various configurations according to the coupling structure with the separator 300.

For example, as illustrated in FIGS. 2 to 20B, the separation part 300 may be fitted with the fixing part 400 so as to be fixed to the fixing part 400.

Here, as illustrated in FIGS. 2 to 17B, the separation part 300 may be coupled to the fixing part 400 by folding the first connecting part 510 in the vertical direction.

Also, the fixing part 400 may be formed on the outer circumferential surface of the first member and may include one or more second fitting part 420 that is fitted with one or more first fitting part 320 provided in the separation part 300.

In addition, as illustrated in FIGS. 18A to 20B, the separation part 300 may move in the vertical direction so as to be coupled to the fixing part 400.

The fixing part 400 may include one or more second fitting part 420 formed on the outer circumferential surface of the first member and fitted with one or more first fitting part 320 provided in the separation part 300.

The first fitting part 320 and the second fitting part 420 may be a configuration to be coupled by fitting of various structures as illustrated in FIGS. 2 to 21C and may have various configurations such as a protrusion, a concave groove, and the like.

The separation part 300 may connect the body part 100 to the cover part 200 in a circumferential direction.

In addition, the separation part 300 may be separated from the second member along the circumferential direction and fixedly coupled to the fixing part 400 formed on the first member.

The connection structure as described above may be implemented by disposing and connecting the structures illustrated in FIGS. 2 to 20B in the circumferential direction rather than the vertical direction.

Figure 21A:
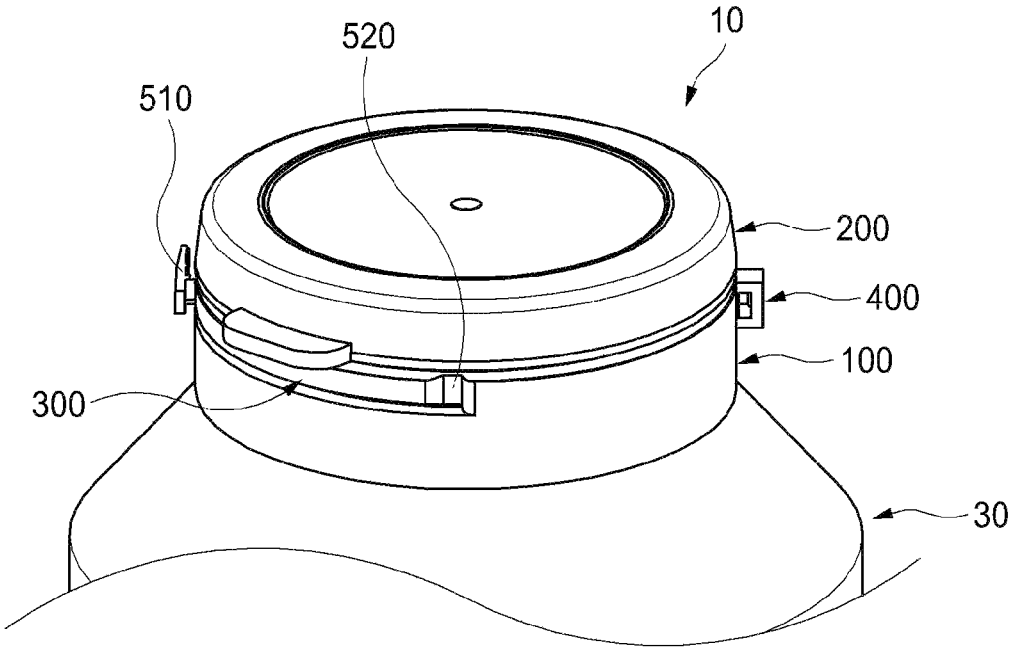
FIG. 21A is a perspective view illustrating a container cap according to a tenth embodiment of the present invention.
Figure 21B:
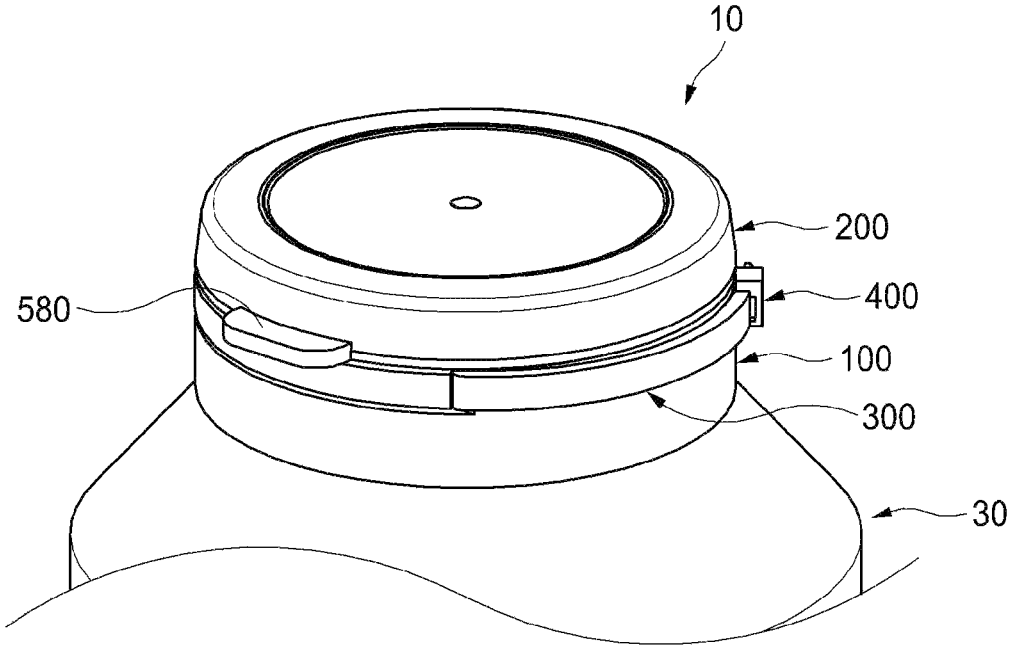
FIG. 21B is a perspective view illustrating a state in which a separation part is coupled to a fixing part in the container cap illustrated in FIG. 21A.
Figure 21C:
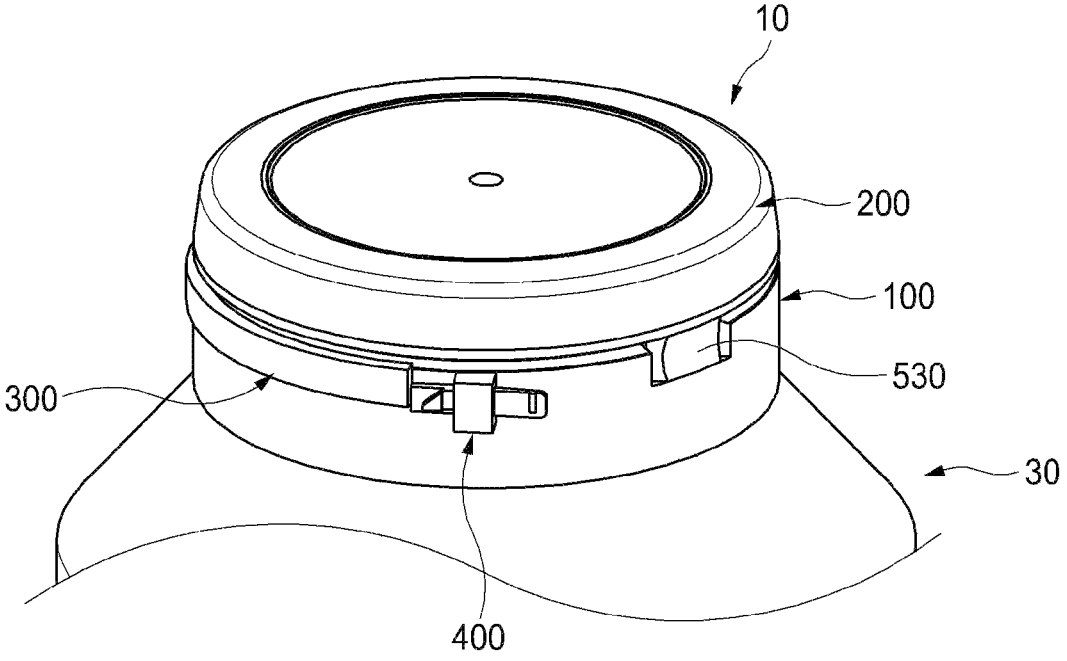
FIG. 21C is a perspective view illustrating the state illustrated in FIG. 21B from a different angle.

As another example, as illustrated in FIGS. 21A to 21C, the separation part 300 may have a belt structure coupled between the first member and the second member by the plurality of bridges and may be inserted and fixed to the fixing part 400 formed on the circumferential surface of the second member after being separated from the second member.

A coupling operation of the separation part 300 with respect to the fixing part 400 may be coupled at various angles, such as being rotated upwardly at an angle of 90° to be coupled or rotated by 180° to be coupled.

In addition, the coupling structure of the separation part 300 and the fixing part 400 may be any structure as long as the coupling structure is provided as a protruding portion and has a structure in which a protruding portion corresponding to the protruding part is inserted.

Figure 5A:
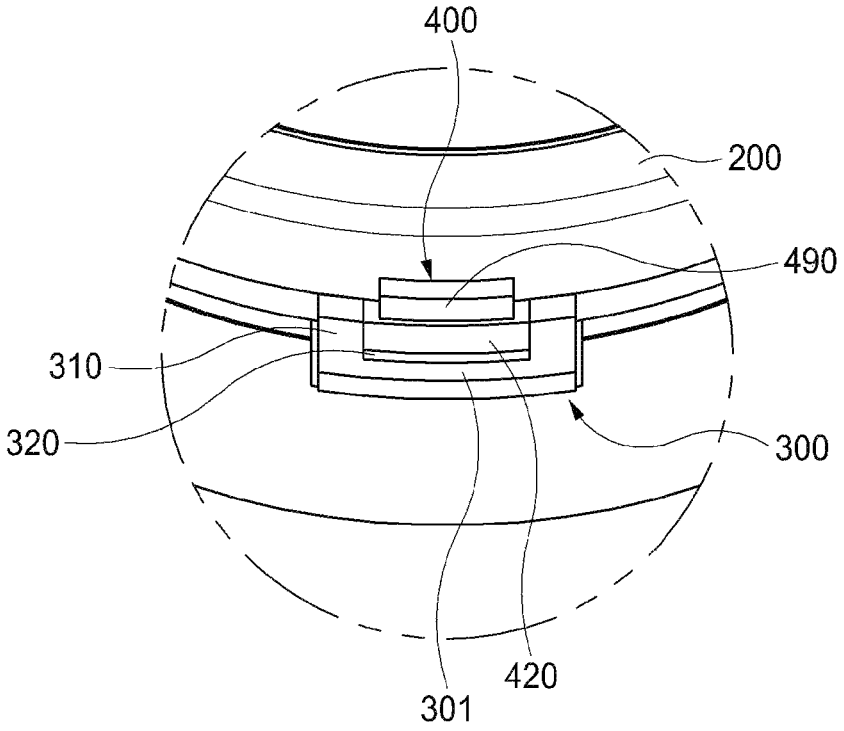
FIG. 5A is an enlarged perspective view of a portion B in FIG. 3.
Figure 5B:
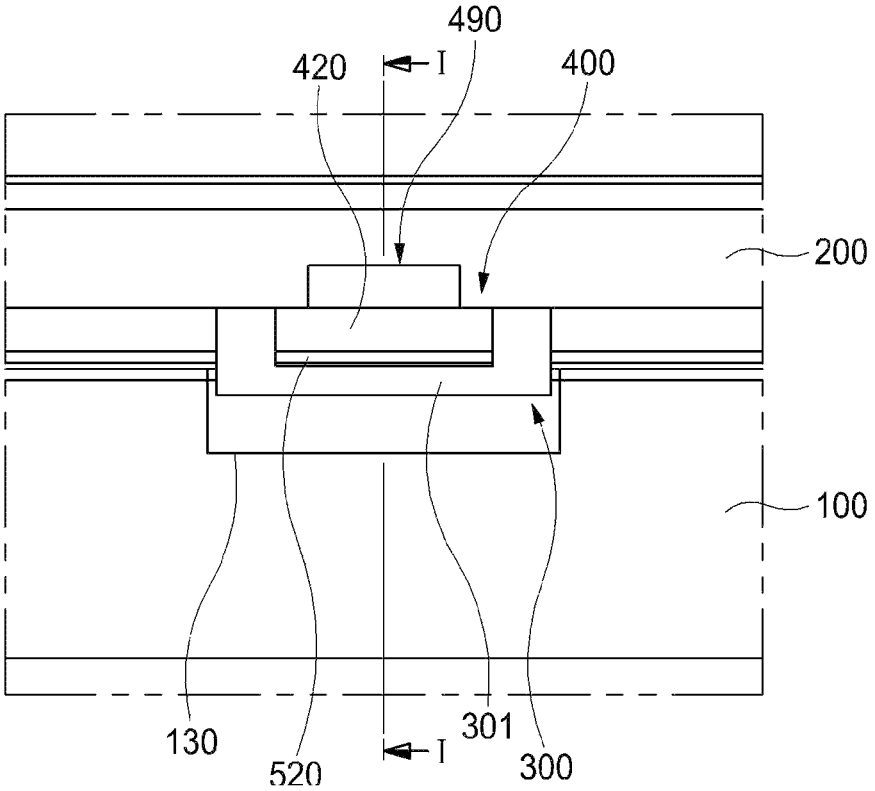
FIG. 5B is a partial front view when viewing the portion B illustrated in FIG. 5A from a front side.
Figure 5C:
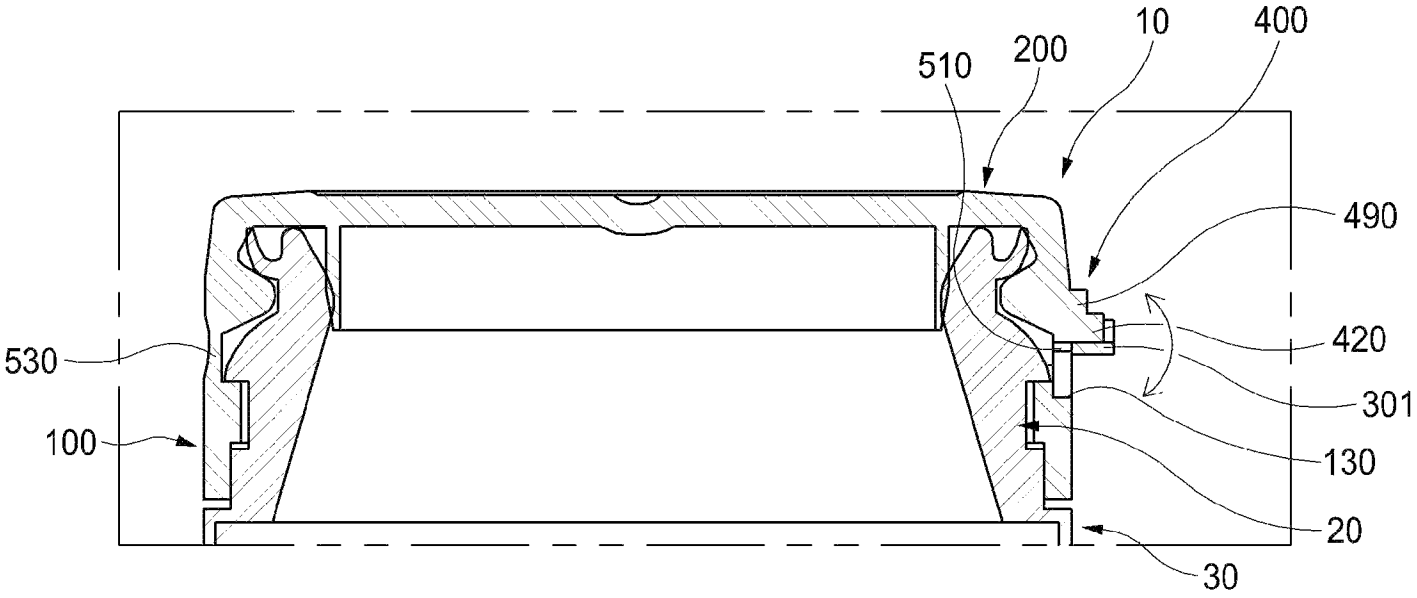
FIG. 5C is a cross-sectional view taken along line II-II in FIG. 3.
Figure 5D:
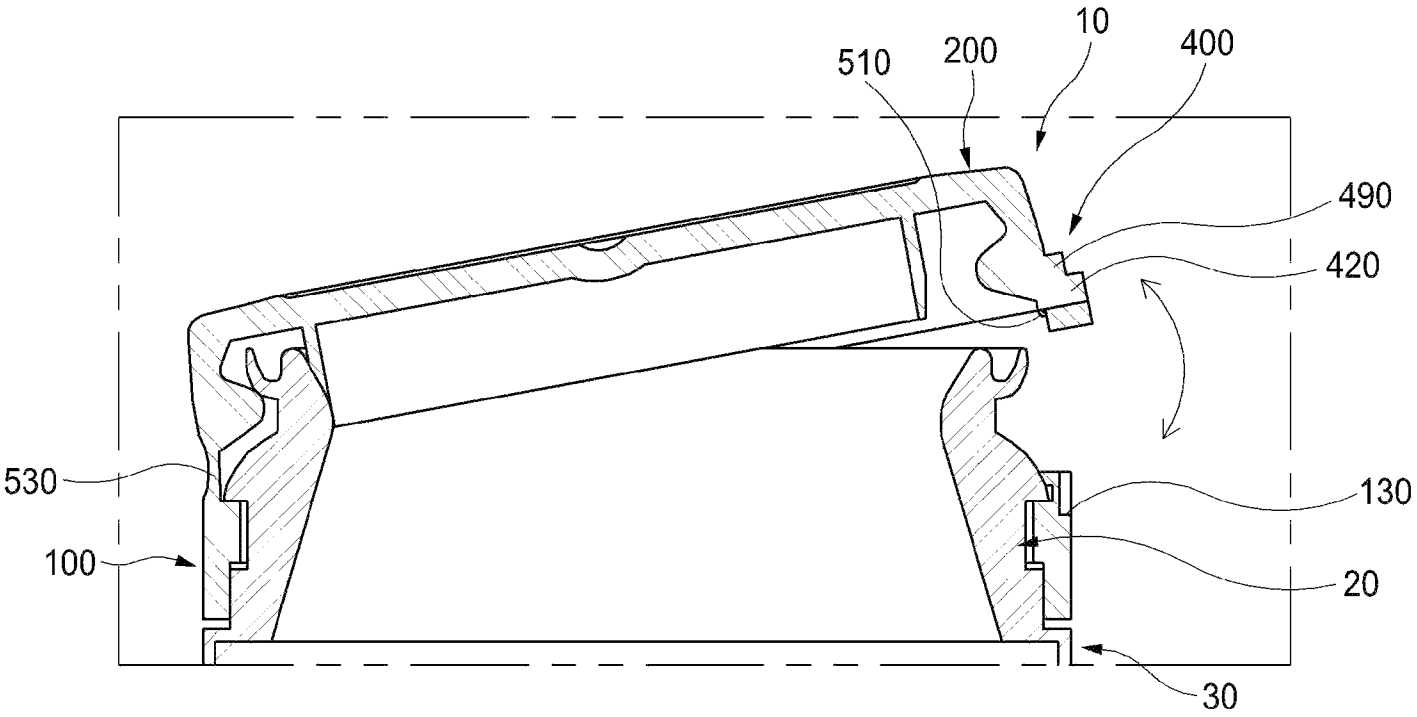
FIG. 5D is a cross-sectional view illustrating a state in which a cover part is separated from a body part in the view of FIG. 5C.
Figure 6:
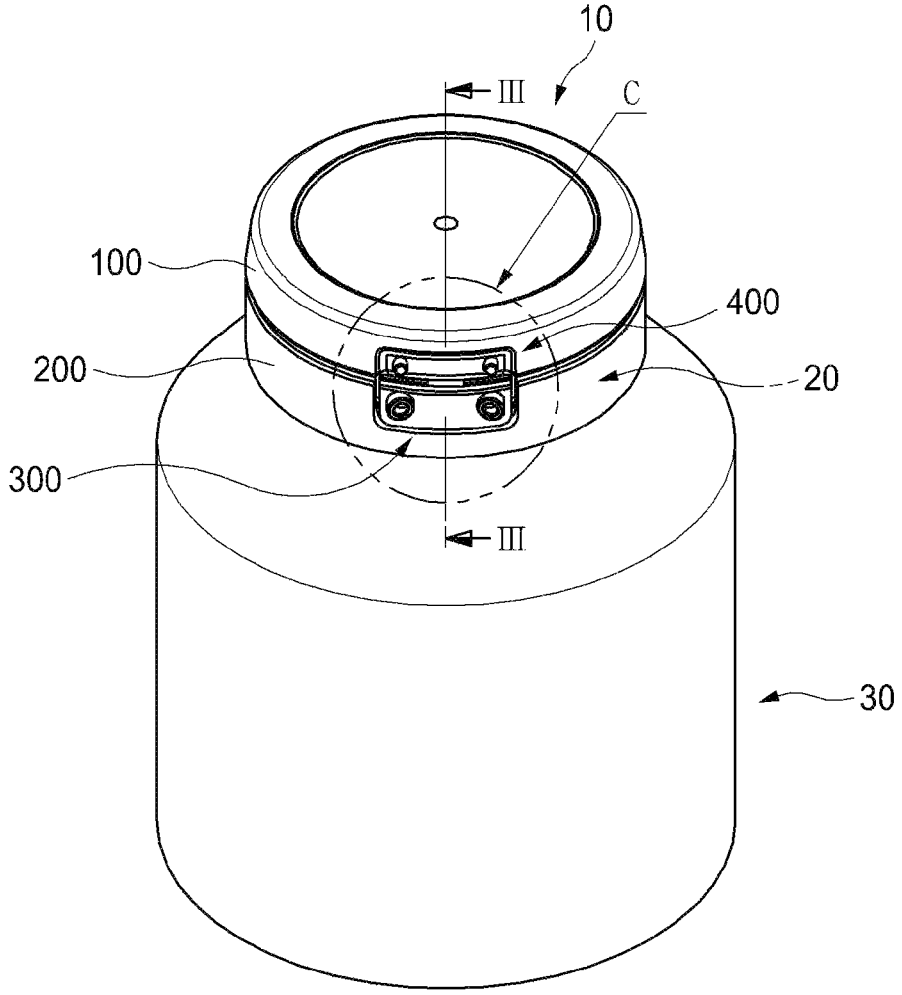
FIG. 6 is a perspective view illustrating a container to which a container cap is coupled according to a second embodiment of the present invention.
Figure 7:
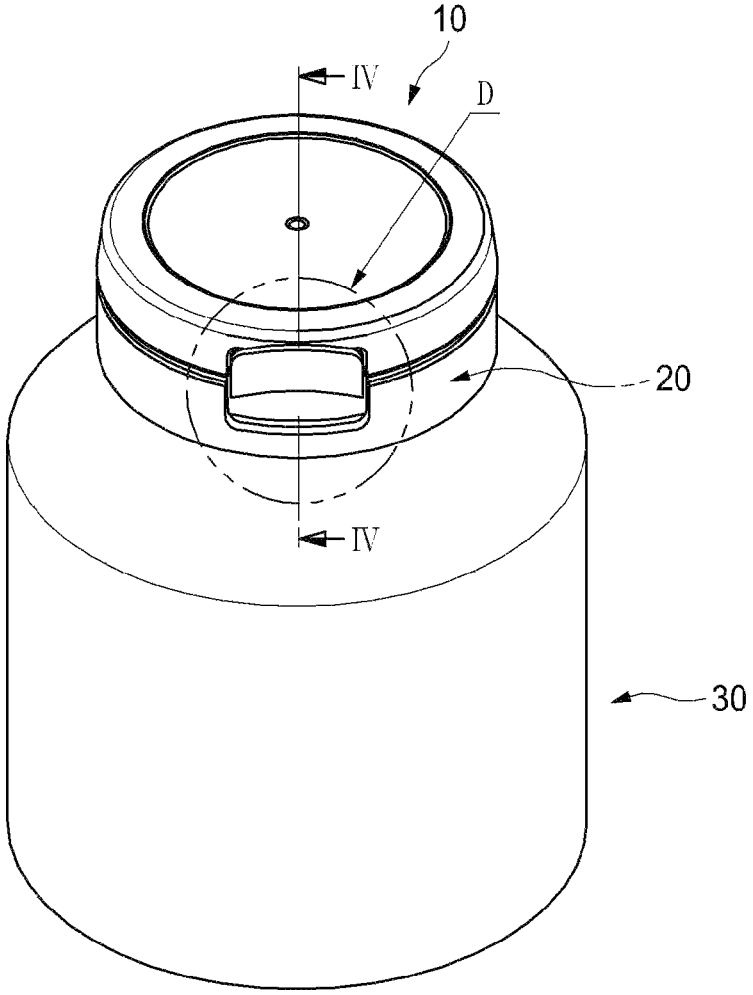
FIG. 7 is a perspective view illustrating a state in which a separation part is coupled to a fixing part in the container cap of FIG. 6.

Particularly, a primary operation for pushing the separation part 300 upward to be coupled to the fixing part 400 and a secondary operation for pushing the separation part 300 and the fixing part 400, which are coupled to each other, upward to be opened upward as illustrated in FIG. 5D may be performed in one operation—one touch manner —, and thus, the container 30 may be easily opened.

Hereinafter, with respect to the configuration of the separation part 300, embodiments of the separation part 300 will be described using the cover part 200 as the first member and the body part 100 as the second member in consideration of the convenience of separating the cover part 200.

First Embodiment (FIGS. 2 to 5C)

Hereinafter, a first embodiment of the coupling structure of the separation part and the fixing part will be described.

The separation part 300 may be, as illustrated in FIGS. 2 and 4A to 4C, a first fitting part 320, and a base part 301 formed to protrude from the cover part 200 to the body part 100 and a pair of protrusions 310 protruding in a radial direction may be formed at intervals in the circumferential direction.

Here, the separation part 300 is connected to the body part 100 by a second connection part 520 provided as a cutting line or a plurality of bridges (not shown).

Also, in the body part 100, the concave groove 130 having a shape corresponding to a front shape of the separation part 300 is formed to be recessed.

Also, in the fixing part 400, a first fitting part 320 formed by the pair of protrusions 310, i.e., one or more second fitting part 420 having a width corresponding to the concave groove may be formed to protrude from the outer circumferential surface of the cover part 200.

The second fitting part 420 may be a configuration formed on the outer circumferential surface of the cover part 200 as a protrusion having a width corresponding to the concave groove formed by the pair of protrusions 310 and may have various configurations.

The formed positions of the separation part 300 and the fixing part 400 may be disposed at positions opposite to the hinge part 530 described above, and the separation part 300 and the fixing part 400, which are coupled to each other, may be used as a handle for opening the container 30 by separating the cover part 200 from the body part 100 due to the user's manipulation.

Here, the separation part 300 may be folded upward by the user's manipulation. Simultaneously, the second connection part 520 may be cut, and as illustrated in FIGS. 3 and 5A to 5D, the first connection part 510 may be folded upward so that the separation part 300 and the fixing part 400 are coupled to each other.

The separation part 300 and the fixing part 400, which are coupled to each other as described above, may separate the cover part 200 from the body part 100 by the user's manipulation so that the container 30 is opened by one operation, so-called one touch operation.

Second Embodiment (FIGS. 6 to 9C)

Hereinafter, a second embodiment of the separation part and the fixing part will be described.

A structure according to the second embodiment has a different coupling structure with the fixing part when compared to the first embodiment.

First, the second fitting part 420 of the fixing part 400 may be constituted by one or more protrusions that are inserted into a fitting grove 321 formed in the first fitting part 320 of the separation part 300 as illustrated in FIGS. 6 and 8A to 8C.

The protrusion may be a configuration that is inserted into the fitting groove 321 formed in the first fitting part 320 of the separation part 300 and may correspond to the number and position of the fitting groove 321 formed in the first fitting part 320 of the separation portion 300.

Also, the first fitting part 320 of the separation part 300 may be formed to protrude from a base part 301 formed to protrude from the cover part 200 to the body part 100 and may be provided as a fitting column in which the fitting grove 321, into which the protrusion formed on the fixing part 400 is fitted.

The fitting column may be formed to protrude from the base part 301 formed to protrude from the cover part 200 to the body part 100 and may be variously provided as a configuration in which the fitting grove 321, into which the protrusion formed on the fixing part 400 is fitted.

Figure 8A:
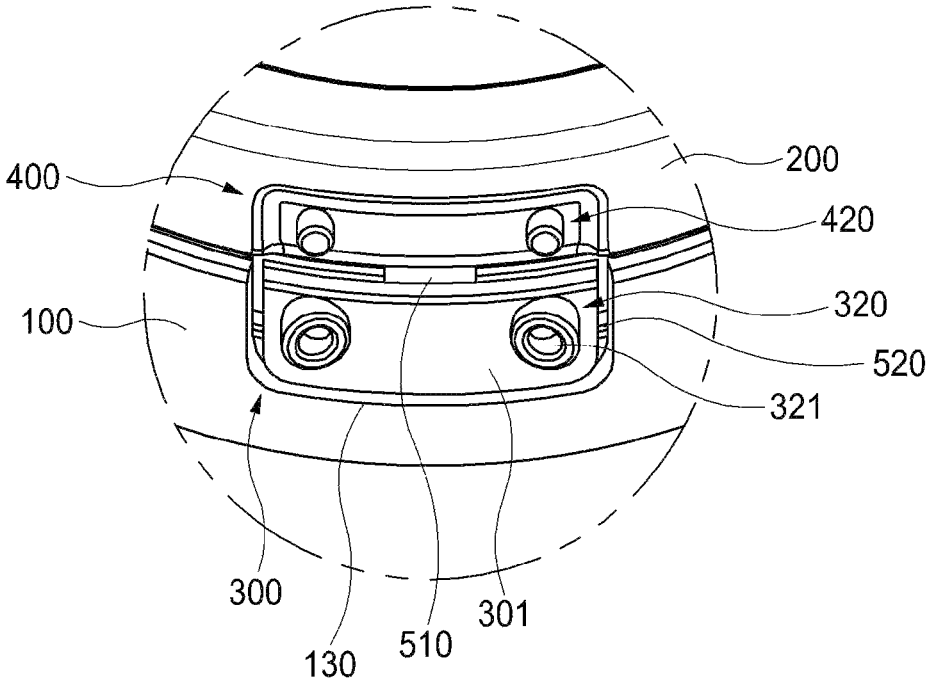
FIG. 8A is an enlarged perspective view of a portion C in FIG. 6.
Figure 8B:
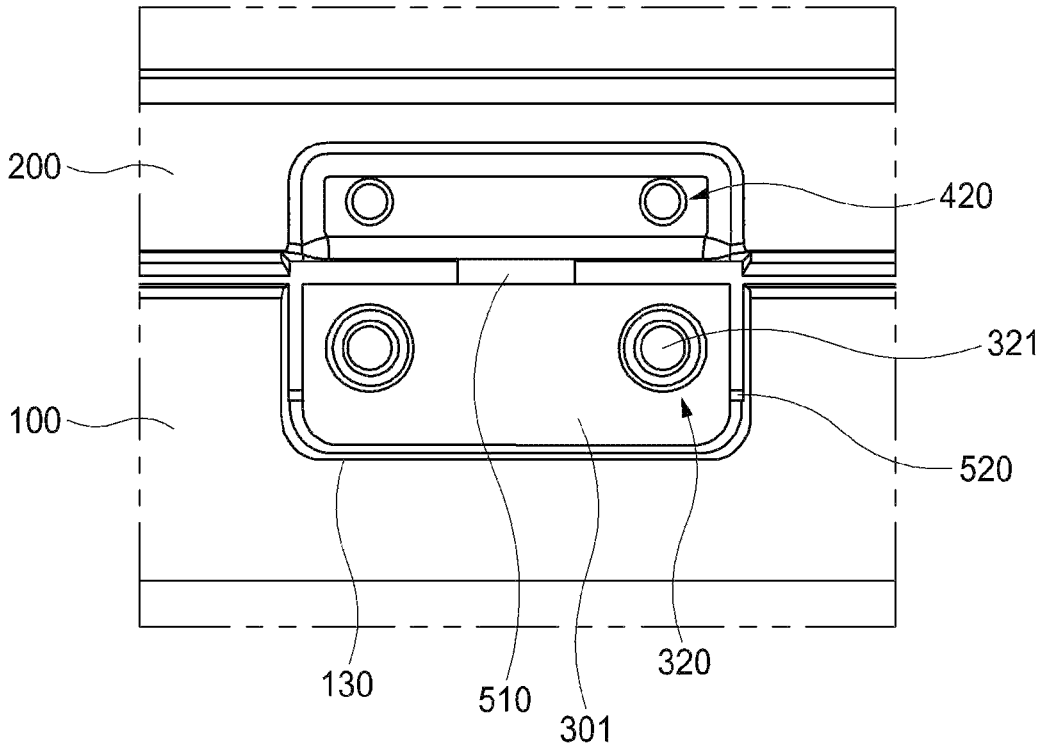
FIG. 8B is a partial front view when viewing the portion C illustrated in FIG. 8A from a front side.
Figure 8C:
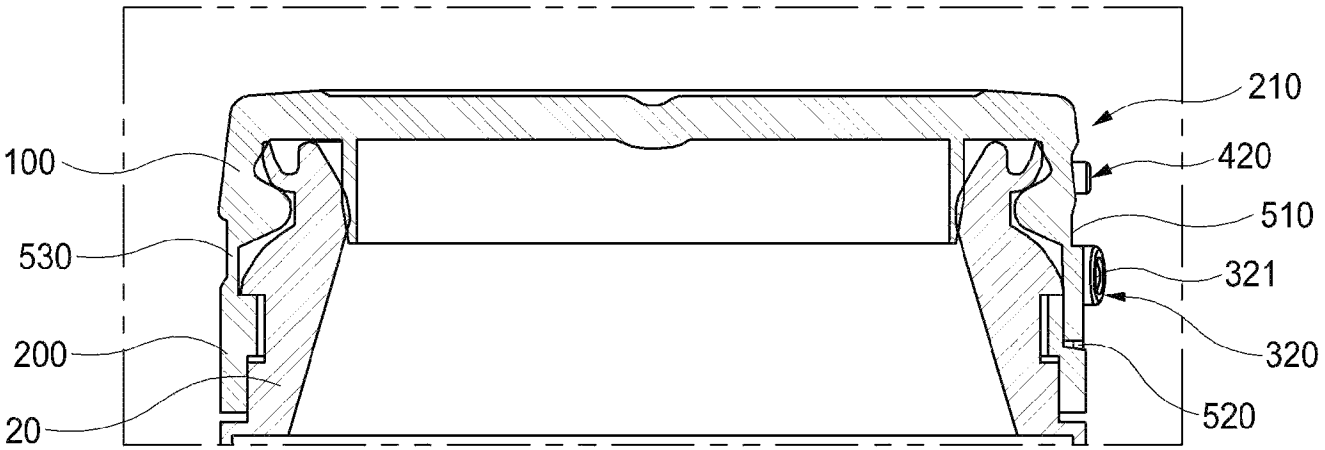
FIG. 8C is a cross-sectional view taken along line III-III in FIG. 6.
Figure 9A:
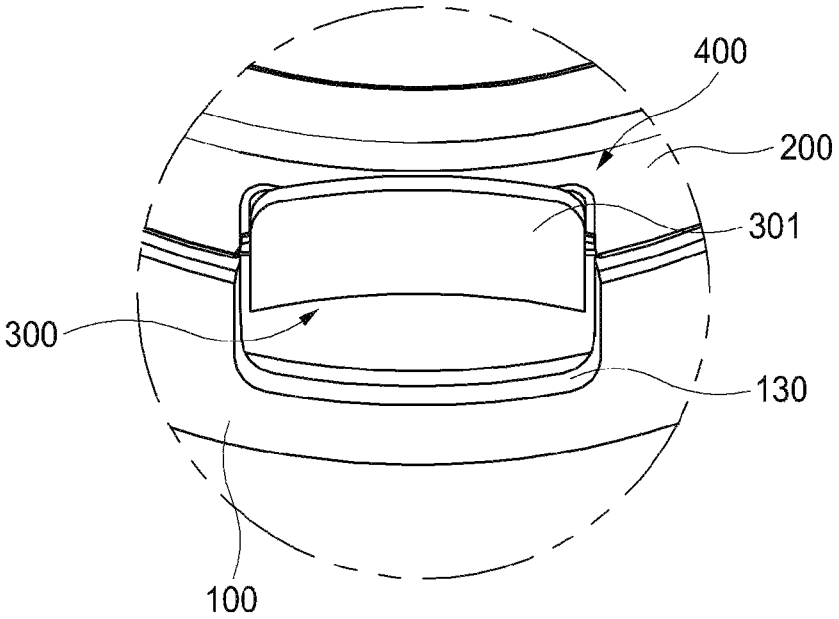
FIG. 9A is an enlarged perspective view of a portion D in FIG. 7.
Figure 9B:
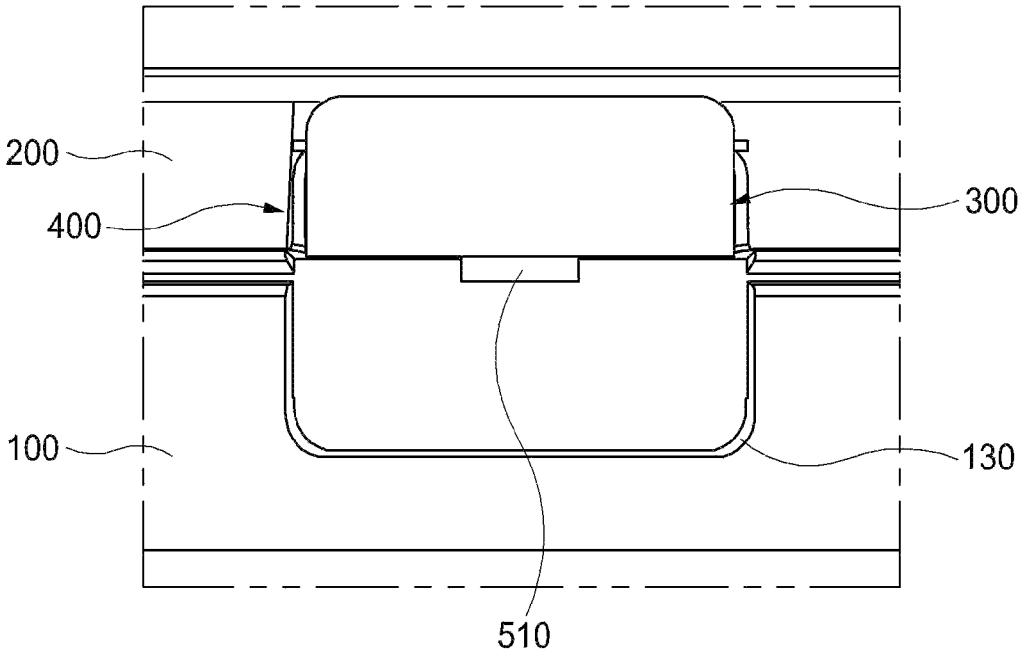
FIG. 9B is a partial front view when viewing the portion D illustrated in FIG. 9A from a front side.
Figure 9C:
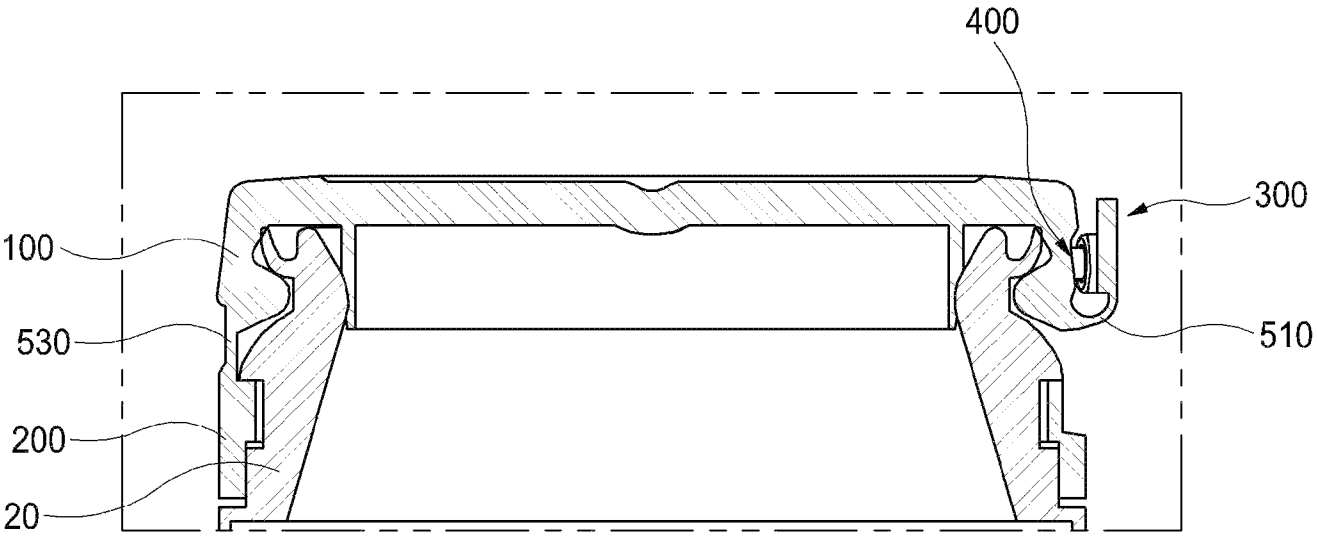
FIG. 9C is a cross-sectional view taken along line IV-IV in FIG. 7.

Particularly, as illustrated in FIG. 8A, the fitting column may be preferably formed to have an end inclined in the circumferential direction so that the separator 300 is folded upward, and the protrusion of the fixing part 400 is easily inserted and fixed.

More specifically, the fitting column may be formed as a pair, and in this case, the ends may be formed to be inclined downward in a direction facing each other.

The separation part 300 is connected to the body part 100 by a second connection part 520 provided as a cutting line or a plurality of bridges (not shown).

Also, in the body part 100, the concave groove 130 having a shape corresponding to a front shape of the separation part 300 is formed to be recessed.

The formed positions of the separation part 300 and the fixing part 400 may be disposed at positions opposite to the hinge part 530 described above, and the separation part 300 and the fixing part 400, which are coupled to each other, may be used as a handle for opening the container 30 by separating the cover part 200 from the body part 100 due to the user's manipulation.

Here, the separation part 300 may be folded upward by the user's manipulation At this time, the second connection part 520 may be cut so that the separation part 300 is separated from the body part 100.

In addition, as illustrated in FIGS. 7 and 9A to 9C, in the separation part 300, the first connection part 510 is folded upward, and the separation part 300 is coupled and fixed to the fixing part 400.

Third Embodiment (FIGS. 10A to 11C)

Hereinafter, a third embodiment of the coupling structure of the separation part and the fixing part will be described.

A coupling structure of a separation part and a fixing part according to the third embodiment is a modified example of a fitting structure when compared to the first and second embodiments.

Figure 10A:
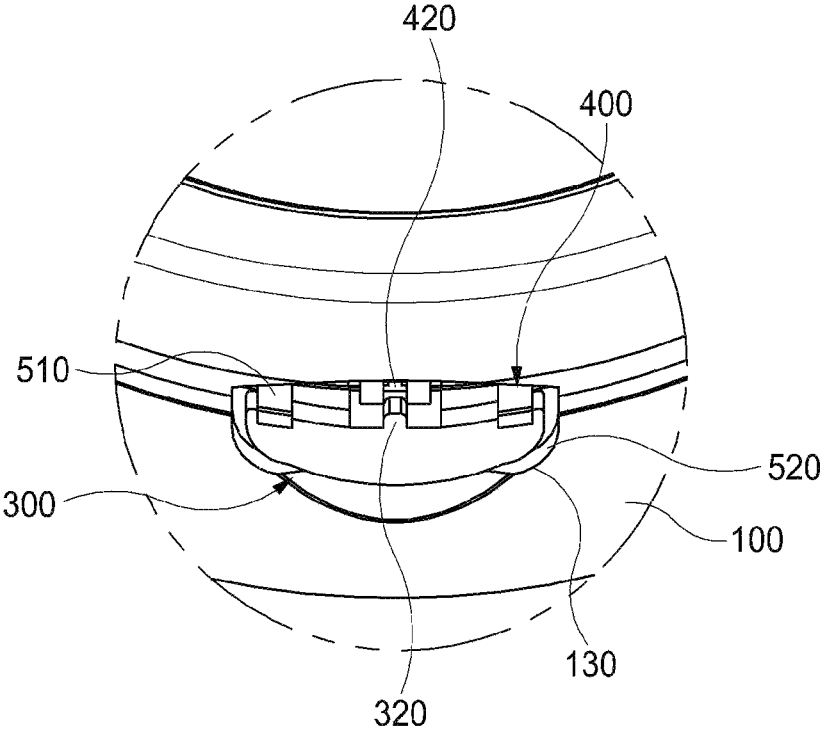
FIG. 10A is a partial perspective view illustrating a container cap according to a third embodiment of the present invention.
Figure 10B:
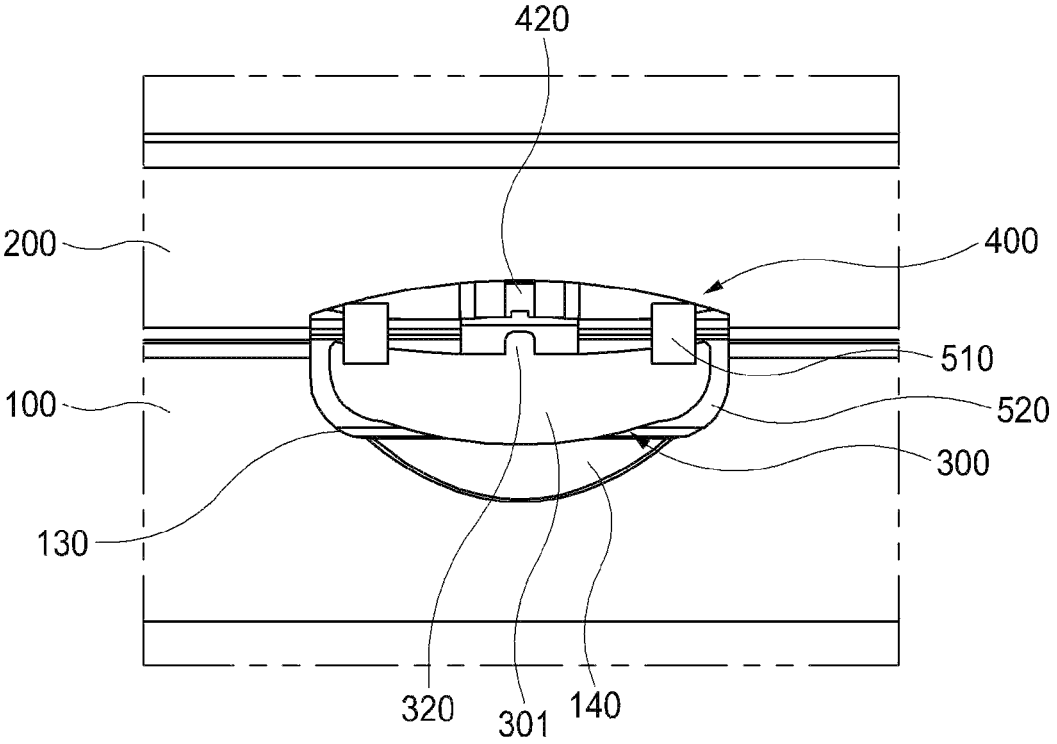
FIG. 10B is a partial front view when viewed in a front view of FIG. 10A.
Figure 10C:
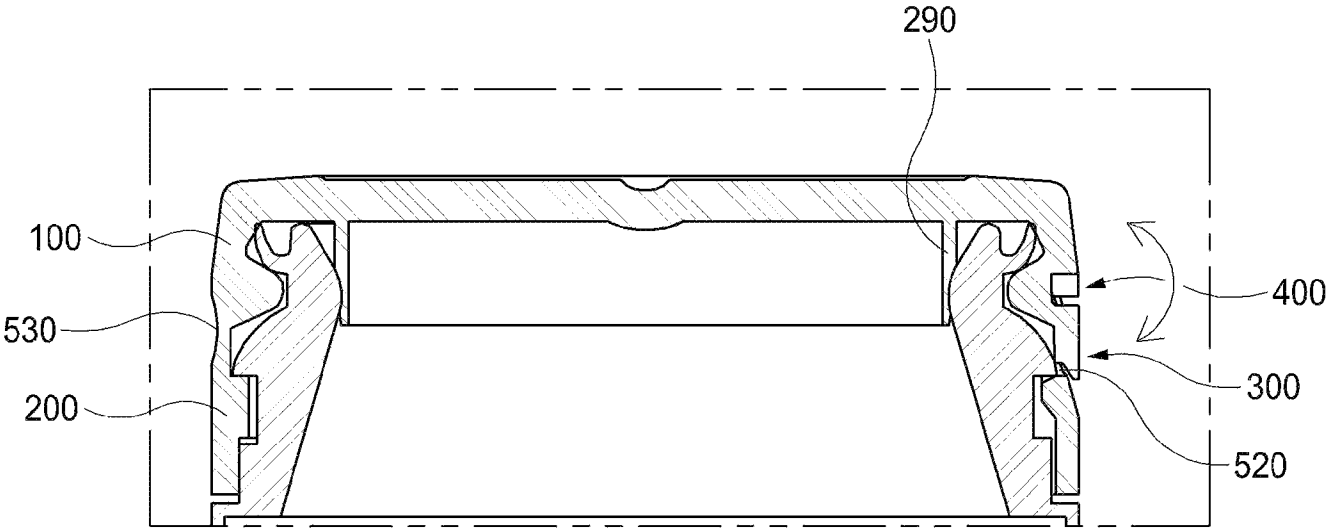
FIG. 10C is a cross-sectional view of FIG. 10A.
Figure 11A:
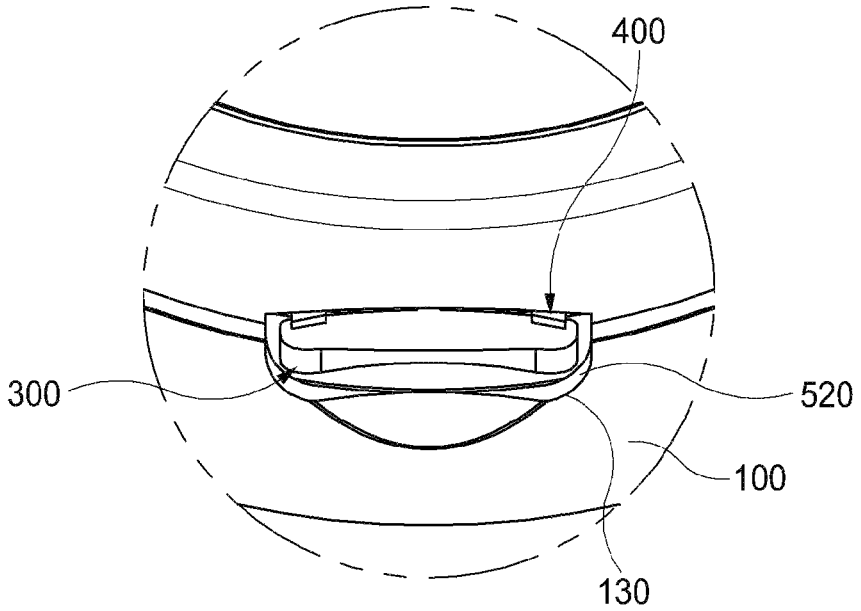
FIG. 11A is a partial perspective view illustrating a state in which a separation part is coupled to a fixing part in the container cap illustrated in FIG. 10A.
Figure 11B:
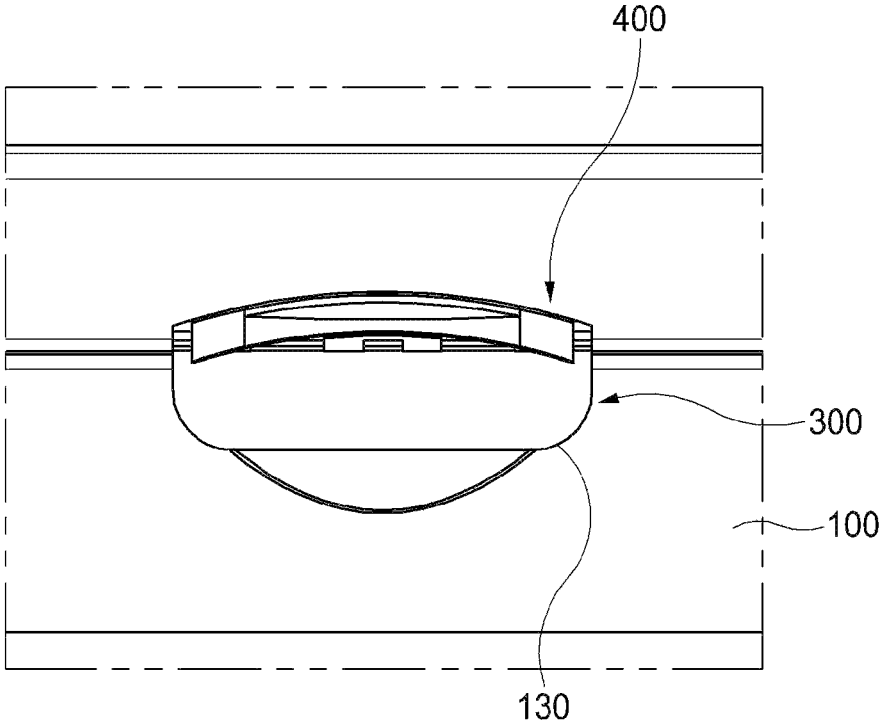
FIG. 11B is a partial front view when viewed in a front view of FIG. 11A.
Figure 11C:
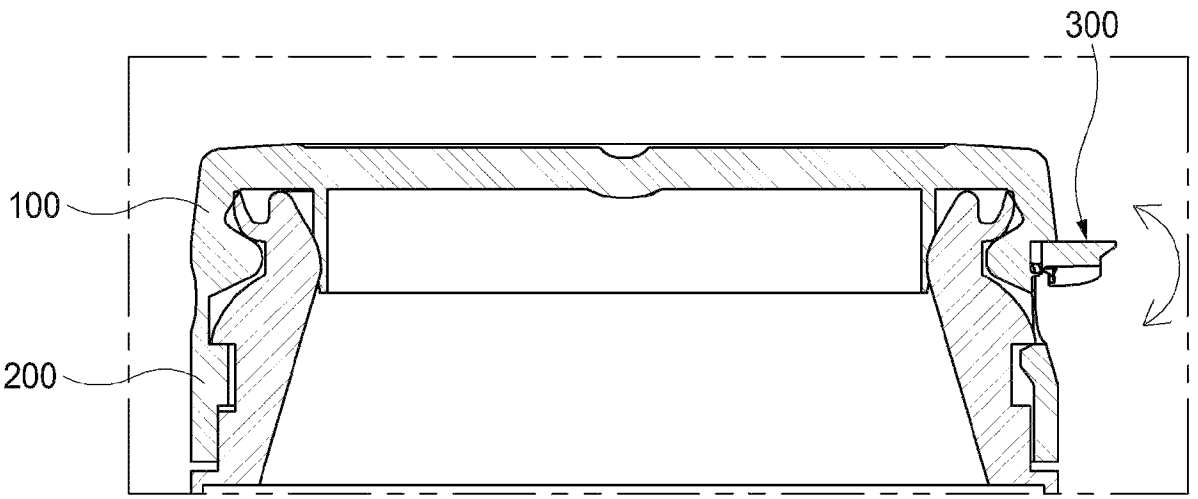
FIG. 11C is a cross-sectional view of FIG. 11A.
Figure 12A:
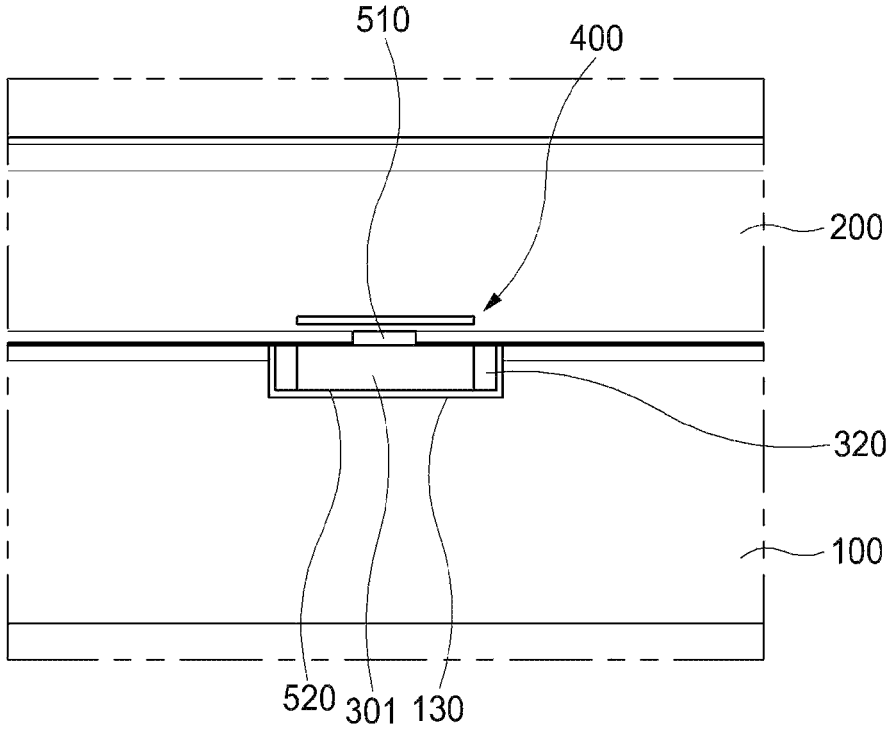
FIG. 12A is a front view illustrating a container cap according to a fourth embodiment of the present invention.
Figure 12B:
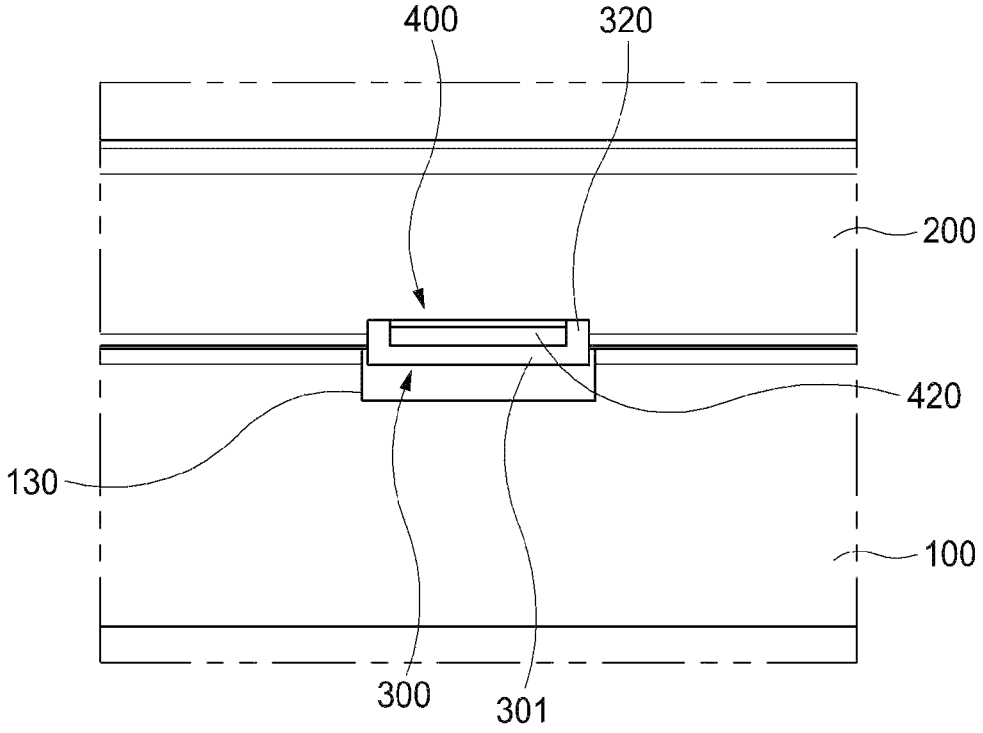
FIG. 12B is a front view illustrating a state in which a separation part is coupled to a fixing part in the container cap illustrated in FIG. 12A.
Figure 13A:
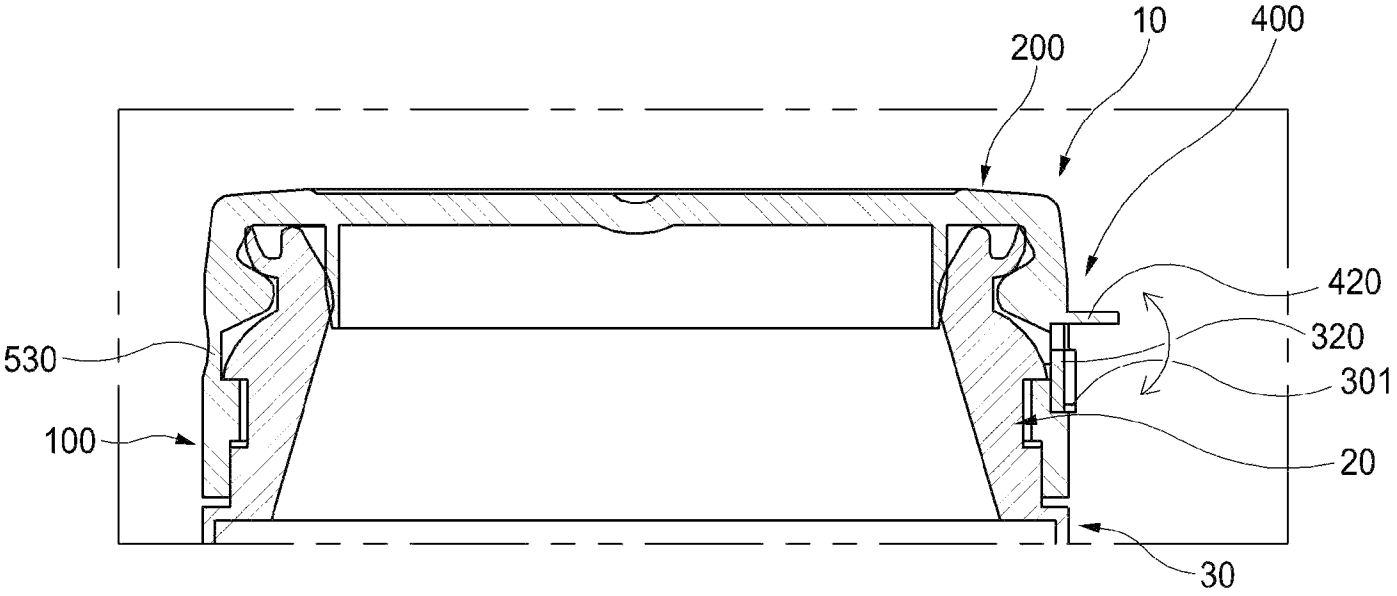
FIG. 13A is a partial cross-sectional view of the container cap illustrated in FIG. 12A.
Figure 13B:
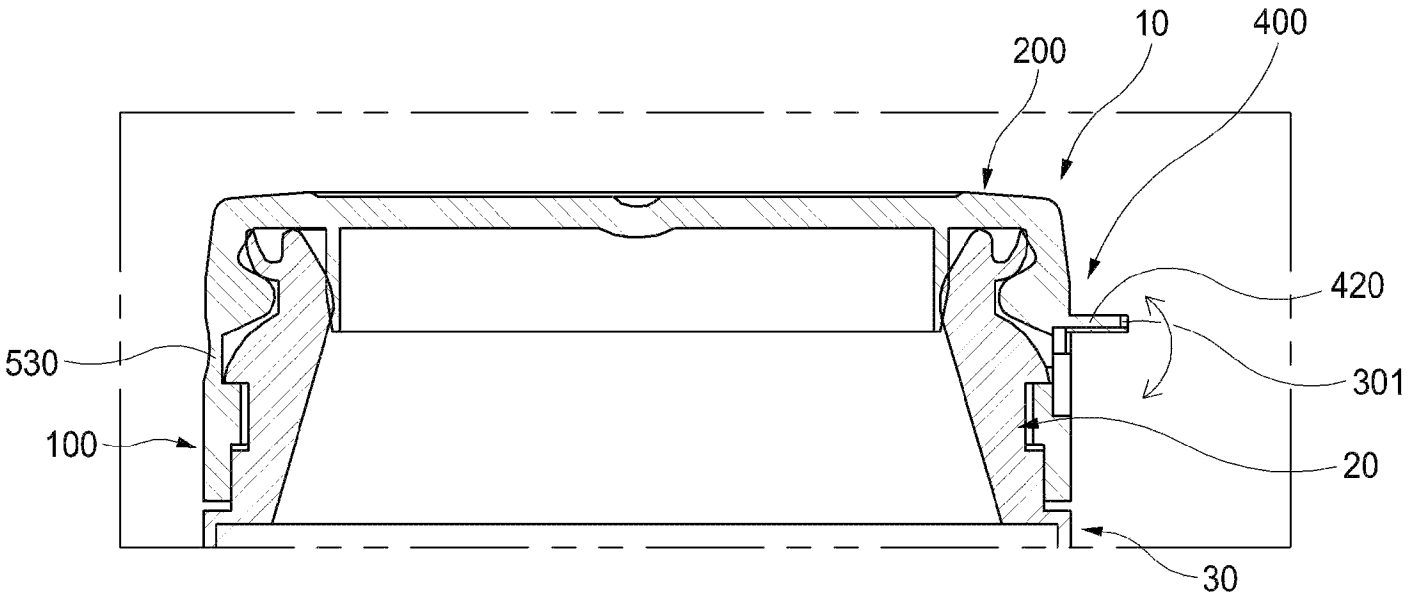
FIG. 13B is a partial cross-sectional view of the container cap illustrated in FIG. 12B.

As illustrated in FIGS. 10A to 10C, the separation part 300 includes a base part 301 protruding from a cover part 200 to a body part 100 and a first fitting part 320 as a protrusion formed to protrude from an upper end of the base part 301.

The base part 301 may be a configuration that is formed separably from the body part 100 by a second connection part 520 and may have various shapes.

Here, in order to form the base part 301, a concave groove 130 having a shape corresponding to a front shape of the separation part 300 is formed to be recessed in the body part 100.

At this time, a portion in which the concave groove 130 is formed may correspond to a lower end of the separation part 300 as shown in FIGS. 10A to 11C so that the separation part 300 is easily separated, and an inclined portion 140 facing a bottom surface of the separation part 300 may be formed.

The inclined portion 140 may correspond to the lower end of the separation part 300 and be inclined toward the bottom surface of the separation part 300, and thus, a user's finger may be caught on the lower end of the separation part 300 so that the separation part 300 is easily separated.

The separation part 300 may be connected to the cover part 200 by a first connection part 510, and the first connection part 510 may be connected in various structures.

That is, the first connection part 510 may be provided in a pair to integrally connect the separation part 300 to the cover part 200 at both sides, unlike the first and second embodiments.

In addition, the first fitting part 320 may be configured as a protrusion formed to protrude from an upper end of the base part 301, and also, one protrusion may be formed to protrude from a center.

The fixing part 400 coupled to the separation part 300 may be a concave groove into which the first fitting part 320 described above is inserted, and a second fitting part 420 may be formed therein.

Here, the fixing part 400 may have a structure into which a remaining portion of the upper end of the base part 301 is inserted, and a concave groove may be formed therein.

As described above, the separation part 300 and the fixing part 400 may be disposed at positions opposite to the hinge part 530 described above, and the separation part 300 and the fixing part 400, which are coupled to each other, may be used as a handle for opening the container 30 by separating the cover part 200 from the body part 100 due to the user's manipulation.

Fourth Embodiment (FIGS. 12A to 13B)

Hereinafter, a fourth embodiment of the coupling structure of the separation part and the fixing part will be described.

A coupling structure of the separation part and the fixing part according to the fourth embodiment is a modified example of the second fitting part 420 constituting the fixing part 400 when compared to the first embodiment.

In the case of the coupling structure of the separation part and the fixing part according to the first embodiment illustrated in FIGS. 2 to 5C, a protrusion constituting the second fitting part 420 of the fixing part 400 may be folded by a distribution process or user's carelessness, and thus, the cover part 200 may be separated from the body part 100.

Thus, in the configuration of the first embodiment, as illustrated in FIGS. 12A to 13B, the second fitting part 420 of the fixing part 400 may be provided as a thin film.

When the second fitting part 420 of the fixing part 400 is provided as the thin film, only the second fitting part 420 of the fixing part 400 may be folded upward to allow the cover part 200 to be separated from the body part 100 even though upward force is applied to the second fitting part 420 of the fixing part 400 due to the distribution process or the user's carelessness.

Figure 14A:
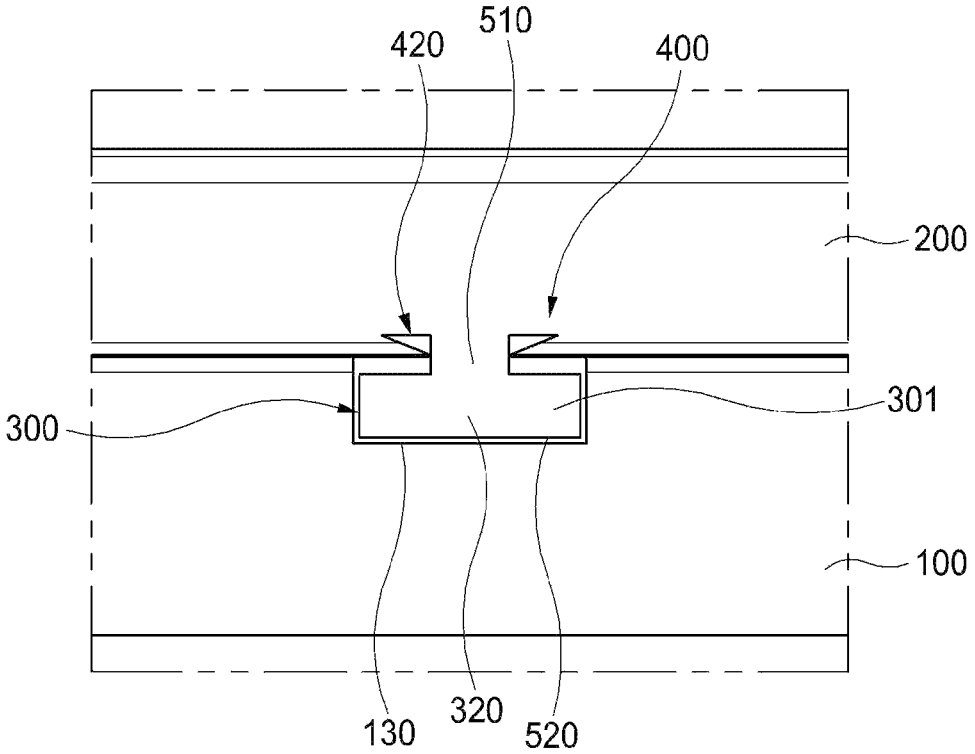
FIG. 14A is a front view illustrating a container cap according to a fifth embodiment of the present invention.
Figure 14B:
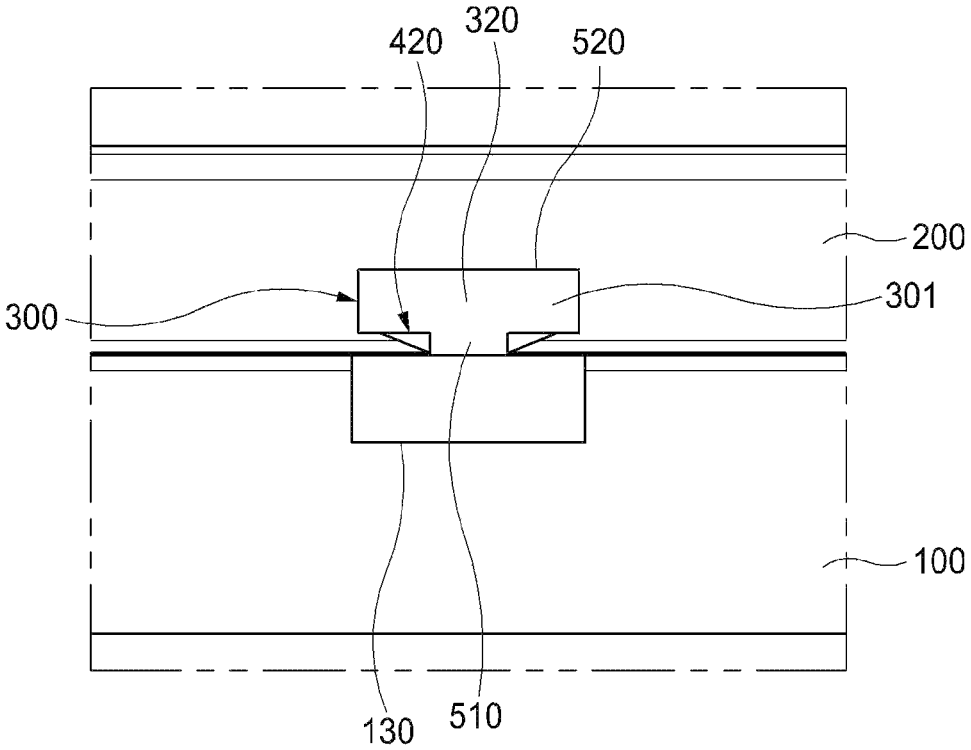
FIG. 14B is a front view illustrating a state in which a separation part is coupled to a fixing part in the container cap illustrated in FIG. 14A.
Figure 15A:
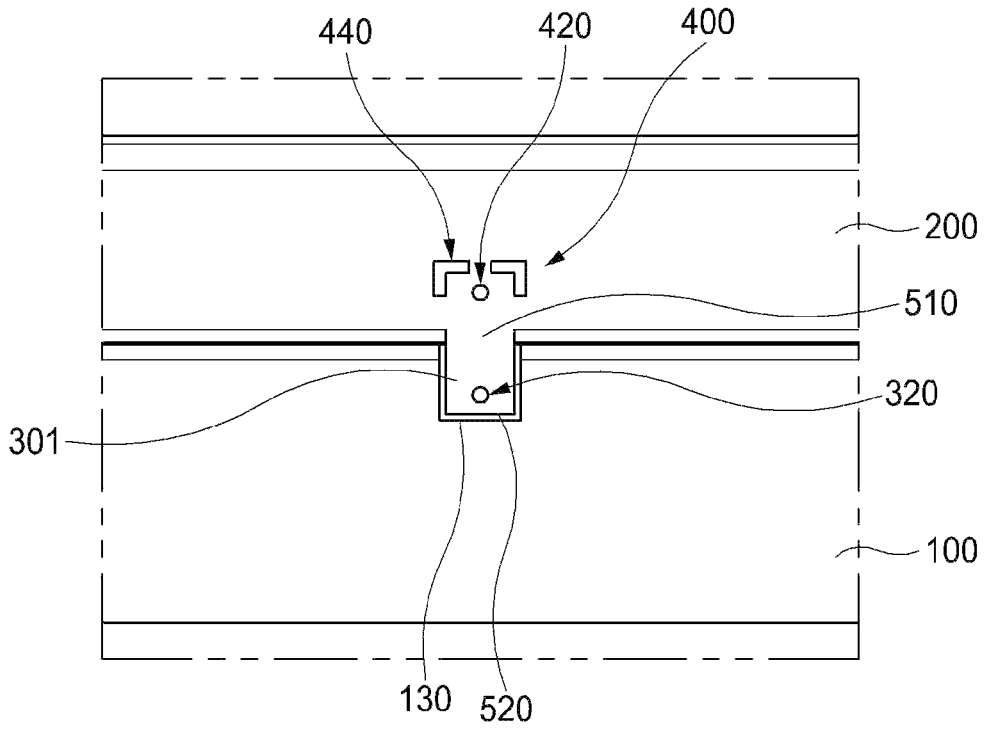
FIG. 15A is a front view illustrating a container cap according to a sixth embodiment of the present invention.
Figure 15B:
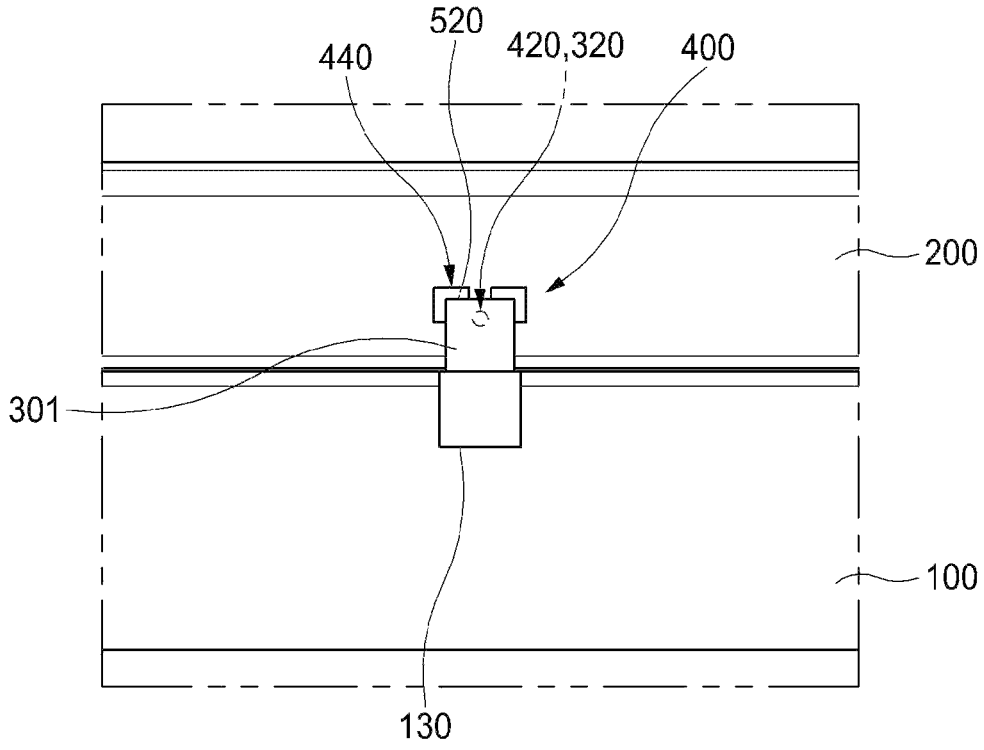
FIG. 15B is a front view illustrating a state in which a separation part is coupled to a fixing part in the container cap illustrated in FIG. 15A.
Figure 16A:
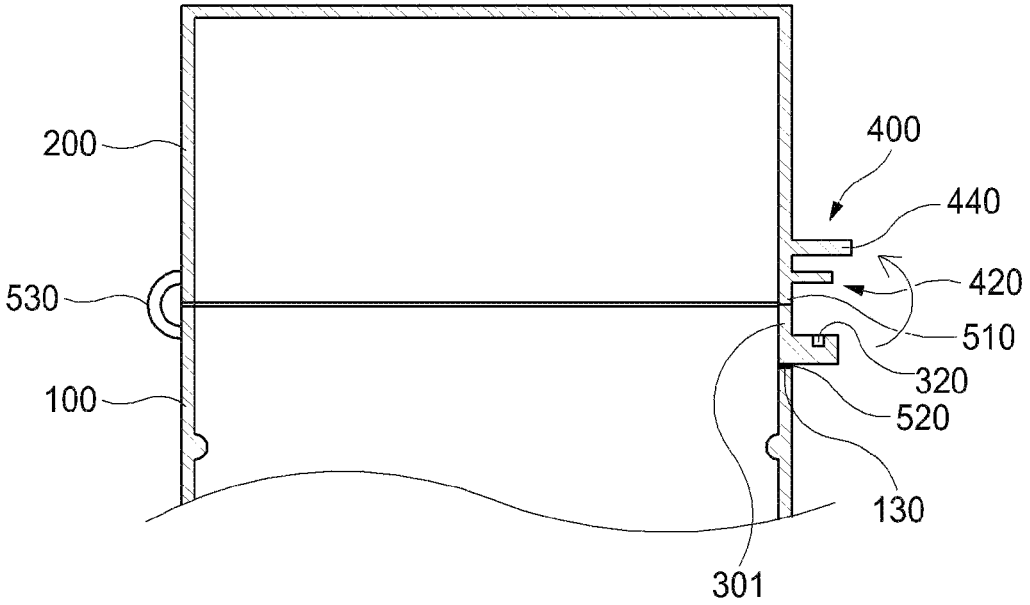
FIG. 16A is a cross-sectional view of FIG. 15A.
Figure 16B:
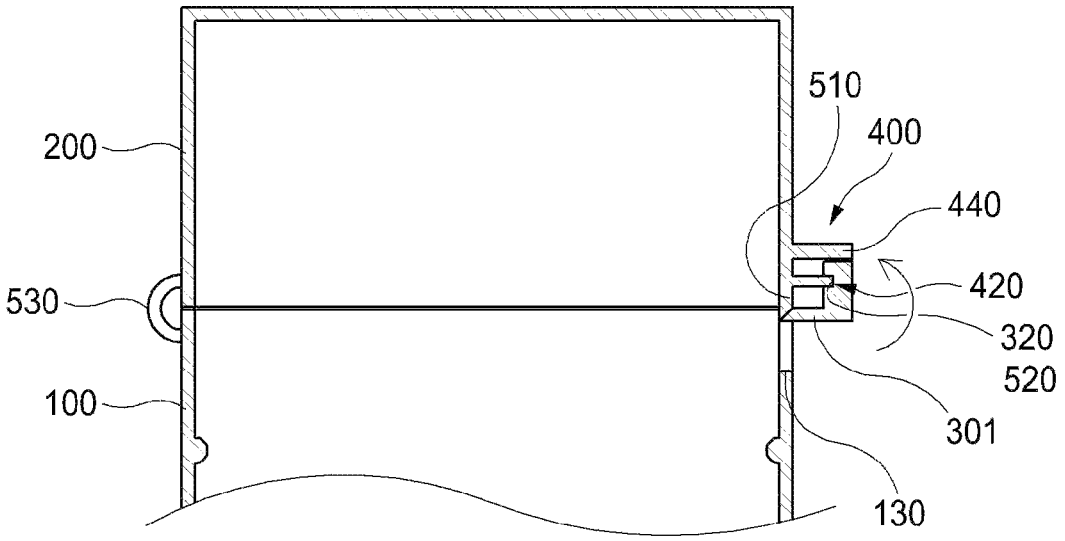
FIG. 16B is a cross-sectional view of FIG. 15B.

Fifth Embodiment (FIGS. 14A and 14B)

Hereinafter, a fifth embodiment of the coupling structure of the separation part and the fixing part will be described.

A coupling structure of the separation part and the fixing part according to the fourth embodiment is a modified example of the first fitting part 320 and the second fitting part 420 when compared to the first embodiment.

The first fitting part 320 may be provided as a protrusion protruding from a central portion of the base part 301, and the second fitting part 420 may be provided as a pair of concave groove formation protrusions that form a concave groove into which the protrusion of the first fitting part 320 is inserted.

As the modification of the structure illustrated in FIGS. 14A and 14B, a first connection part 510 may be folded and fitted into the concave groove formed by the pair of concave groove formation protrusions, and the base part 301 may be hang on an upper end of the concave groove formation protrusion, and thus, the separation part 300 and the fixing part 400 may be coupled to each other.

Sixth Embodiment (FIGS. 15A to 16B)

Hereinafter, a sixth embodiment of the coupling structure of the separation part and the fixing part will be described.

A coupling structure of the separation part and the fixing part according to the sixth embodiment is a modified example of the first fitting part 320 and the second fitting part 420 when compared to the first embodiment.

The first fitting part 320 may be provided as a concave groove formed in the base part 301, and the second fitting part 420 may be provided as a fitting protrusion inserted into a concave groove formed in the first fitting part 320.

Specifically, when the base part 301 is folded upward by the user's manipulation, the first connection part 510 may be folded, and the base part 301 may rotate upward with respect to the first connection part 510.

In addition, the base part 301 may be directed toward the second fitting part 420 by the rotation thereof, and the fitting protrusion of the second fitting part 420 may be inserted into the concave groove formed in the base part 301 and then coupled.

Here, one or more guide protrusions 440 for guiding the coupling of the first fitting part 320 and the second fitting part 420 may be formed at a portion corresponding to an outer edge of the base part on an outer circumferential surface of the cover part 200 so that the first fitting part 320 and the second fitting part 420 are easily fitted.

The guide protrusion 440 may be a configuration formed on the outer circumferential surface of the cover part 200 to guide the coupling of the first fitting part 320 and the second fitting part 420 at the portion corresponding to the outer edge of the base part 301 and may be variously configured according to a front shape of the base part 301.

For example, the guide protrusion 440 may be formed in an 'L' shape to correspond to a vertex of the base part 301 when the front shape of the base part 301 has a rectangular shape.

Figure 17A:
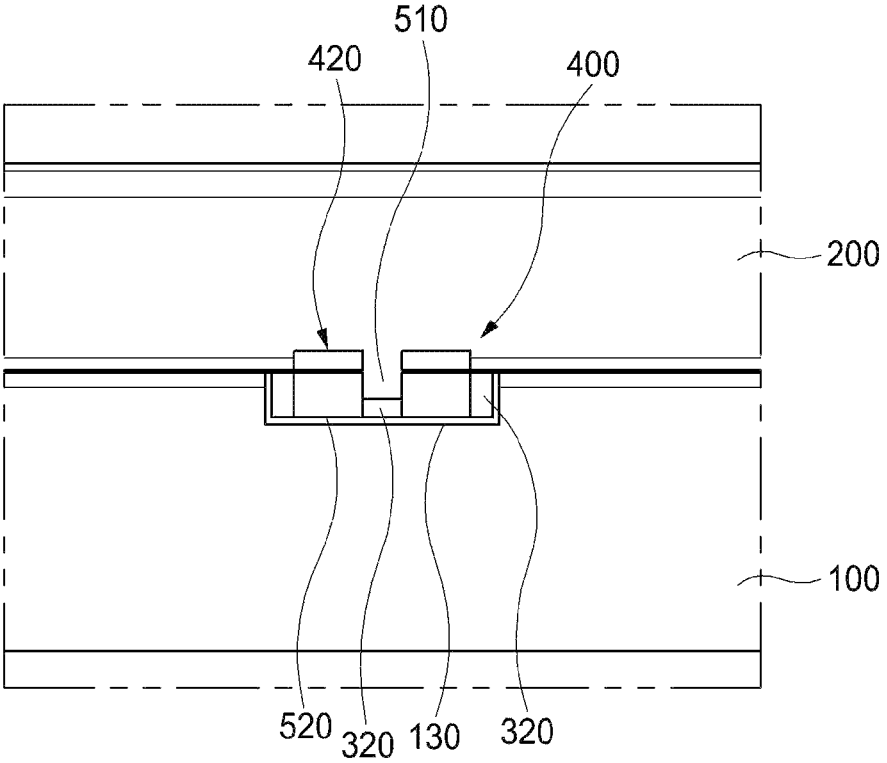
FIG. 17A is a front view illustrating a container cap according to a seventh embodiment of the present invention.
Figure 17B:
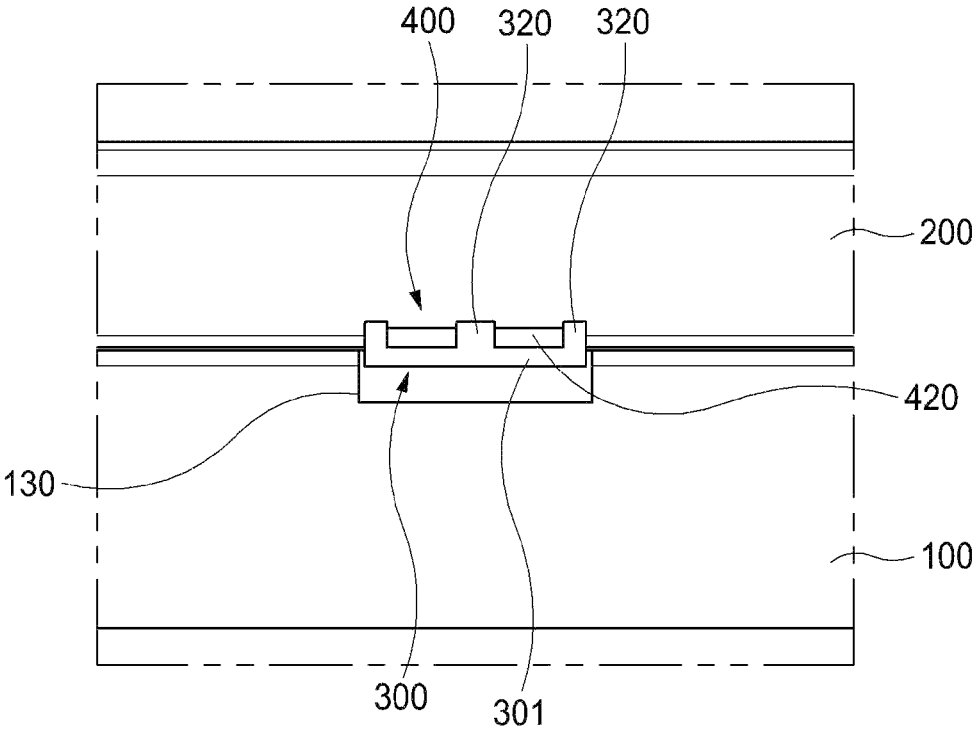
FIG. 17B is a front view illustrating a state in which a separation part is coupled to a fixing part in the container cap illustrated in FIG. 17A.

Seventh Embodiment (FIGS. 17A and 17B)

Hereinafter, a seventh embodiment of the coupling structure of the separation part and the fixing part will be described.

A coupling structure of the separation part and the fixing part according to the seventh embodiment is a modified example of the first fitting part 320 and the second fitting part 420 when compared to the first embodiment.

The first fitting part 320 may be provided as three concave groove formation protrusions that form two concave grooves in a horizontal direction, and the second fitting part 420 may be provided as two concave groove formation protrusions fitted into two concave grooves formed by the three concave groove formation protrusions.

According to the structure as described above, when the separation part 300 is separated from the body part 100 and folded upward, the three concave groove formation protrusions formed on the base part 301 are opposed to the two protrusions.

In addition, the two protrusions of the second fitting part 420 may be fitted into the two concave grooves formed by the three concave groove formation protrusions, and thus, the separation part 300 may be fixed and coupled to the fixing part 400.

Figure 18A:
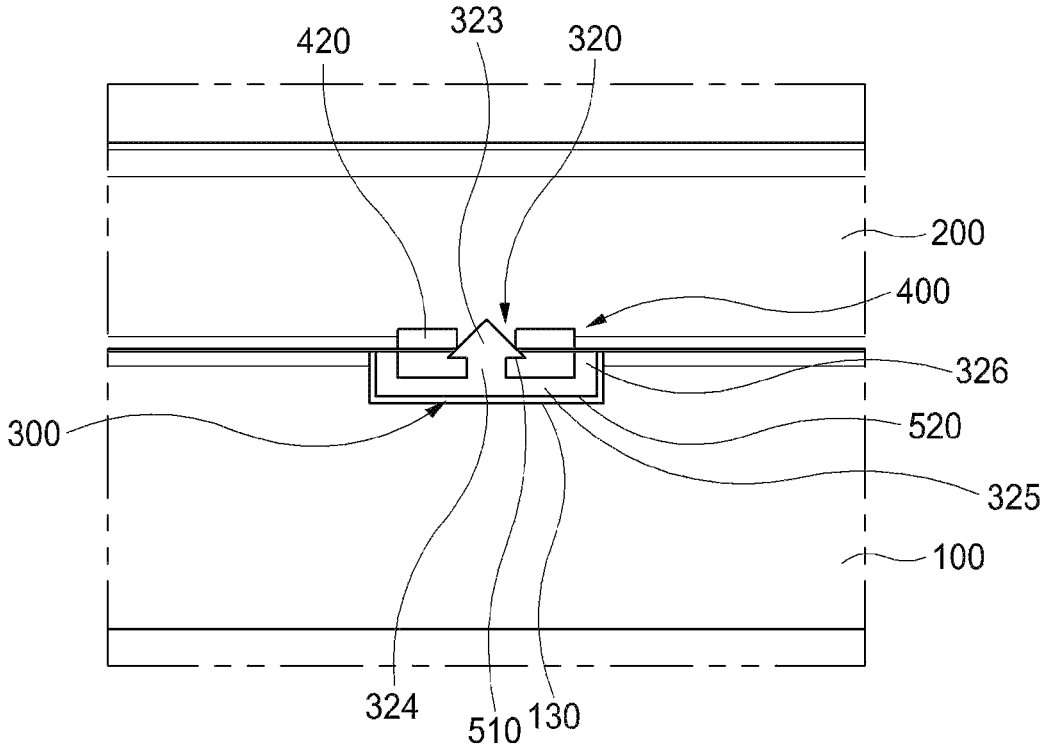
FIG. 18A is a front view illustrating a container cap according to an eighth embodiment of the present invention.
Figure 18B:
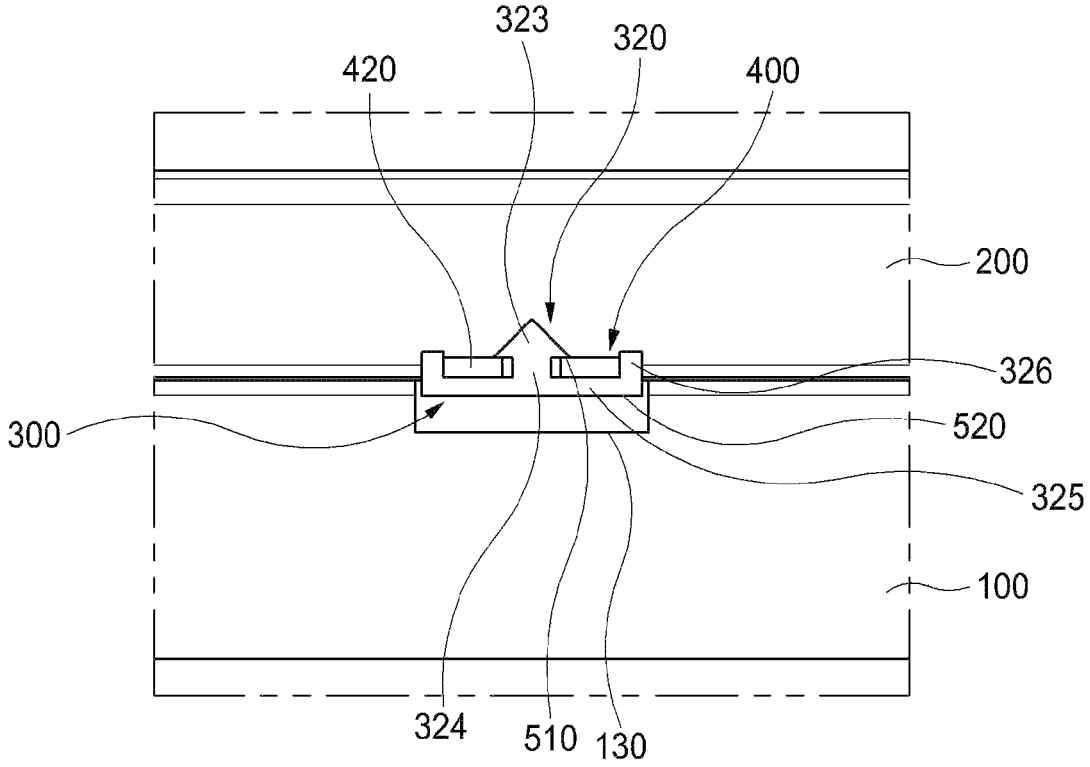
FIG. 18B is a front view illustrating a state in which a separation part is coupled to a fixing part in the container cap illustrated in FIG. 18A.
Figure 19A:
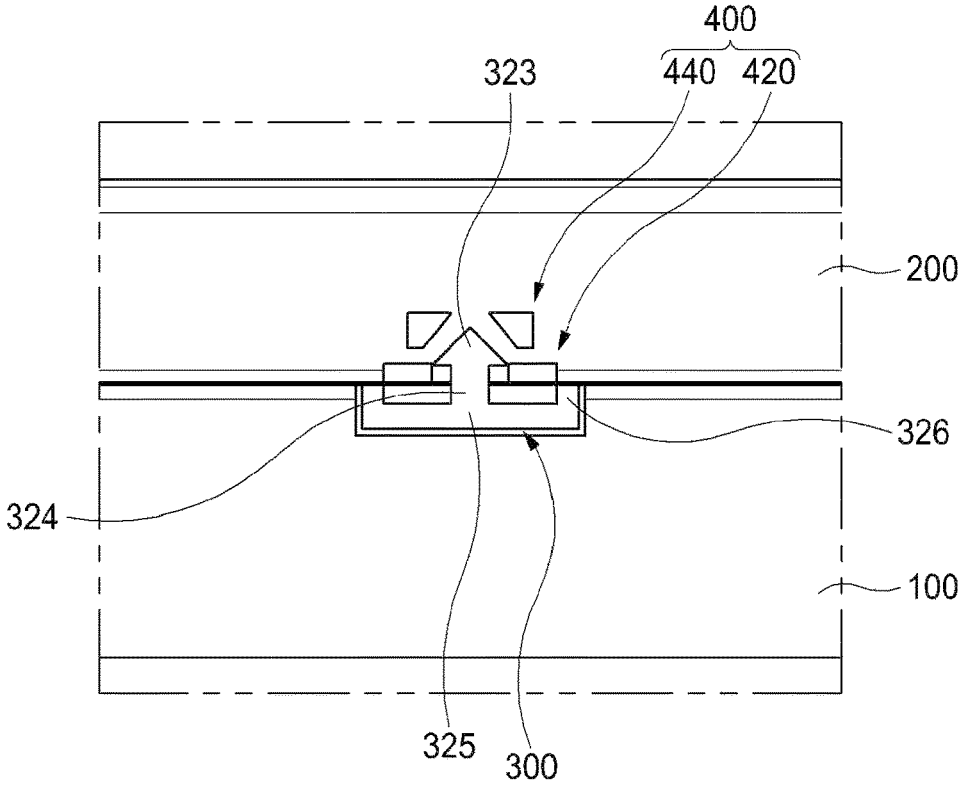
FIG. 19A is a front view illustrating a container cap according to a ninth embodiment of the present invention.
Figure 19B:
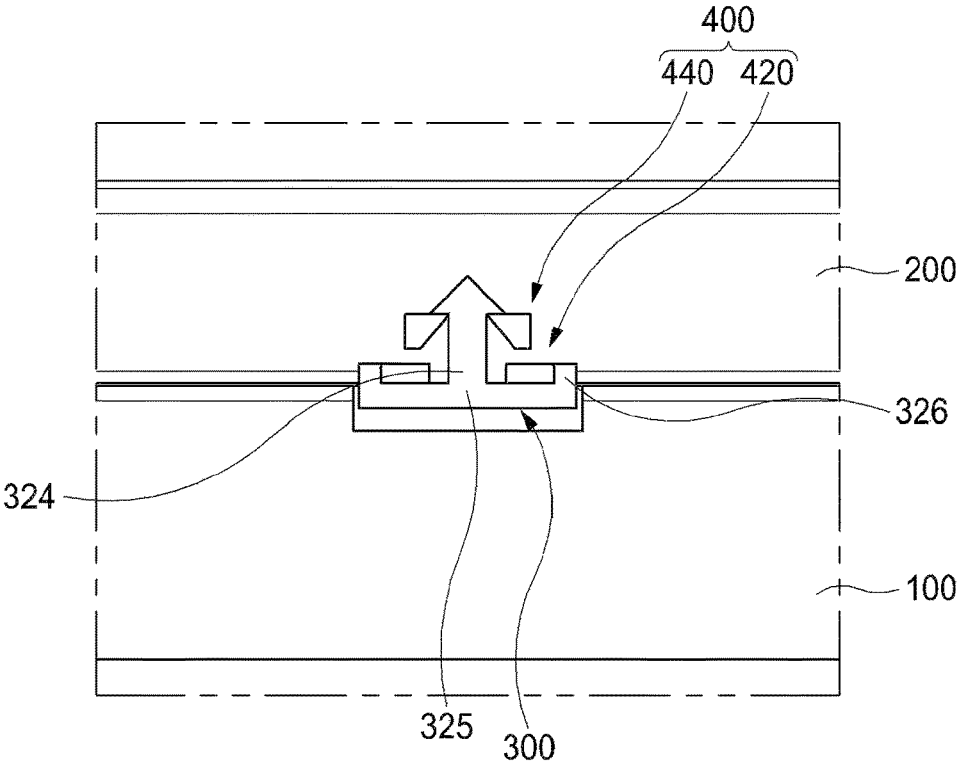
FIG. 19B is a front view illustrating a state in which a separation part is coupled to a fixing part in the container cap illustrated in FIG. 19A.
Figure 20A:
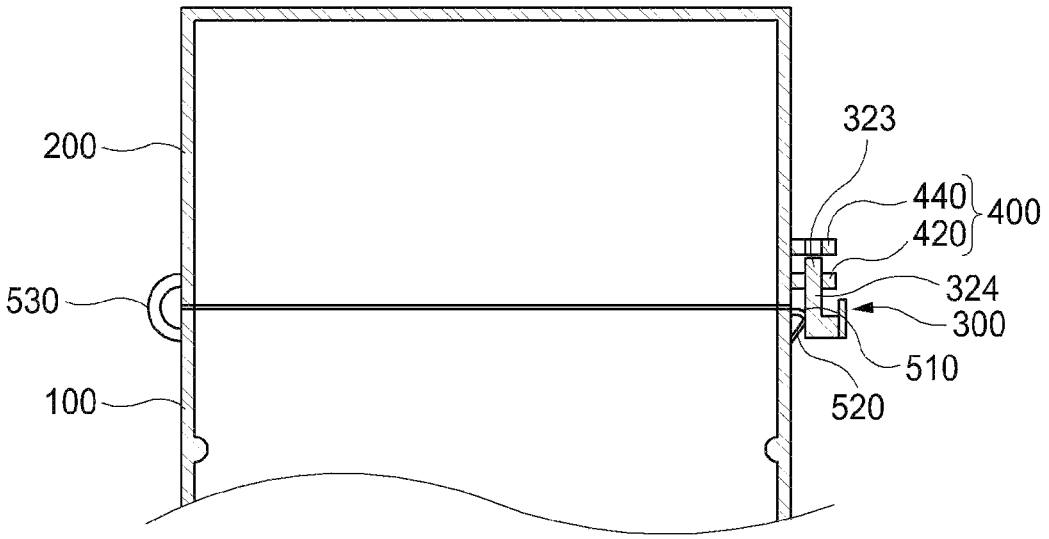
FIG. 20A is a cross-sectional view of FIG. 19A.
Figure 20B:
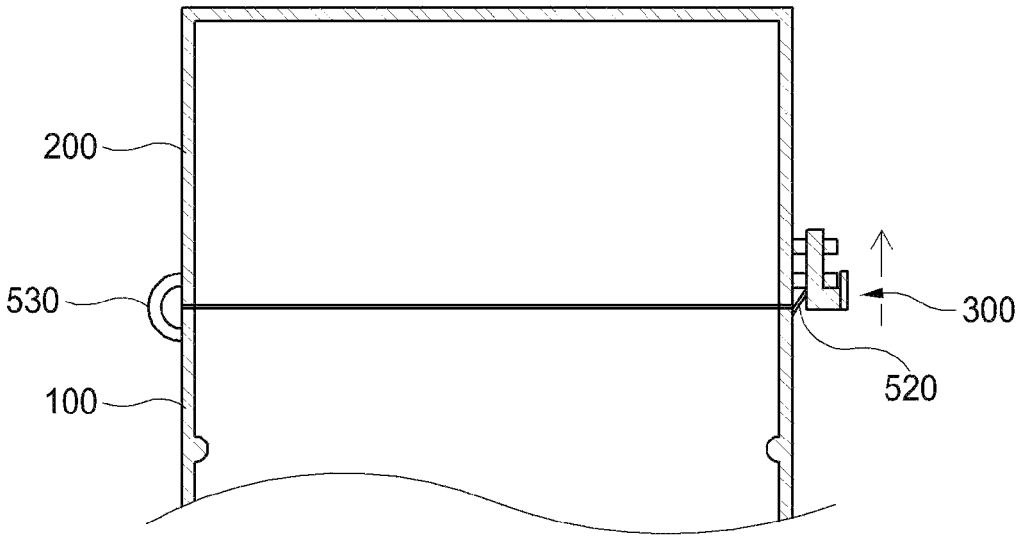
FIG. 20B is a cross-sectional view of FIG. 19B.

Eighth Embodiment (FIGS. 18A and 18B)

Hereinafter, an eighth embodiment of the coupling structure of the separation part and the fixing part will be described.

A coupling structure of the separation part and the fixing part according to the seventh embodiment is a modified example of a movement structure of the first fitting part 320 and a coupling structure of the first fitting part 320 and the second fitting part 420 when compared to the first embodiment.

First, the separation part 300, that is, the first fitting part 320 is characterized in that the first fitting part 320 moves vertically and is coupled to the fixing part 400 as illustrated in FIGS. 18A to 20B.

For this, the first fitting part 320 may have various configurations according to the fitting structure of the second fitting part 420.

For example, the first fitting part 320 may include a head portion 323 and an extension portion 324 having a width less than that of the head portion 323.

The head portion 323 may have any structure as long as the head portion 23 has a width greater than that of the concave groove to maintain a hooked state by passing through the concave groove formed by a pair of protrusions forming the second fitting part 420 to be described later.

Particularly, it is preferable that the head portion 323 has a wedge shape so as to pass through the concave groove formed by the pair of protrusions to maintain the hooked state.

The extension portion 324 may be a portion extending downward from the head portion 323 and may be disposed between the concave grooves formed by the pair of protrusions after the head portion 323 passes through the concave groove formed by the pair of protrusions.

In the first fitting part 320, a hook part 325 hooked with the pair of protrusions to prevent the head portion 323 from excessively moving may formed to extend in the horizontal direction to prevent the head portion 323 from excessively moving.

In order to prevent the head portion 323 from excessively moving, the hook part 325 may be a configuration that is hooked with the pair of protrusions and may have various configurations.

Furthermore, the hook part 325 may be formed by allowing an upper extension part 326 to extend upward to form the concave groove into which each of the pair of protrusions is inserted together with the extension portion 324.

The second connection part 520 may be formed between a bottom surface of the separation part 300 and an outer circumferential surface of the body part 100.

In addition, in order to form the separation part 300, the concave groove 130 corresponding to the front shape of the separation part 300 is not necessarily formed in the body part 100.

The second fitting part 420 constituting the fixing part 400 may be provided as the pair of protrusions that form a concave groove having a width less than a horizontal width of the head portion 323 so that the aforementioned head portion 323 is fitted and hooked.

The pair of fitting protrusions are configured to form the concave groove having the width less than the horizontal width of the head portion 323 so that the head portion 323 is fitted and hooked and may have various configurations.

Ninth Embodiment (FIGS. 19A to 20B)

Hereinafter, a ninth embodiment of the coupling structure of the separation part and the fixing part will be described.

A coupling structure of the separation part and the fixing part according to the ninth embodiment is a modified example of the second fitting part 420 when compared to the second embodiment.

Specifically, the second fitting part 420 may include a pair of primary protrusions that maintain a state in which the head portion 323 is fitted before the separation portion 300 is separated from the body part 100, and a pair of secondary protrusions on which the head portion 323 moves upward after the separation part 300 is separated from the body part 100 and then passes to be hooked.

Tenth Embodiment (FIGS. 21A to 21C)

Hereinafter, a ninth embodiment of the coupling structure of the separation part and the fixing part will be described.

A coupling structure of the separation part and the fixing part according to the ninth embodiment is an embodiment in which the structures illustrated in FIGS. 2 to 20B are arranged and connected in the circumferential direction rather than the vertical direction.

Specifically, as illustrated in FIGS. 21A to 21C, the separation part 300 has a belt structure coupled to the cover part 200 and the body part 100 by a plurality of bridges (not shown) and may be inserted into and fixed to the fixing part 400 formed on any one circumferential surface of the cover part 200 and the body part 100 after being separated from the cover part 200 and the body part 100.

Here, at least a portion of the outer circumferential surface of the cover part 200 and the fixing part 300 may be cut in a portion at which the separation part 300 is disposed so that the separation part 300 is installed.

In addition, for the convenience of the separation of the separation part 300, a separation handle 570 held by the use may be formed at an end portion of the separation part 300.

The separation part 300 may be integrally connected to a side, at which the fixing part 400 is formed, of the cover part 200 and the body part 100 by a first connection part 510 so that an end close to the fixing part 400 is folded in the circumferential direction.

The fixing part 400 may be formed at the side, to which the separation part 300 is connected, of the cover part 200 and the body part 100 and may have any configuration as long as the separation part 300 is fixed.

For example, the fixing part 400 may have a structure in which a through-hole to be fitted in the circumferential direction is formed in consideration of the separation part 300 of the belt structure.

The cover part 200 may be hingedly coupled to the body part 100 by a hinge part 530 so that the user easily separates the cover part 200 from the body part 100. Here, a handle part 580 disposed at a position opposite to the hinge part 530 may be formed so that the handle part 580 is disposed opposite to the hinge part 530.

Role of Handle and Injection Molding

In the container cap 10 according to the present invention, at least one of the separation part 300 or the fixing part 400 may be disposed at positions opposite to the hinge part 530 described above, and the separation part 300 and the fixing part 400, which are coupled to each other, may be used as a handle for opening the container 30 by separating the cover part 200 from the body part 100 due to the user's manipulation.

The container cap 10 having the above configuration may be formed by injecting a synthetic resin material.

Here, in the container cap 10 according to the present invention, it is preferable that the body part 100, the cover part 200 and the separation part 300 are integrally formed in consideration of manufacturing convenience and recycling after use.

Container Structure

The container cap 10 having the above configuration may be coupled to containers having various structures.

Particularly, the container cap 10 according to the present invention is suitable for a container 30 containing powder, in particular, contents having a granular structure, and the container 30 structure may also be specialized in discharging the contents having the granular structure.

Figure 22:
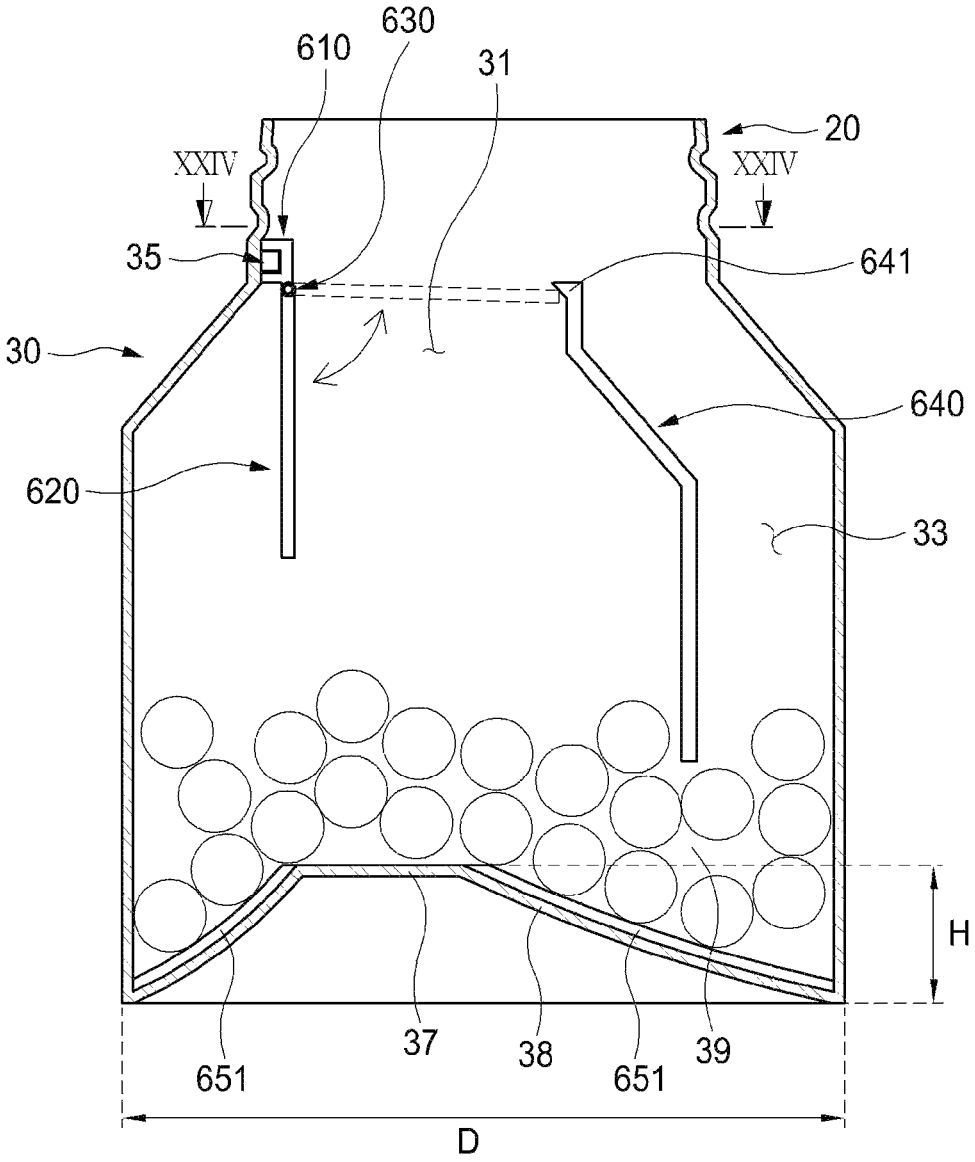
FIG. 22 is a cross-sectional view of a container according to the present invention.
Figure 23:
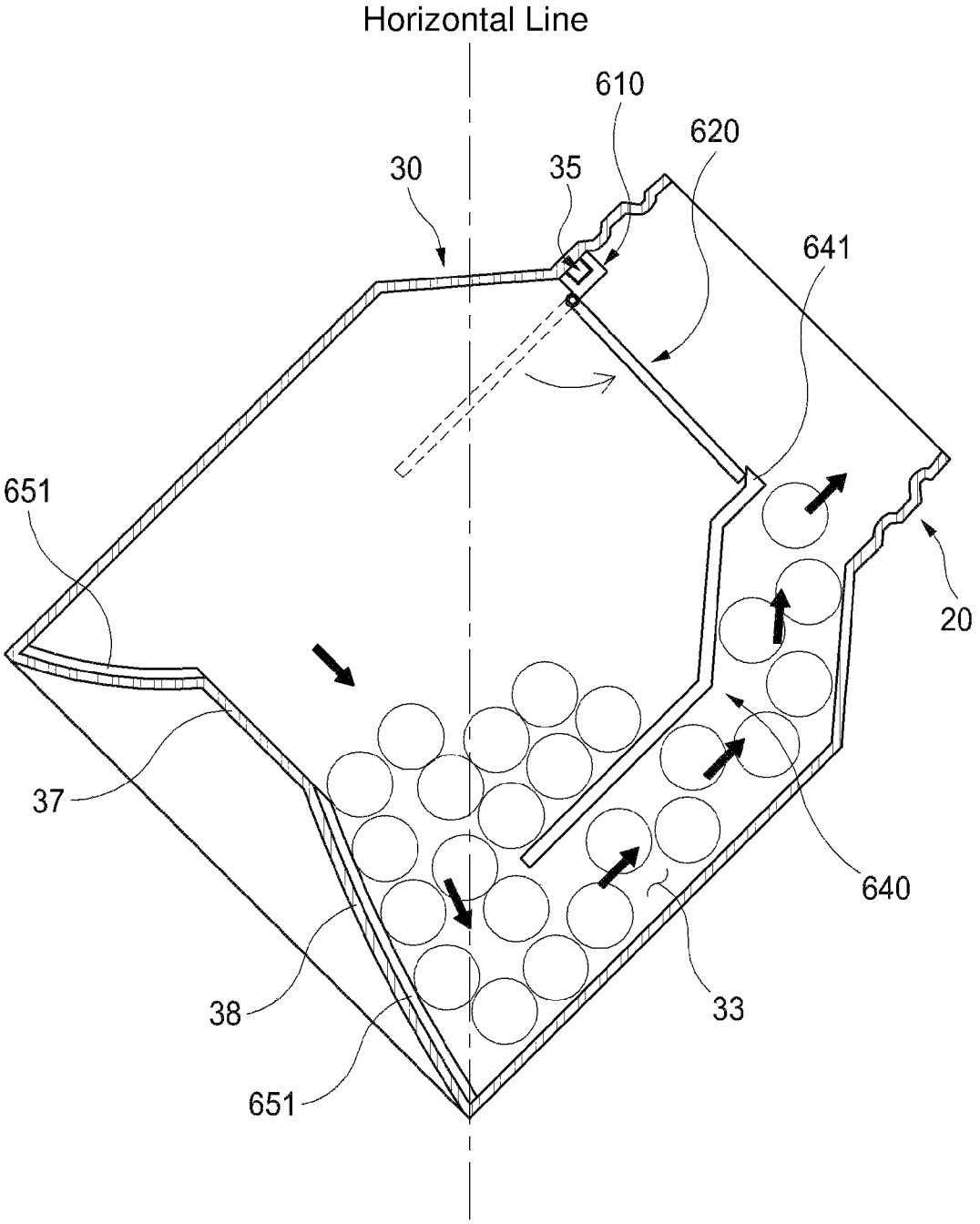
FIG. 23 is a cross-sectional view illustrating a state in which the container of FIG. 22 is inclined.
Figure 24:
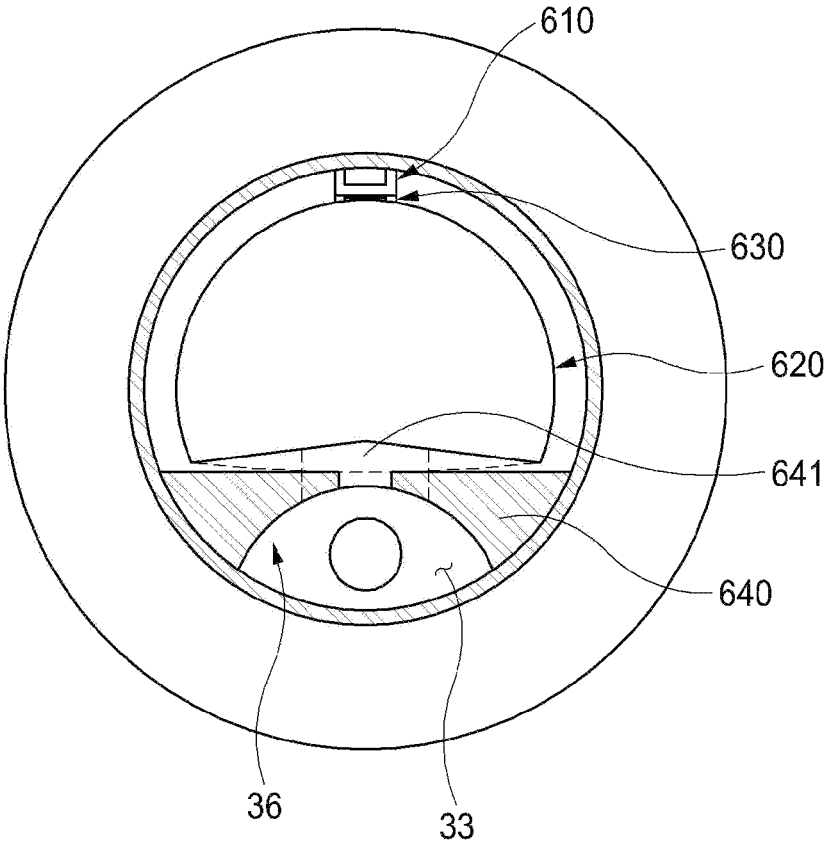
FIG. 24 is a cross-sectional view taken along lie XX-XX in FIG. 22.

Specifically, in the container 30 according to the present invention, as illustrated in FIGS. 22 to 24, a partition member 640 forming a discharge passage 33 of the contents may be installed.

The partition member 640 may be installed inside the container 30 to form the discharge passage 33 of the contents and may have various configurations.

For example, the partition member 640 may form a content communication passage 39 communicating with the discharge passage 33 at a lower end thereof.

The partition member 640 may form two passages at an upper end thereof, that is, a discharge passage 33 and an inflow passage 31 through which the contents are introduced, and as illustrated in FIG. 23, when it is inclined more than a horizontal line, it is necessary to block the discharge of the contents from being discharged through the inflow passage 31.

For this, the container 30 may be installed at an upper end of the inflow passage 31, and a door member 620 for opening and closing the inflow passage 31 according to an inclined angle of the container 30 may be rotatably installed.

The door member 620 may be a configuration that is installed at the upper end of the inflow passage 31 to open and close the inflow passage 31 according to the inclined angle of the container 30 and may have various configurations.

Here, the door member 620 has to be installed by being supported inside the container 30. Here, the hinge part 630 to which the door member 620 is coupled to enable hinge rotation is coupled to the door member 620, and the door member 620 may be coupled to the inner circumferential surface of the container 30 by an installation coupling part 610 coupled to a support coupling part 35 formed on the inner circumferential surface of the container 30.

In addition, in order to prevent the door member 620 from excessively rotating when the door member 620 rotates, a hook part 641 with which the door member 620 is hooked to prevent the door member 620 from excessively rotating may be formed on an upper end of the partition member 640.

In the container 30 according to the present invention, the contents having the granular structure have to be smoothly discharged toward the discharge passage 33, and thus, a bottom structure thereof may have various structures as illustrated in FIGS. 22 to 26C.

Specifically, in the container 30, an apex portion 37 may protrude from an end thereof so that the contents having the granular structure are discharged toward the discharge passage 33.

The apex portion 37 may be a configuration in which the apex portion 37 protrudes from the end thereof so that the contents having the granular structure are discharged toward the discharge passage 33, and it is preferable that a height H of the apex portion 37 is greater than ¼ of a diameter D of a lower end of the container 30 to improve a formation effect.

Since the apex portion 37 is formed, an inclined surface 36 that is inclined toward a lower edge of the container 30 may be formed to guide the contents to the lower edge of the container 30.

In addition, as illustrated in FIGS. 25A and 15B, and 26A and 26B, the apex portion 37 may be formed in a symmetrical structure at a center thereof.

Particularly, the apex portion 37 may be asymmetrical to induce the content so as to flow toward the discharge passage 33 and may be preferably formed far from the discharge passage 33 as illustrated in FIGS. 22 and 23, 25C and 26C.

Here, a plurality of ribs 651 protruding upward from a bottom surface may be formed on the inclined surface 36 to guide the movement of the contents.

Figure 25A:
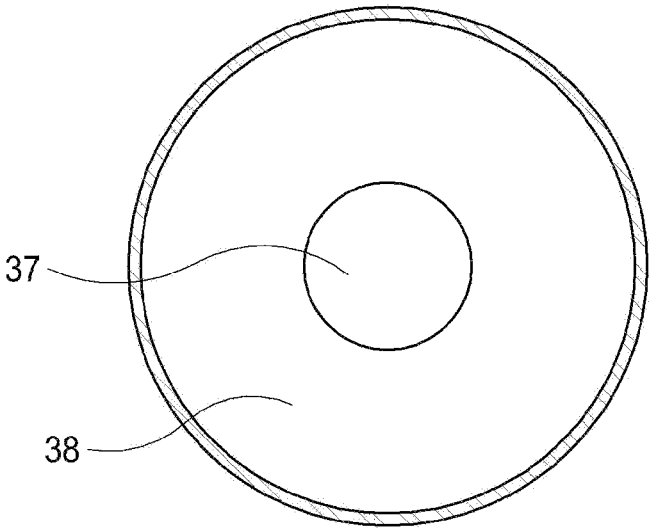
FIGS. 25A to 25C are transverse cross-sectional views illustrating embodiments of a bottom of the container of FIG. 22.
Figure 25B:
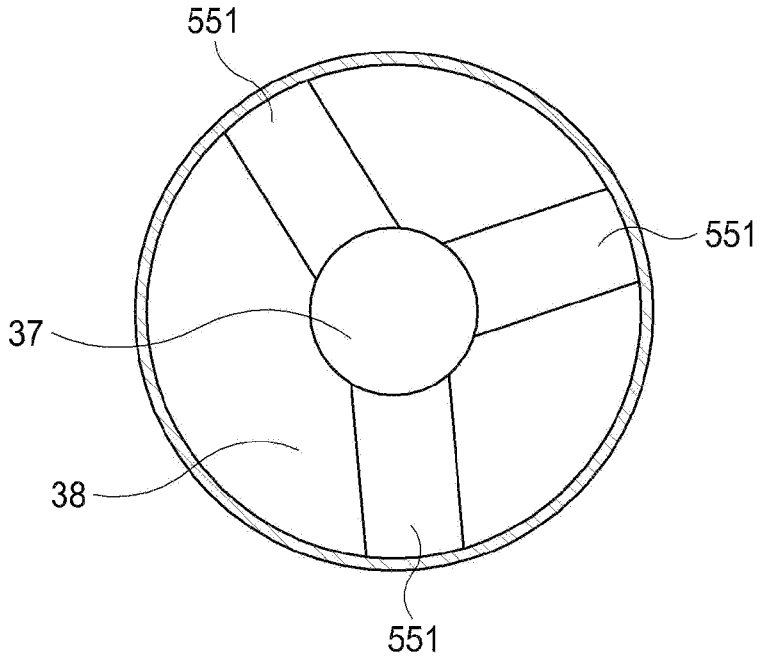
Figure 25C:
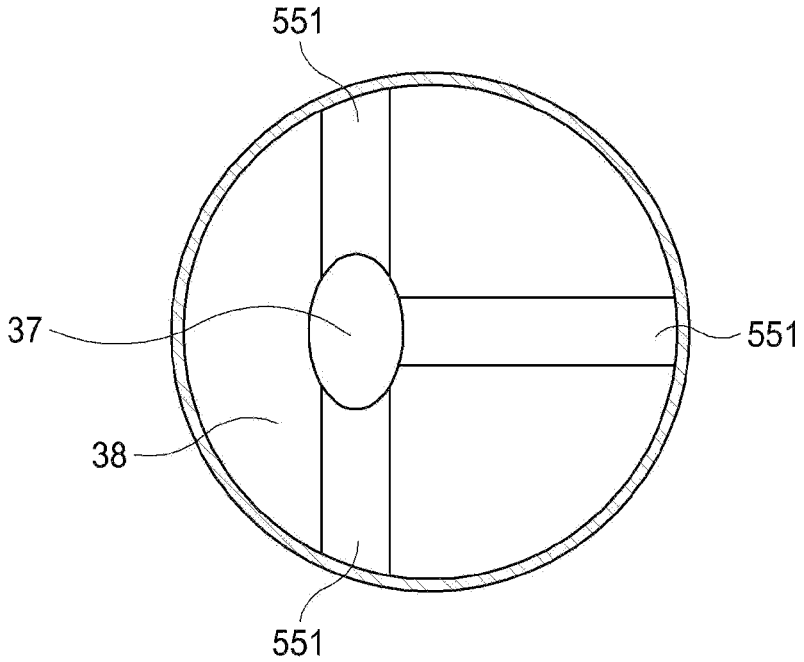
Figure 26A:
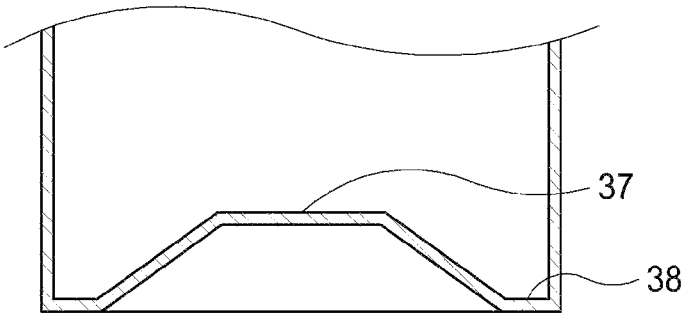
FIGS. 26A to 26C are vertical cross-sectional views of the bottom illustrated in FIGS. 25A to 25C, respectively.
Figure 26B:
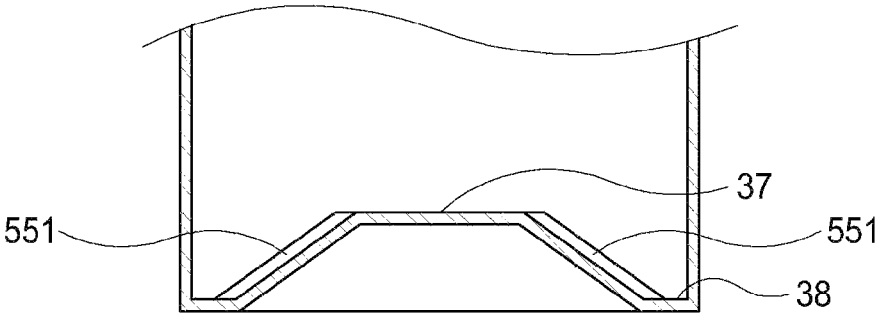
Figure 26C:
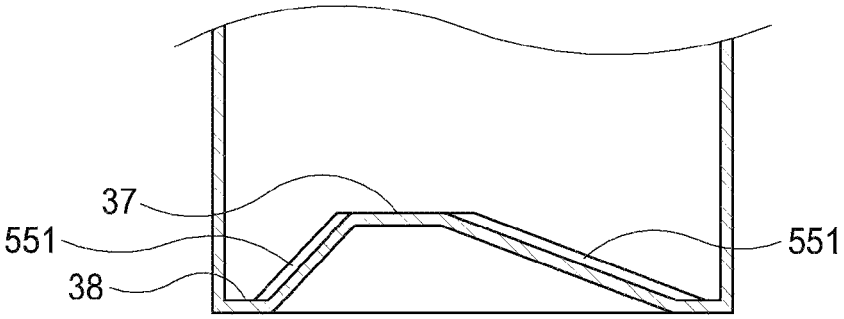

The plurality of ribs 651 may be a portion that is formed to protrude upward from the bottom surface on the inclined surface 36 to guide the movement of the contents and may be formed in various structures as illustrated in FIGS. 25B and 25C.

In the container 30, when external air or the like is introduced into the inside, deterioration of the contents may occur. Thus, it is preferable that the container cap 10 coupled to the container inlet 20 has a blocking structure for maximally blocking the container inlet 20 to prevent the external air from being introduced.

Thus, at least one of the cover part 200 or the container inlet 20 may include a plurality of close contact parts that are in close contact with the container inlet 20. The close contact part may have a close curve surrounding the container inlet 20 to prevent the external air from being introduced from the outside into the container 30.

Particularly, the blocking structure for sealing the inside of the container 30 is preferably provided in the cover part 200 coupled to the upper end of the container inlet 20.

That is, the cover part 200 may include an inner ring 290, a so-called ring gasket, which protrudes from the bottom surface and is inserted into the inner circumferential surface of the container inlet 20 in order to increase in sealing force of the container 30.

The inner ring 290 may be a portion that protrudes from the bottom surface of the cover part 200 and is inserted into the inner circumferential surface of the container inlet 20 in order to increase in sealing force of the container 30 and may have various configurations according to the contact structure with the container inlet 20.

The cover part 200 may be coupled to a snap-type coupling structure (e.g., one piece and two piece one touch cap and undercut cap structure).

Here, the snap-type coupling structure refers to a structure in which a circular ring is formed to protrude from the outer circumferential surface of the container inlet 20, and a ring-shaped hook protrusion hooked with the circular ring of the container inlet 20 is formed on the inner circumferential surface of the container cap 10.

Also, a screw coupling structure refers to a structure in which a male screw is formed on the outer circumferential surface of the container inlet 20, and a female screw screw-coupled to the male screw is formed on a portion of the inner circumferential surface of the container cap 10 so as to be coupled.

Here, in the container inlet 20, one or more ring-shaped coupling protrusions 24 may be formed on the outer circumferential surface, and the cover part 200 may be coupled to the container inlet 20 because the ring-shaped coupling protrusion 290, into which the coupling protrusion 24 formed on the container inlet 20 is inserted, is formed on the inner circumferential surface.

Also, the body part 100 coupled to the cover part 200 may have various coupling structures such as screw coupling or snap coupling with respect to the container inlet 20.

The cover part 200 may be provided with a plurality of close contact parts that are in close contact with the container inlet 20 by relatively close contact with the container inlet 20.

Also, each of the close contact parts may have a closed curve surrounding the container inlet 20 in order to block the inflow of the external air into the container 30 from the outside and may have various configurations.

Hereinafter, the blocking structure will be described in detail with reference to a more specific embodiment. Also, for the convenience of description, characteristic portions will be described in detail.

In addition, although the blocking structure has been described for each embodiment, one or more embodiments may be combined in a range that does not conflict with each other.

First Embodiment

Figure 27A:
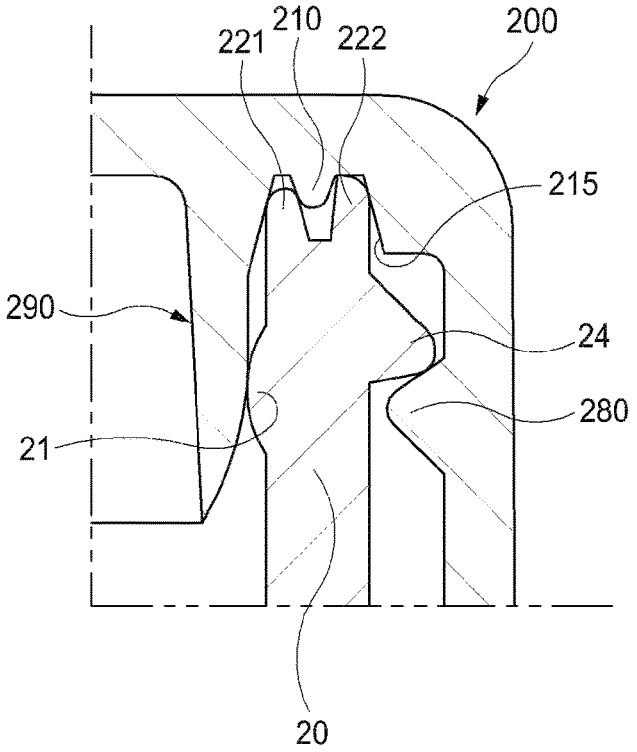
FIG. 27A is a partial cross-sectional view illustrating a first embodiment of a blocking structure applied to the container cap according to the present invention.

As illustrated in FIG. 27A, the cover part 200 may be provided with one or more inner circumferential-side protrusions 21 protruding toward the inner ring 290 to be in contact with an outer circumferential surface of the inner ring 290 when the cover part 200 is coupled to the container inlet 20.

Each of the inner circumferential-side protrusions 21 may be a portion protruding toward the inner ring 290 so as to be in contact with the outer circumferential surface of the inner ring 290 and may have a ring shape in the circumferential direction with respect to a central axis in a longitudinal direction of the cover part 200.

Also, it is preferable that the inner circumferential-side protrusion 21 is formed in a gentle curve so that a longitudinal cross-section of the container inlet 20 is in surface contact rather than line contact with the outer circumferential surface of the inner ring 290.

The cover part 200 may have a configuration similar to the inner circumferential-side protrusion 21 described above and may be provided with one or more inner ring protrusions protruding toward the inner circumferential surface of the cover part 200 so as to be in contact with the inner circumferential surface of the cover part 200 when the cover part 200 is coupled to the container inlet 20.

The inner ring protrusion may be a configuration protruding toward the inner circumferential surface of the cover part 200 so as to be in contact with the inner circumferential surface of the cover part 200 when the cover part 200 is coupled to the container inlet 20 and may have a ring shape in the circumferential direction with respect to the central axis in the longitudinal direction of the container inlet 20.

Also, it is preferable that the inner ring protrusion is formed in a gentle curve so that a longitudinal cross-section of the container inlet 20 is in surface contact rather than line contact with the inner circumferential surface of the container inlet 20.

In order to increase in sealing force for the container 30, the cover part 200 may be inserted into the concave groove 220 formed integrally along the circumference at the upper end of the container inlet 20, and when the cover part 200 is coupled to the container inlet 20, a middle ring 210 formed on the bottom surface of the cover part 200 may be formed.

The middle ring 210 may be inserted into the concave groove 220 integrally formed along the circumference at the upper end of the container inlet 20 and may be a ring formed on the bottom surface of the cover part 200 when the cover 200 is coupled to the container inlet 20, and also, the middle ring 210 may have various configurations.

For example, the middle ring 210 may form an inverted triangular shape or an inverted trapezoid shape in a vertical cross-section. Here, an end of the middle ring 210 may have various shapes such as a flat surface or a curved surface.

In addition, the concave groove 220 into which the middle ring 210 is inserted may be formed in a shape corresponding to the cross-sectional shape of the middle ring 210, and also may be preferably formed so that a width thereof in the cross-sectional shape of the middle ring 210 is more reduced to be in close contact with the middle ring while the middle ring 210 is inserted.

The concave groove 220 and the middle ring 210 may be formed in two or more according to sealing force.

In the formation of the concave groove 220, the concave groove 220 may be formed by two (inner and outer) upper ends 221 and 222 forming the upper end of the container inlet 20.

Here, the two upper ends 221 and 222 are preferably formed in a structure having elasticity while forming an inclination at a portion constituting the concave groove 220.

Also, it is preferable that at least one of the two upper ends 221 and 222 has a curved outer circumferential surface.

Here, as illustrated in FIG. 27A, the cover part 200 may have a slope 215 that is in contact with the curved outer circumferential surface of the upper ends 221 and 222 so that the cover part 200 and the container inlet 20 are in close contact with each other, i.e., one or more close contact parts are formed when the cover part 200 is coupled to the container inlet 20.

In the upper end of the container inlet 20, that is, the two upper ends 221 and 222, the inner upper end 221 may be formed lower than the outer end 222 with respect to the concave groove 220.

Second Embodiment

Figure 27B:
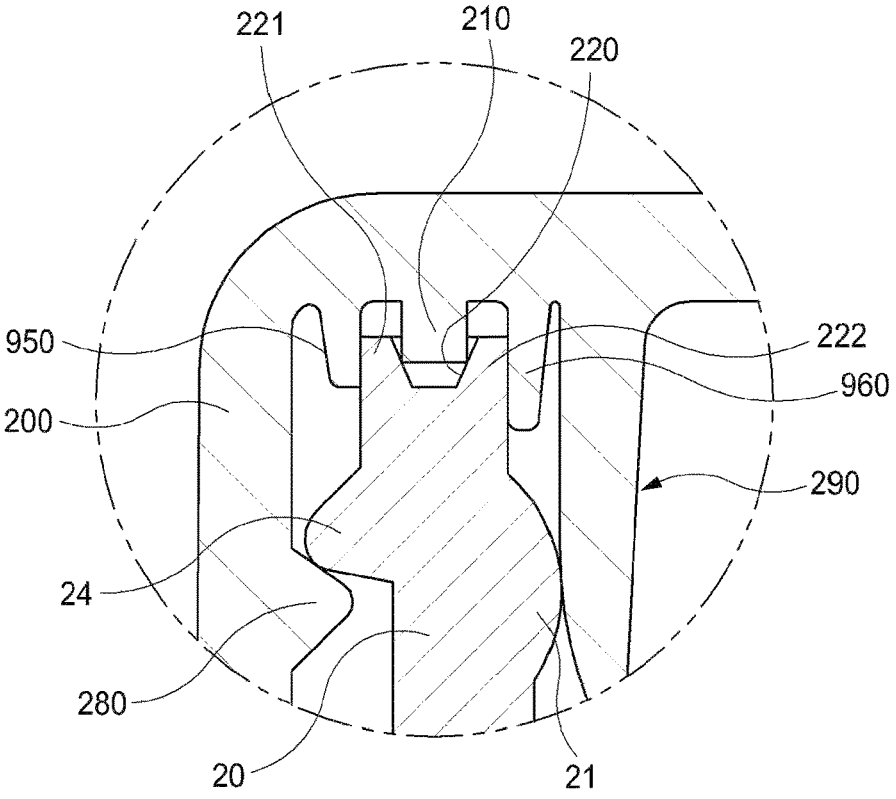
FIG. 27B is a partial cross-sectional view illustrating a second embodiment of a blocking structure applied to the container cap according to the present invention.

In the upper end of the container inlet 20, as illustrated in FIG. 27B, in addition to or separately from the same or similar structure as in the first embodiment, one or more contact rings 950 and 960 extending from the lower end of the cover part 200 may be formed to extend so as to be in close contact with the upper end of the container inlet 20.

The contact rings 950 and 960 may be portions extending from the lower end of the cover 200 so as to be in close contact with the upper end of the container inlet 20 and may have a ring shape.

Particularly, the contact rings 950 and 960 may be constituted by an inner ring 950 and an outer ring 960 so that the upper end of the container inlet 20 is fitted.

Third Embodiment

In the sealing of the cover part 200 and the container inlet 20, when flexibility is provided to portions that are in contact with each other, the sealing force of the container may be greatly improved.

Thus, as illustrated in FIGS. 28A to 28D, one or more flexibility imparting grooves 231, 232, and 233 may be formed in the container inlet 20, and pressing contact parts 241, 242, 243, and 215 that are in press contact with positions corresponding to the flexibility imparting grooves 231, 232, and 233 may be formed on the cover part 200.

The flexibility imparting grooves 231, 232, and 233 may be grooves formed to improve the sealing force of the container by imparting the flexibility to the portion at which the cover part 200 and the container inlet 20 are in contact with each other and may be formed at all portions at which the cover part 200 and the container inlet 20 are in contact with each other.

Figure 28A:
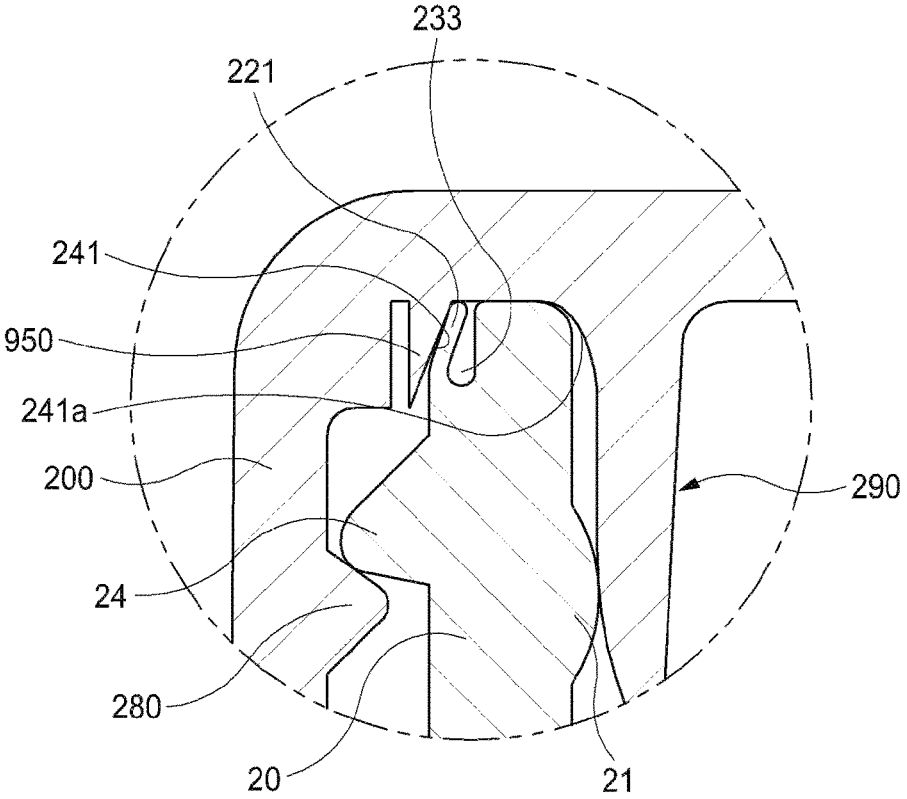
FIGS. 28A to 28C are partial cross-sectional views illustrating third embodiments of the blocking structure applied to the container cap according to the present invention, respectively.
Figure 28B:
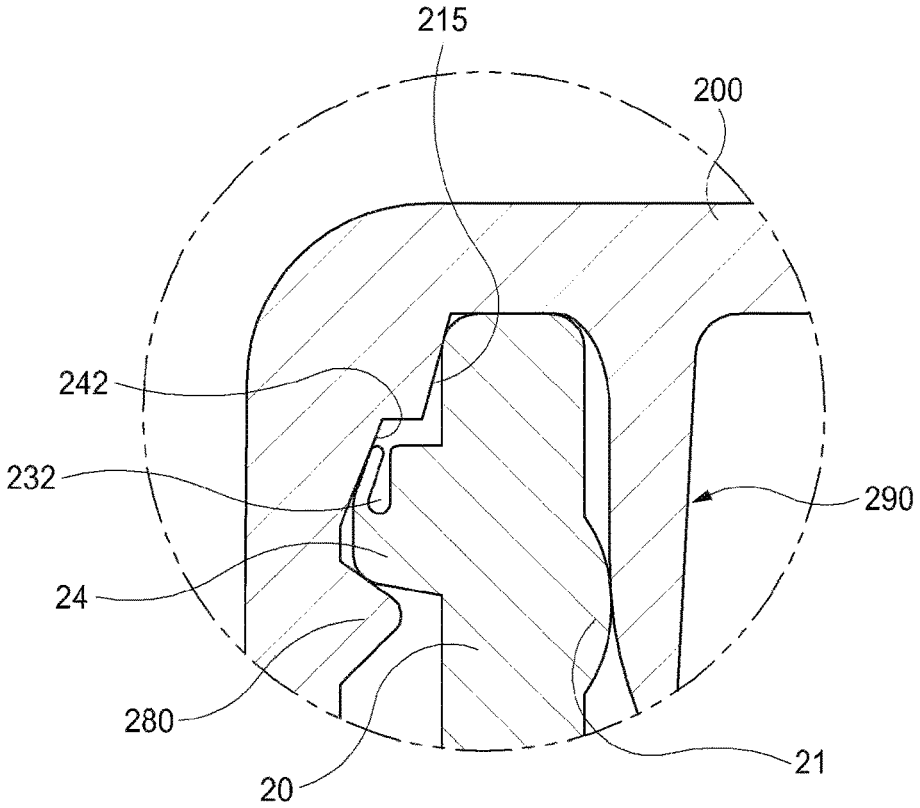
Figure 28C:
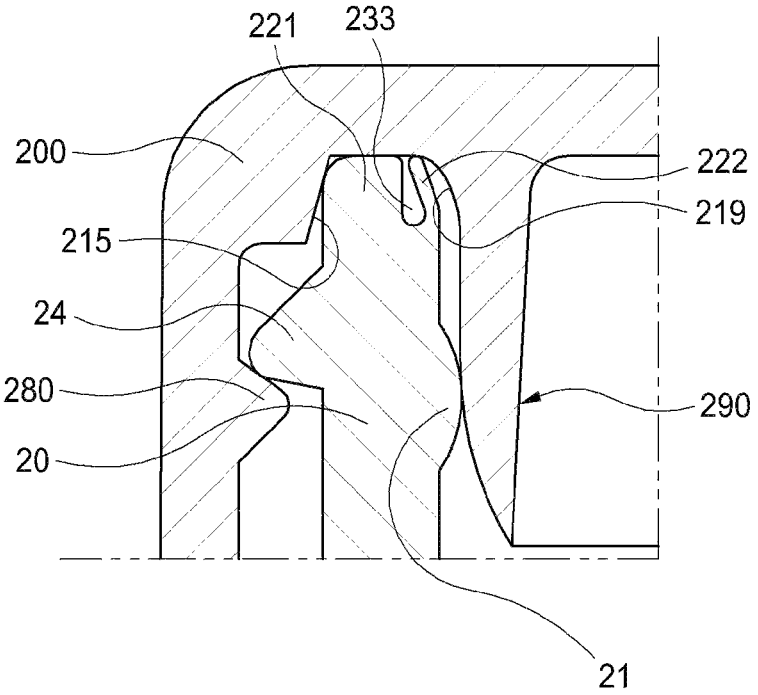

For example, as illustrated in FIGS. 28 and 28C, the flexibility imparting grooves may be provided as flexibility imparting grooves 231 and 233 formed at the upper end of the container inlet 20.

The flexibility imparting grooves 231 and 233 formed at the upper end of the container inlet 20 may be ring-shaped grooves formed at the upper end of the container inlet 20 and also may be provided as the concave groove 220 disclosed in the first embodiment.

Particularly, the flexibility imparting grooves 231 and 233 formed at the upper end of the container inlet 20 may be formed close to the inner circumferential surface (FIG. 28C) or the outer circumferential surface (FIG. 28) at the upper end of the container inlet 20 so that deformation is allowable when being in contact with the cover part 200.

As another example, when the flexibility imparting groove 232 formed at the upper end of the container inlet 20 is formed close to the inner circumferential surface at the upper end of the container inlet 20 as illustrated in FIG. 28B, the cover part 200 may press and be in contact with the portion in which the flexibility imparting groove 232 is formed as the pressing contact part 215 when the cover part 200 is coupled to the container inlet 20 by the formation of the inclined surface 215 at the position corresponding thereto.

When the flexibility imparting groove 231 formed at the upper end of the container inlet 20 is formed close to the outer circumferential surface at the upper end of the container inlet 20 as illustrated in FIG. 28A, the cover part 200 may press and be in contact with the portion in which the flexibility imparting groove 231 is formed as the pressing contact part 241 when the cover part 200 is coupled to the container inlet 20 by the formation of the inclined surface 241 at the position corresponding thereto.

In the formation of the pressing contact part 241 in the cover part 200, as illustrated in FIG. 28B in addition to the simple inclined surface, the pressing contact part 241 may be formed on the outer ring 950 disclosed in the second embodiment.

As another example, as illustrated in FIG. 28B, the flexibility imparting groove 232 may be provided as the flexibility imparting groove 232 formed on the outer circumferential surface of the container inlet 20.

Here, a ring-shaped flexibility imparting protrusion 230 may be formed on the outer circumferential surface of the container inlet 20 in order to form the flexibility imparting groove 232 pressed to the cover part 200, and since the flexibility imparting groove 232 is formed to be concave from the upper side to the lower side in the flexibility imparting protrusion 230, the flexibility imparting groove 232 may be formed.

In addition, the cover part 200 may be provided with a pressing contact part 242 formed on the inner circumferential surface of the cover part 200 to correspond to the flexibility imparting groove 232.

The pressing contact part 242 may be formed as an inclined surface formed to be inclined upward to press a portion, in which the flexibility imparting groove 232 is formed, of the flexibility imparting protrusion 230 by descending of the cover part 200 when the cover part 200 is coupled to the container inlet 20.

As described above, the pressing contact parts 241, 242, and 215 may be portions formed on the cover part 200 and pressed to be in contact with the flexibility imparting grooves 231, 232, and 233 at the corresponding positions and may have any structure as long as the portions in which the flexibility imparting grooves 231, 232, and 233 are pressed.

Specifically, the pressing contact parts 241, 242, and 215 may be preferably formed as an inclined surfaces in consideration that the cover part 200 rotates and/or descends with respect to the container inlet 20, and the portions, in which the flexibility imparting grooves 231, 232, and 233 are formed, are pressed by force applied by the descending.

However, the pressing contact parts 241, 242, and 215 may have various structures such as protrusions in addition to the inclined surfaces as long as the portions in which the flexibility imparting grooves 231, 232, and 233 are formed are pressed by the force applied by the descent.

Fourth Embodiment

When the cover part 200 and the container inlet 20 are coupled, the portions that are in close contact with each other may intentionally increase to improve the sealing force of the container and may be implemented in various embodiments.

The cover part 200 may further include an auxiliary inner ring 280 between the upper end of the container inlet 20 and the inner ring 290 in contrast to the configuration illustrated in FIG. 28A.

The auxiliary inner ring 280 may be formed to protrude downward from the bottom surface of the cover part 200 between the upper portion of the container inlet 20 and the inner ring 290.

Here, the auxiliary inner ring 280 may be preferably formed shorter than a vertical length of the inner ring 290 in order to prevent interference with the inner ring 290.

Also, the auxiliary inner ring 280 may be preferable that a surface toward the upper end of the container inlet 20 is formed as an inclination. Here, the upper end of the container inlet 20 may also be preferably formed with an inclined surface as the pressing contact part 24 at the portions that are in contact with the auxiliary inner ring 280.

As described in the first embodiment, the container inlet 20 may be provided with an inner circumferential-side protrusion 21 that is in contact with the outer circumferential surface of the inner ring 290.

The above structure may increase in contact portion between the cover 200 and the container inlet 20 to improve the sealing force of the container.

Figure 29A:
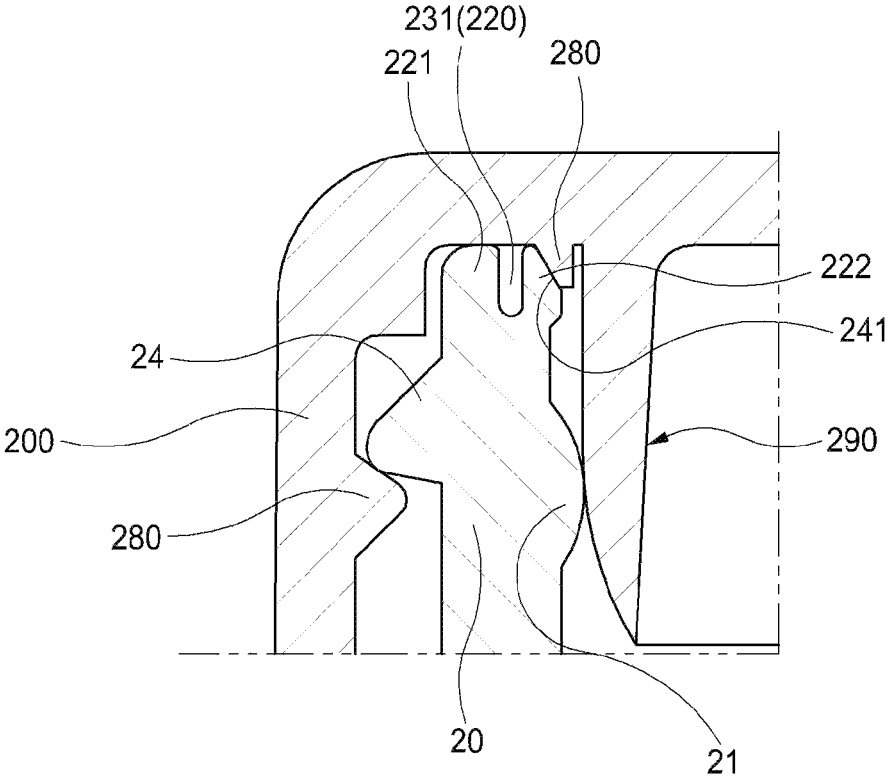
FIGS. 29A to 29D are partial cross-sectional views illustrating fourth embodiments of the blocking structure applied to the container cap according to the present invention, respectively.

As illustrated in FIG. 29A, a pressing contact part 241 for pressing the portion in which the flexibility imparting groove 234 may be formed as an inclined surface so that a partial-inner ring 290 instead of the configuration of the auxiliary ring 280 and an auxiliary inner ring 280 are integrated with each other.

Figure 29B:
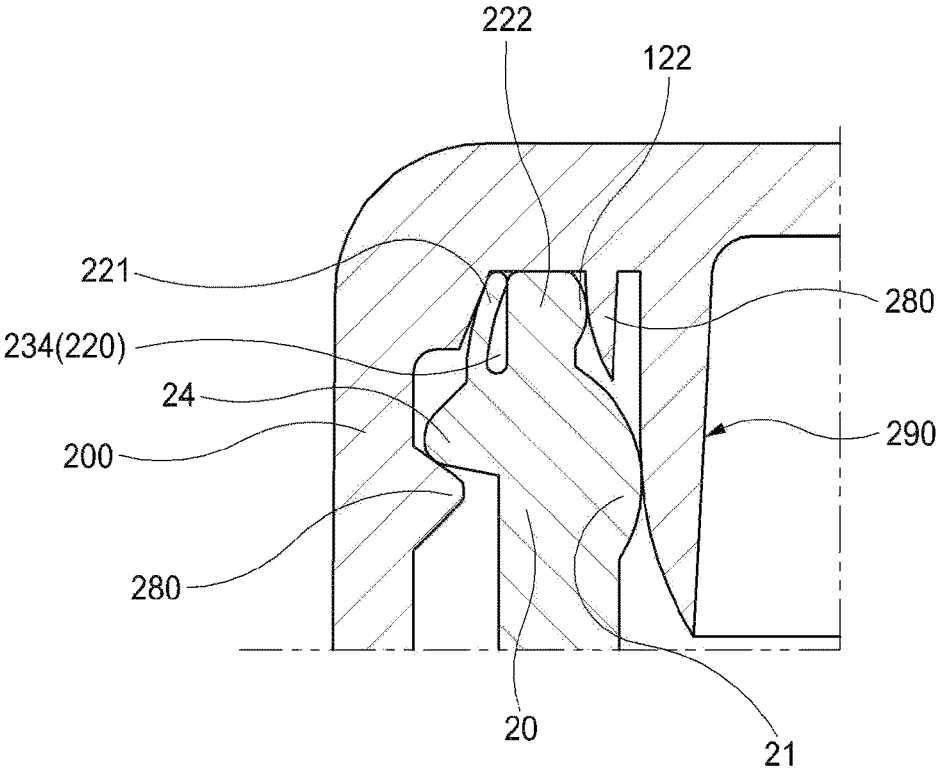

In the embodiment illustrated in FIGS. 29A and 29B, as illustrated in FIG. 28A with respect to the formation of the flexibility imparting groove 231 or the concave groove 220, the flexibility imparting groove 231 or the concave groove 220 may be formed by the inner upper end 222 and the outer upper end 221, and the inner upper end 222 and the outer upper end 221 may have the same height or heights different from each other.

Particularly, in FIGS. 29A and 29B, the height of the inner upper end 222 may be less than that of the outer upper end 221.

Figure 29C:
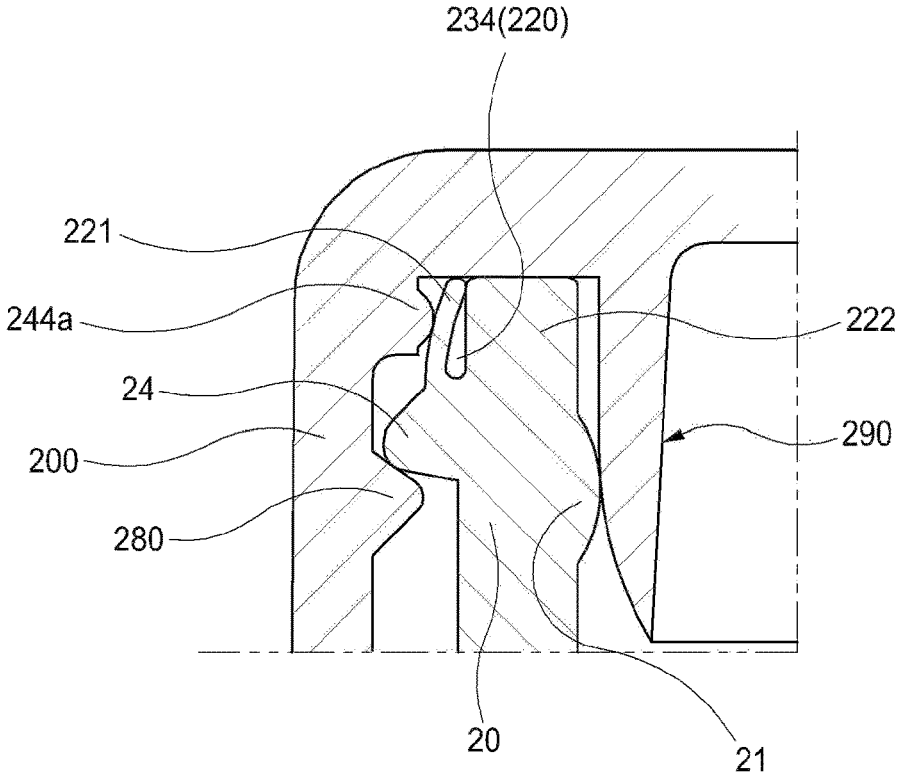

The flexibility imparting groove 234 may be formed close to the outer circumferential surface of the upper end of the container inlet 20, as illustrated in FIG. 29C.

Here, the cover part 200 may have an inclined surface 215 as the pressing contact part 215 to press the portion in which the flexibility imparting groove 234 is formed.

In FIG. 29C, a height of the outer upper end 221 may be less than that of the inner upper end 222.

Figure 29D:
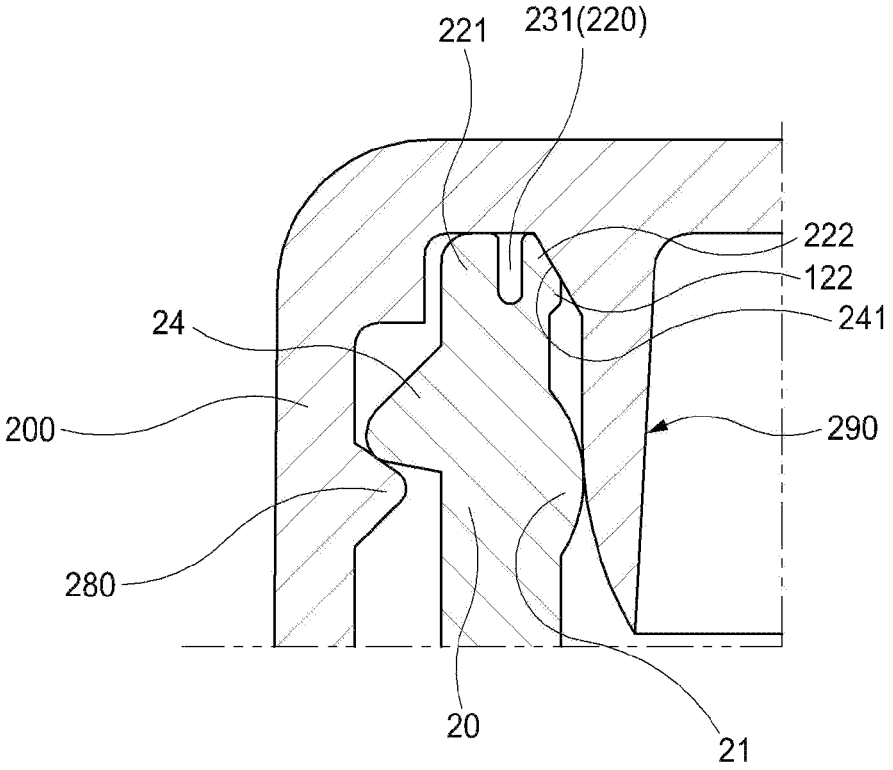

Also, as illustrated in FIG. 29D, a protrusion 244*a* may be formed on the cover part 200 as the pressing contact part for pressing the portion in which the flexibility imparting groove 234 is formed.

In the improving of the sealing force of the container, it is preferable to relatively more increase in contact portion between the upper end of the container inlet 20 and the cover part 200. Particularly, a plurality of contact parts may be preferably formed in plurality with respect to a passage from the outside of the container to the inside of the container rather than being connected to each other.

Figure 30A:
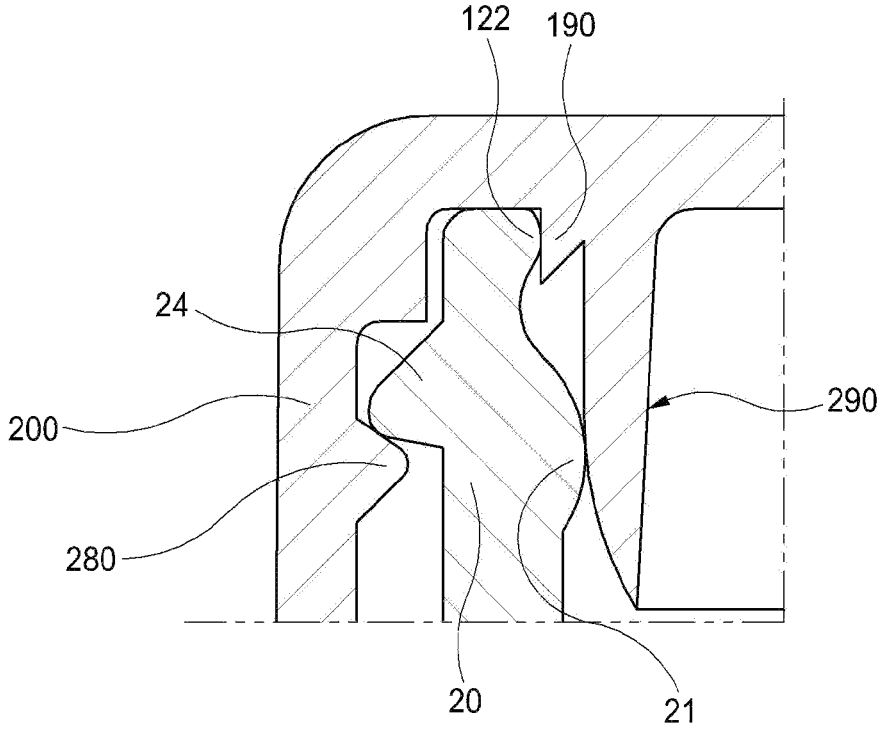
FIGS. 30A to 30E are partial cross-sectional view illustrating modified examples of the blocking structure illustrated in FIGS. 29A to 29D, respectively.

As a first example, as illustrated in FIG. 30A, in addition to the inner ring 290 and the inner protrusion 21 that are in contact with the outer circumferential surface of the inner ring 290 disclosed in the first embodiment, the cover part 200 may be additionally provided with an auxiliary inner ring 280 that is in close contact with the upper end of the container inlet 20.

The auxiliary inner ring 280 may be formed to protrude downward from the cover part 200, in particular, the bottom surface of the cover part 200 between the upper portion of the container inlet 20 and the inner ring 290.

Here, the auxiliary inner ring 280 may be preferably formed shorter than a vertical length of the inner ring 290 in order to prevent interference with the inner ring 290.

Also, it is preferable that the auxiliary inner ring 280 is formed so as to be in contact with the upper end of the container inlet 20 when the cover 200 is coupled to the container inlet 20.

For this, it is preferable that the cross-section of the upper end of the container inlet 20 forms a curved surface, and an inner circumferential-side protrusion 122 on which the inner circumferential surface of the upper end of the container inlet 20 protrudes toward the inner circumferential surface of the auxiliary inner ring 280 may be formed.

Figure 30B:
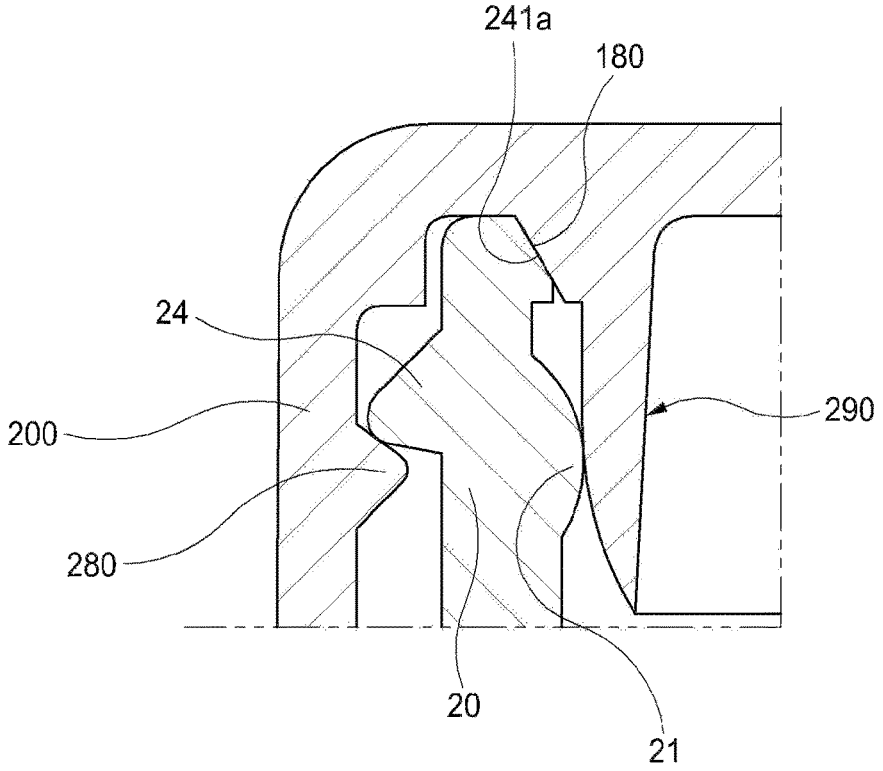

As a second example, as illustrated in FIG. 30B, at least one surface of the surfaces on which the upper end of the auxiliary inner ring 280 and the container inlet 20 are in contact with each other in the structure illustrated in FIG. 39*a* may be provided as inclined surfaces 180 and 241*a*.

In the first and second examples, the auxiliary inner ring 280 may be between the upper end of the container inlet 20 and a wall portion 25 instead of the position between the upper end of the container inlet 20 and the inner ring 290 and the corresponding configurations may be formed symmetrical to each other.

Figure 30C:
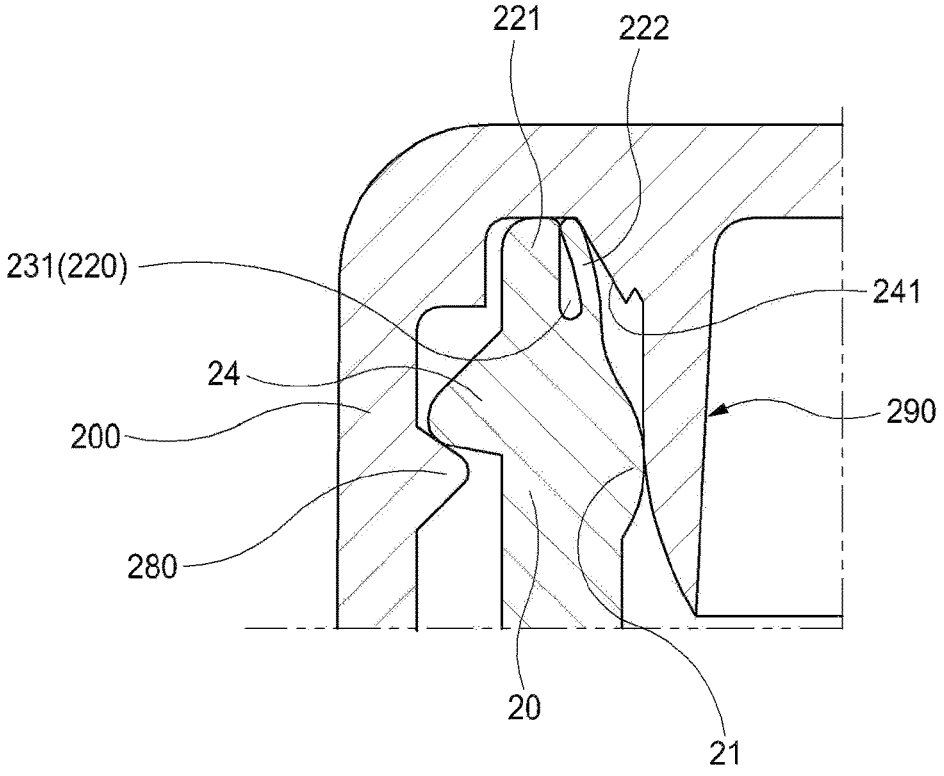

As a third example, as illustrated in FIG. 30C, the flexibility imparting groove 231 may be additionally formed in the structure of FIG. 30B.

Here, an auxiliary protrusion 122 as illustrated in FIG. 30A may be formed on the inner circumferential surface of the container inlet 20.

Figure 30D:
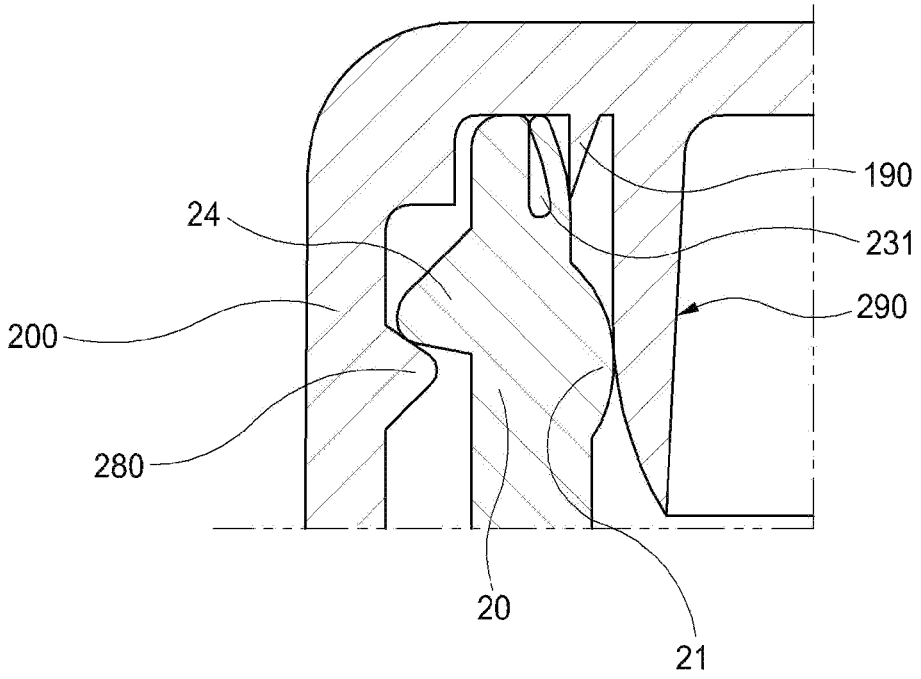

As a fourth example, as illustrated in FIG. 30D, the flexibility imparting groove 231 may be additionally formed in the structure of FIG. 30A.

Figure 30E:
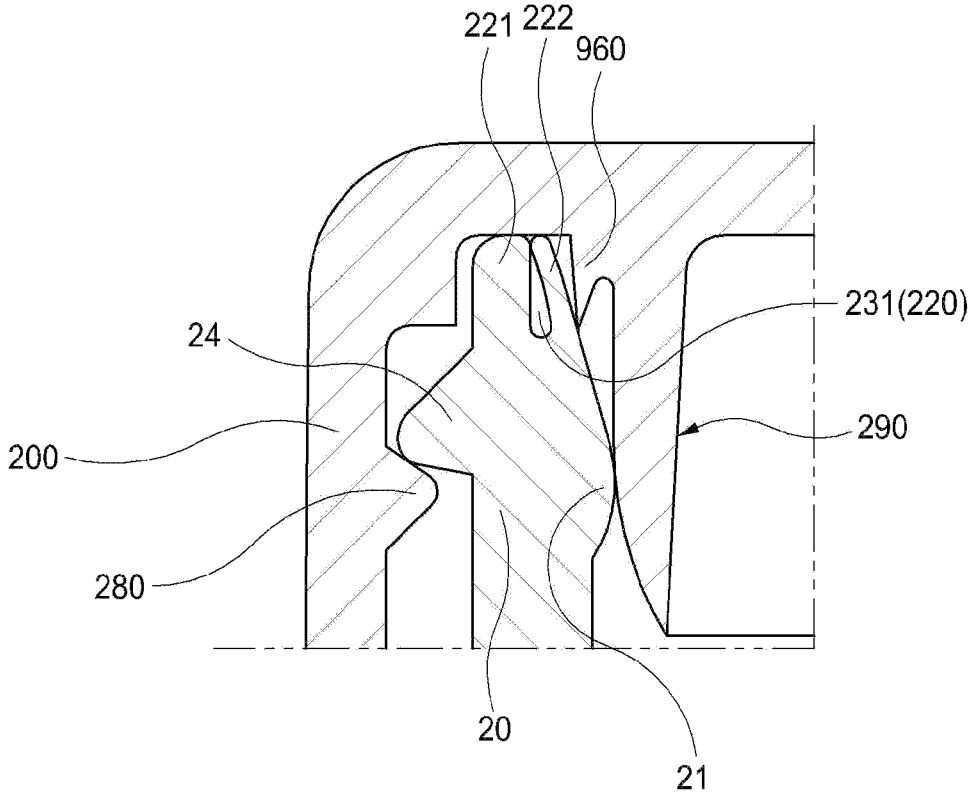

As a fifth example, as illustrated in FIG. 30E, in the structure of FIG. 30D, an inclination may be formed from the upper end of the container inlet 20 to the inner circumferential-side protrusion 21.

Specifically, the container inlet 20 may have an inclination in a direction in which an inner diameter decreases form the upper end to the inner circumferential-side protrusion 21.

With the above structure, in the case in which the cover part 200 is coupled to the container inlet 20, when the cover part 200 descends with respect to the container inlet 20, the outer circumferential surface of the auxiliary ring 280 may be in close contact between the upper end of the container inlet 20 and the inner circumferential-side protrusion 21.

Fifth Embodiment

When the cover part 200 and the container inlet 20 are coupled, the portions that are in close contact with each other may intentionally increase to improve the sealing force of the container and may be implemented in various embodiments.

Particularly, if the contact portions that are in contact with the upper end of the container inlet 20 and the cover 200 are improved, the sealing force of the container may be improved.

Figure 31A:
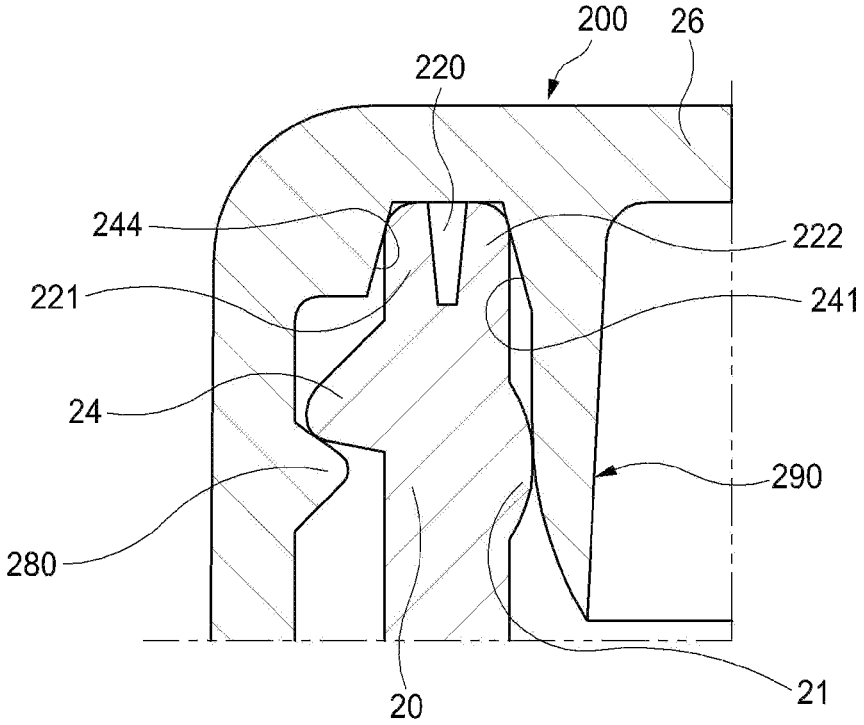
FIGS. 31A and 31B are partial cross-sectional views illustrating fifth embodiments of the blocking structure applied to the container cap according to the present invention, respectively.
Figure 31B:
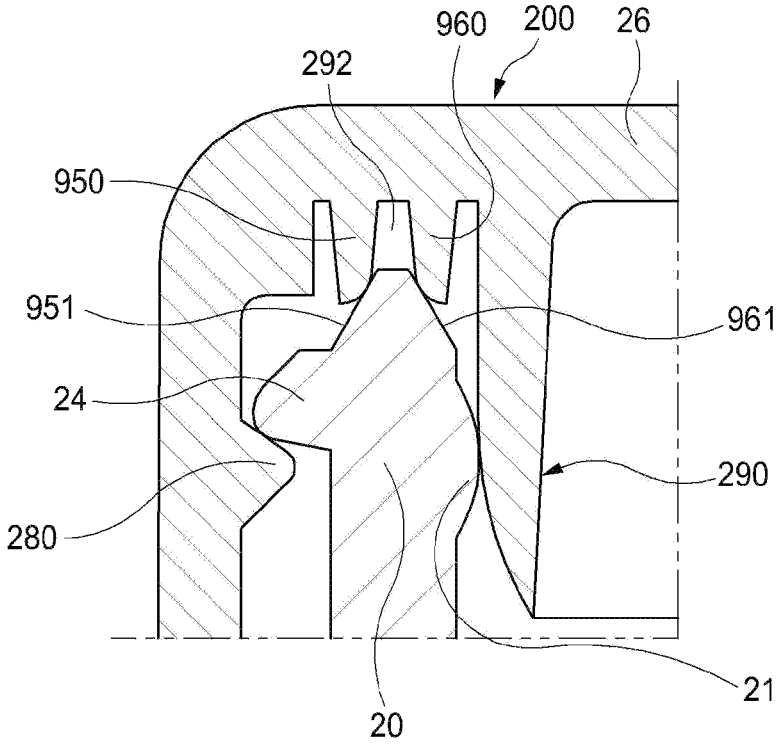

In the container according to the fifth embodiment of the present invention, as illustrated in FIGS. 31A and 31B, the container inlet 20 may have a concave groove 220 at a center by an inner upper end 222 and an outer upper end 221 and have an inner inclined surface 241 and an outer inclined surface 242 on which the cover part 200 is in contact with the inner portion of the inner upper end 222 and the outer portion of the outer upper end 221.

Specifically, the container inlet 20 may have a concave groove 220 formed at a center of the upper end by the inner upper end 222 and the outer upper end 221.

Here, the inner portion of the inner upper end 222 and the outer portion of the outer upper end 221 may be formed as curved surfaces so as to be in close contact with the inner inclined surface 241 and the outer inclined surface 242.

Also, a sidewall of the concave groove 220 may be preferably formed to be inclined upward so that the inner upper end 222 and the outer upper end 221 are easily deformed in a direction, in which the width thereof decreases, i.e., the inner upper end 222 and the outer upper end 221 are contracted.

In other words, each of the inner upper end 222 and the outer upper end 221 preferably has a 'V' shape.

The cover part 200 may have an inner inclined surface 241 and an outer inclined surface 242 that are in contact with an inner portion of the inner upper end 222 and an outer portion of the outer upper end 221.

The inner inclined surface 241 and the outer inclined surface 242 may be portions formed on the cover part 200 so as to be in contact with the inner portion of the inner upper end 222 and the outer portion of the outer upper end 221 and may have various structures.

For example, the inner inclined surface 241 may be formed as a portion of the inner ring 290 as illustrated in FIGS. 31A and 31B.

Also, the inner inclined surface 241 may be formed as a portion of the auxiliary inner ring 280 when the auxiliary inner ring 280 is provided.

As illustrated in FIG. 31B, the cover part 200 may be provided with an inner contact ring 960 and an outer contact ring 950 so that an opposite concave groove 292 is formed to allow the upper end of the container inlet 20 to be at least partially inserted.

The inner contact ring 960 and the outer contact ring 950 may be formed in the cover part 200 to form the opposite concave groove 292 so that the upper end of the container inlet 20 is at least partially inserted and may have various configurations.

For example, the inner contact ring 960 and the outer contact ring 950 may be formed to extend downward from the bottom surface of the cover part 200.

Here, it is preferable that each of the inner contact ring 960 and the outer contact ring 950 have a curved surface that is in contact with the upper end of the container inlet 20.

In addition, each of lower ends of the inner contact ring 960 and the outer contact ring 950 may be deformed in a direction in which a width of the opposite concave groove 292 is widened, that is, the sidewall of the opposite concave groove 292 may be preferably formed to have an upward inclination so that the inner contact ring 960 and the outer contact ring 950 are deformed to be spread with respect to each other.

In other words, it is preferable that each of the inner contact ring 960 and the outer contact ring 950 has an inverted 'V' shape toward the lower side.

It is preferable that the upper end of the container inlet 20 is sharply formed so as to be easily inserted into the opposite concave groove 292 formed by the inner contact ring 960 and the outer contact ring 950.

Also, as illustrated in FIG. 31B, the upper end of the container inlet 20 may have inclined surfaces 961 and 951 expanded inward and outward with respect to the uppermost end so as to be easily inserted into the opposite concave groove 292.

Sixth Embodiment

Referring to the above-described embodiments, it is preferable that the contact portion at which the cover part 200 and the container inlet 20 are in contact with each other increases, in particular, the contact portion between the upper end of the container inlet 20 and the cover part 200 relatively increases as a means of increasing in sealing force of the container.

Here, a plurality of contact parts may be preferably formed in plurality with respect to a passage from the outside of the container to the inside of the container rather than being connected to each other.

Particularly, in the formation of the plurality of contact parts, it is achieved by the deformation of the structure of the cover part 200 and the container inlet 20, and it may be implemented by the formation of the inclined surfaces having various angles and structures, the flexibility imparting groove, and the like.

In addition, the structure of the plurality of contact portions may be changed by exchanging the structures of the cover part 200 and the container inlet 20 with each other.

Hereinafter, various modifications of the container inlet 20 for forming the plurality of contact portions in plurality based on a passage from the outside of the container to the inside of the container will be described.

Figure 32A:
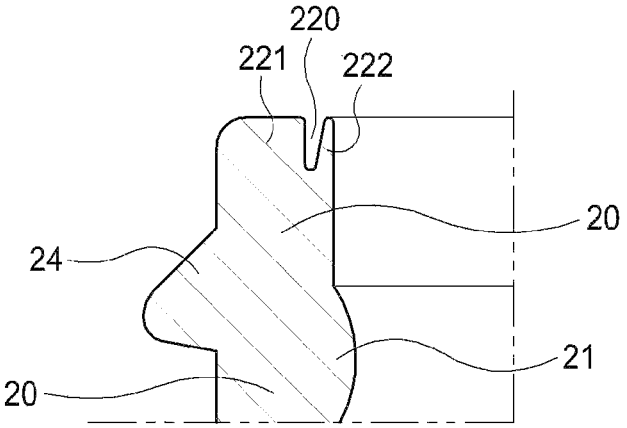
FIGS. 32A to 32G are partial cross-sectional views illustrating sixth embodiments of the blocking structure applied to the container cap according to the present invention, respectively.

As illustrated in FIG. 32A, the container inlet 20 may be provided with an inner upper end 222 and an outer upper end 221 at the upper end centering on the concave groove 220.

Here, the concave groove 220 may be formed close to the inner side or the outer side, and thus, any one of the inner upper end 222 and the outer upper end 221 may have a width less than that of the other one so as to be easily deformed by being in contact with the cover part 200.

In addition, heights of the inner upper end 222 and the outer upper end 221 may be the same as or different from each other.

FIG. 32A illustrates a case in which the width of the inner upper end 222 is less than that of the outer upper end 221.

In addition, the concave groove 220 may be formed to increase in width as it goes upward.

Figure 32B:
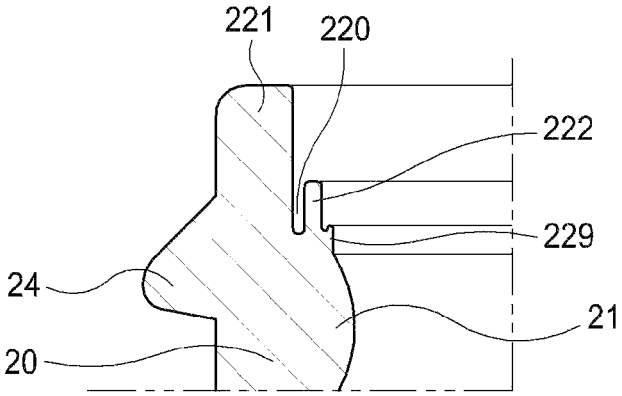

FIG. 32B is a modified example of the container inlet 20 illustrated in FIG. 32A.

The container inlet 20 illustrated in FIG. 32B may be formed so that the height of the inner upper end 222 is greater than that of the outer upper end 221.

Furthermore, a fine ring protrusion 229 may be formed to increase in contact portion with the cover part 200 on the inner circumferential surface of the container inlet 20.

Figure 32C:
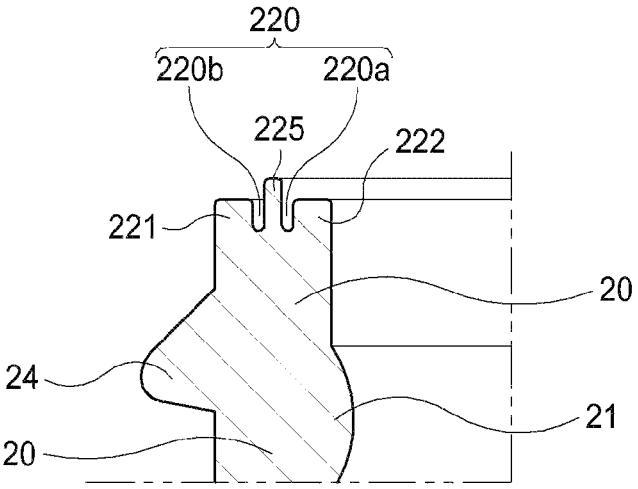

FIG. 32C is a modified example of the container inlet 20 illustrated in FIG. 32A.

The container inlet 20 illustrated in FIG. 32C may be further provided with a central protruding upper end 225 protruding upward from the concave groove 220 of FIG. 32A.

Particularly, the central protruding upper end 225 may be formed higher than the height of each of the inner upper end 222 and the outer upper end 221, and the concave groove 220 may be formed by forming two divided concave grooves 220*a* and 220*b*.

Here, it is preferable that the cover part 200 coupled to the container inlet 20 has a ring-shaped groove into which the central protruding upper end 225 is inserted.

Figure 32D:
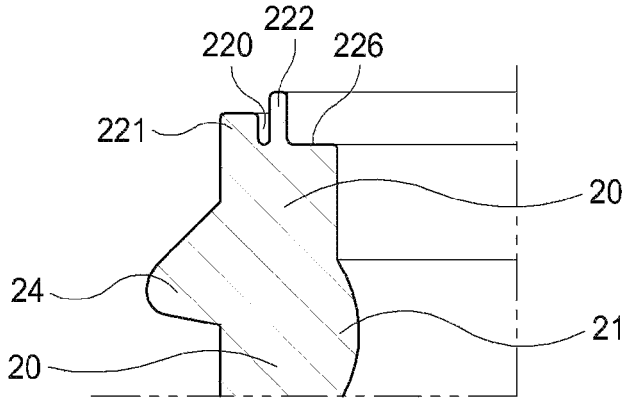

FIG. 32D is a modified example of the container inlet 20 illustrated in FIG. 32A.

In the container inlet 20 illustrated in FIG. 32D, the inner upper end 222 may be formed higher than the outer upper end 221 and may have a stepped portion 226 that is smaller than each of the inner upper end 222 and the outer upper end 221 at the inside thereof.

Figure 32E:
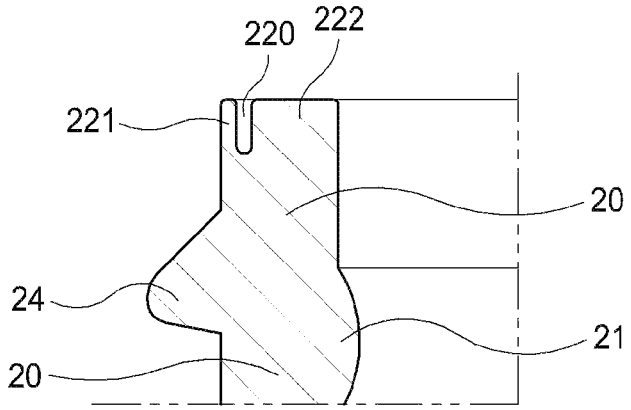

FIG. 32E is a modified example of the container inlet 20 illustrated in FIG. 32A.

The container inlet 20 illustrated in FIG. 32E may be an opposite case of FIG. 32A, and the outer upper end 221 may be formed to have a width less than that of the inner upper end 222.

FIGS. 32A and 32D illustrate a structure in which a relatively small inner upper end 222 or outer upper end 221 is formed at a position at which a blocking structure is deformed by pressing of the cover part 200 or filling of hot contents. The container inlet 20 may have all or a portion of the structures illustrated in FIGS. 32F and 32G in addition to the structures of FIGS. 28A and 28C of the third embodiment.

Figure 32F:
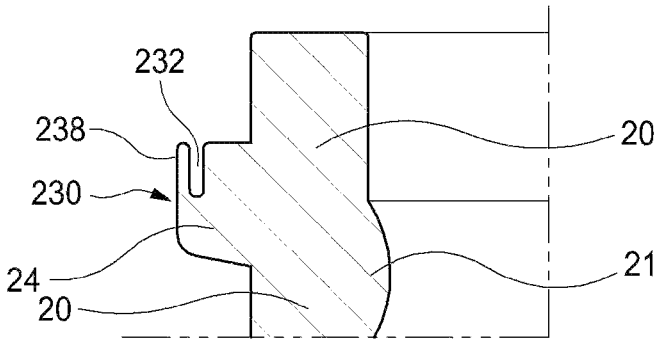

The flexibility imparting groove may be formed close to the inner circumferential surface adjacent to the upper end of the container inlet 20, as illustrated in FIG. 32F.

That is, as illustrated in FIG. 32F, the flexibility imparting groove 232 may be provided as a flexibility imparting groove 232 formed in the outer circumferential surface of the container inlet 20.

Here, a ring-shaped flexibility imparting protrusion 230 may be formed on the outer circumferential surface of the container inlet 20 in order to form the flexibility imparting groove 232 pressed to the cover part 200, and since the flexibility imparting groove 232 is formed to be concave from the upper side to the lower side in the flexibility imparting protrusion 230, the flexibility imparting groove 232 may be formed.

Here, the flexibility imparting groove 232 may be relatively formed by a groove forming protrusion ring 238 extending upward.

Figure 32G:
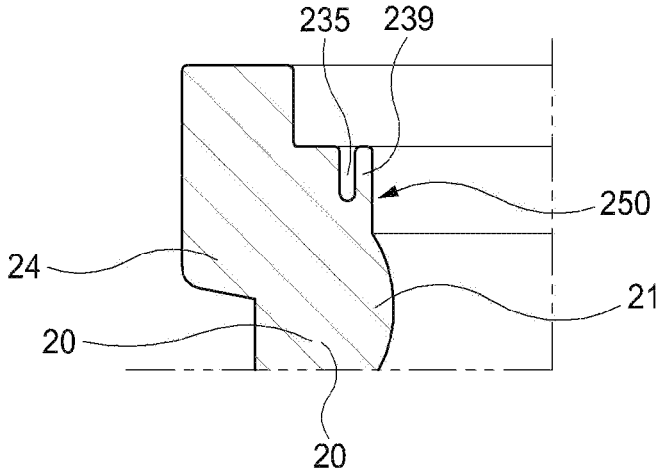

As another example, as illustrated in FIG. 32G, the flexibility imparting groove 235 may be provided as a flexibility imparting groove 235 formed in the inner circumferential surface of the container inlet 20.

Here, a ring-shaped inner flexibility imparting part 250 may be formed on the inner circumferential surface of the container inlet 20 in order to form the flexibility imparting groove 235 pressed to the cover part 200, and since the flexibility imparting groove 232 is formed to be concave from the upper side to the lower side in the inner flexibility imparting part 250, the flexibility imparting groove 232 may be formed.

Here, the flexibility imparting groove 235 may be relatively formed by a groove forming protrusion ring 239 extending upward.

The cover part 200 has a structure such as an inclined surface or an inner ring for pressing a groove forming protrusion ring 239.

Hereinafter, various modifications of the cover part 200 in addition to or separately from the container inlet 20 in order to form the plurality of contact portions based on a passage from the outside of the container 30 to the inside of the container will be described.

Figure 33A:
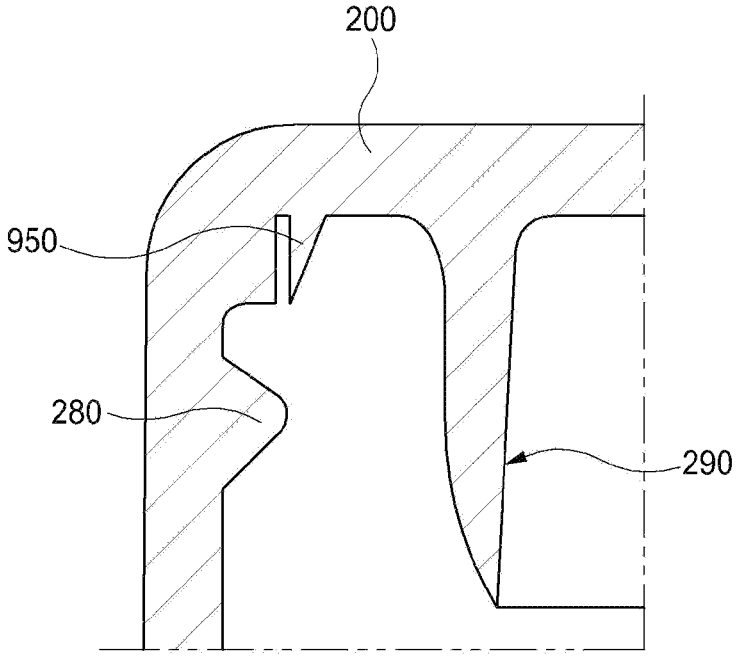
FIGS. 33A to 33C are partial cross-sectional view illustrating a structure of a cover part illustrated in FIG. 27B or 28A.

The cover part 200 illustrated in FIG. 33A may have a structure of the container cap illustrated in FIG. 27A or 28A.

Figure 33B:
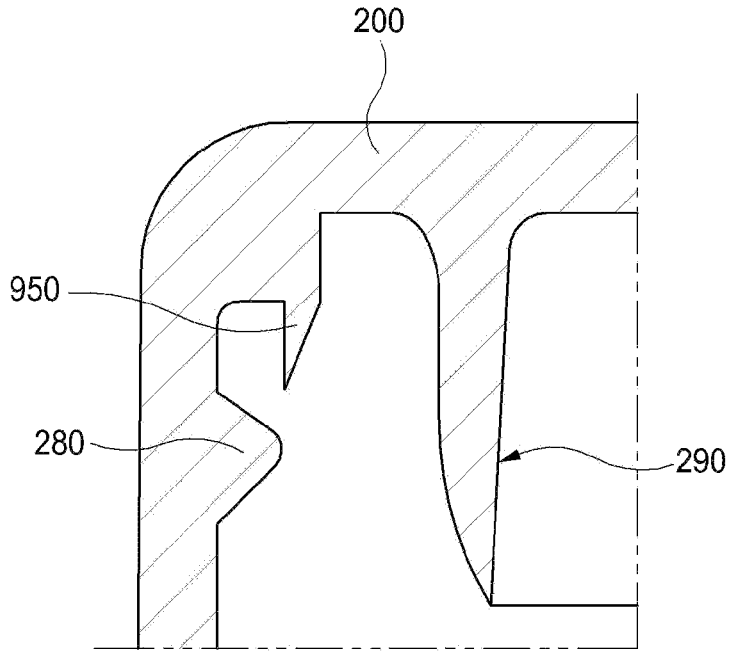

The cover part 200 illustrated in FIG. 33B illustrates a case in which a distance between a contact ring 950 and an inner ring 290 is formed to be relatively small as a modification of FIG. 33A.

In addition, an end of the contact ring 950 may be disposed lower than the inner ring 290.

Here, the container inlet 20 may be provided with an inclined surface, a protruding ring, etc. at a portion that is in contact with the contact ring 950.

Figure 33C:
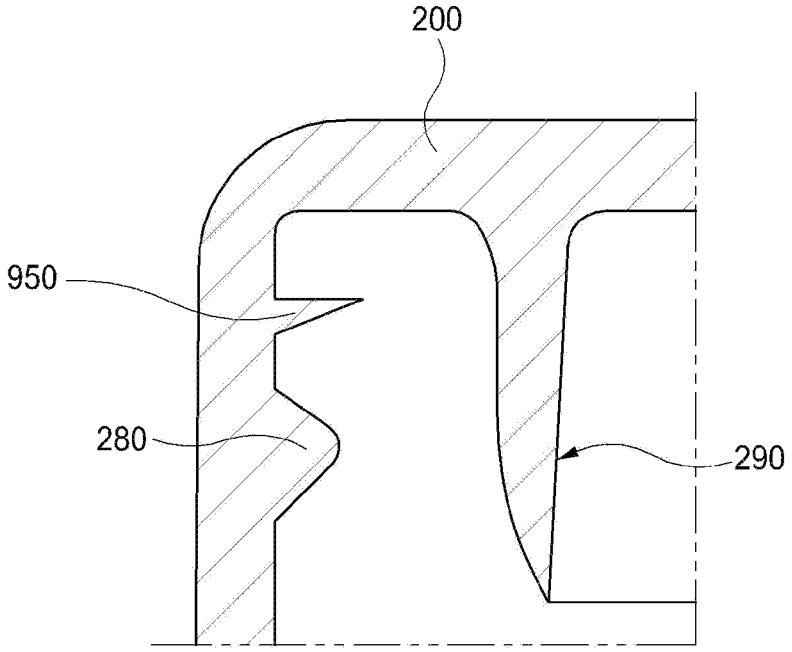

FIG. 33C is a modification of FIG. 33A. Here, the contact ring 950 may be formed to protrude from an inner circumferential surface of a sidewall 25 instead of the bottom surface of the cover part 200.

Here, the container inlet 20 may be provided with an inclined surface, a protruding ring, etc. at a portion that is in contact with the contact ring 950.

Figure 34A:
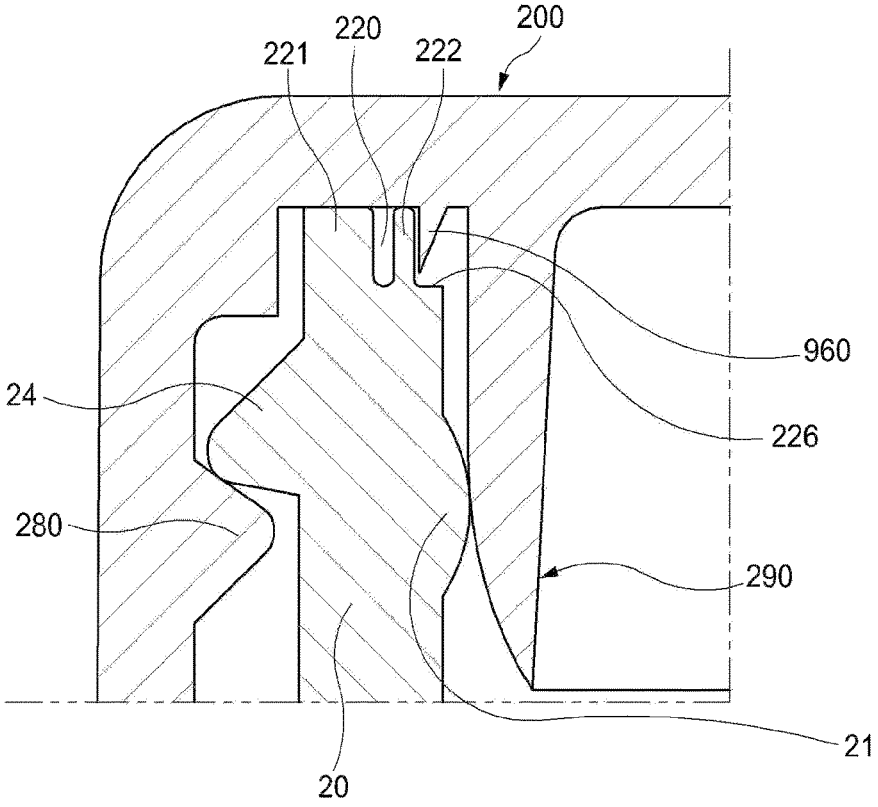
FIGS. 34A to 34C are partial cross-sectional view illustrating examples in which a cover part of the container cap and a container inlet are coupled to each other according to the present invention.
Figure 34B:
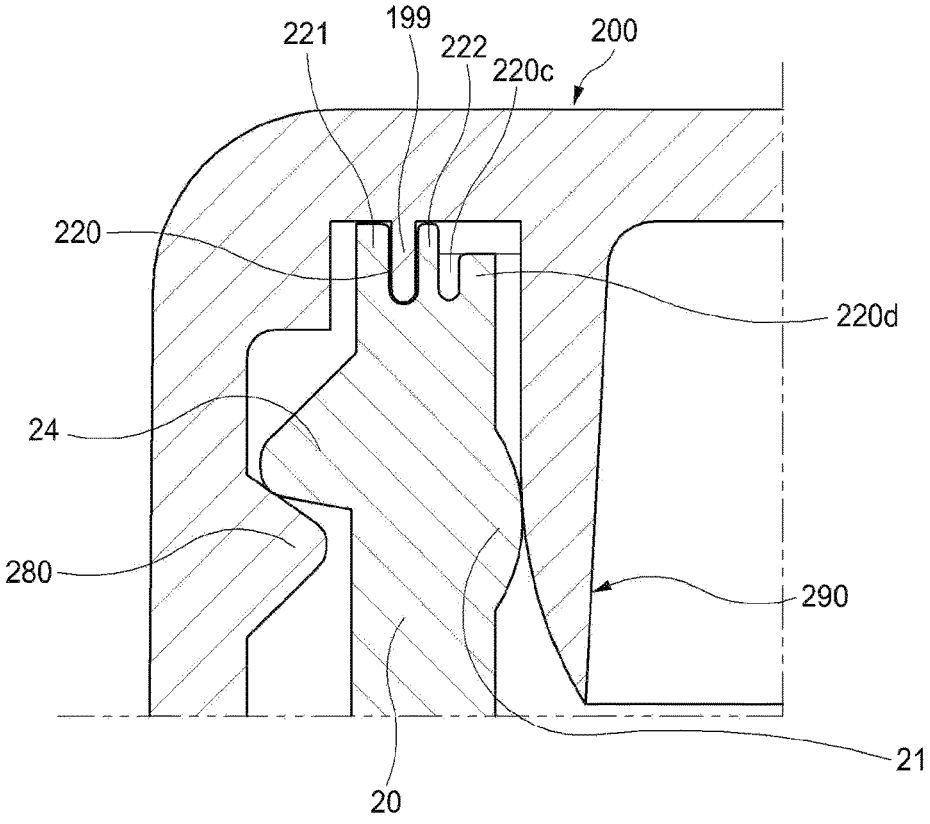
Figure 34C:
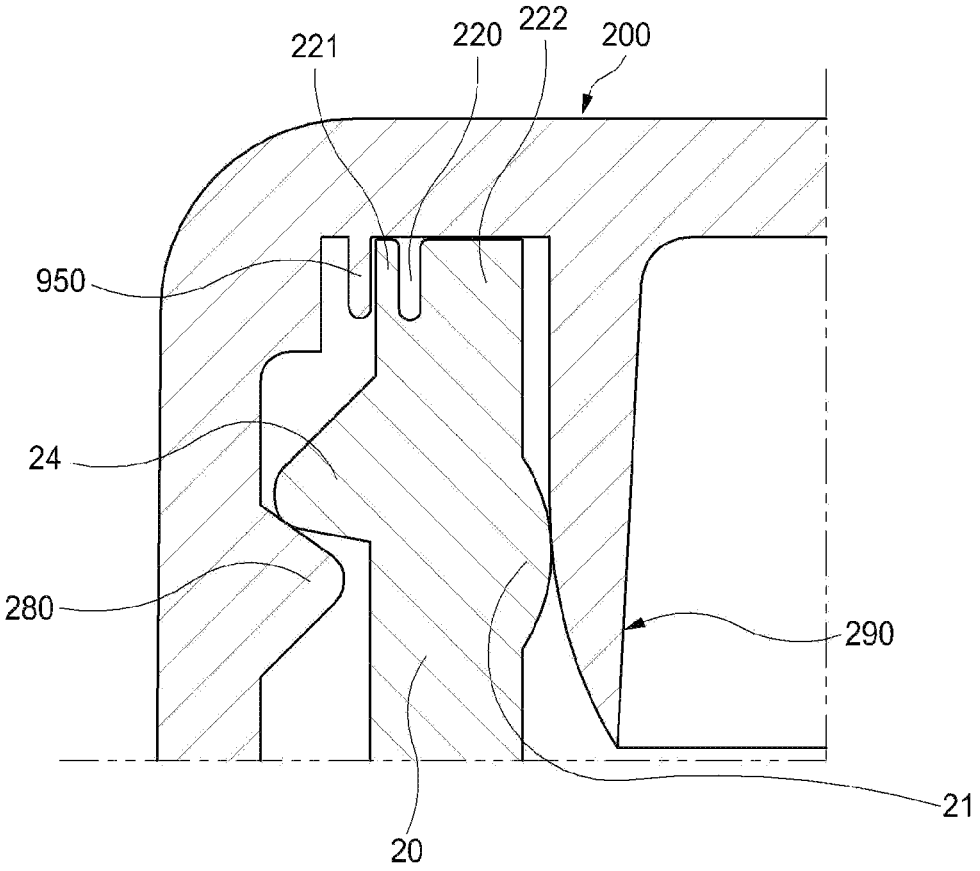

FIGS. 34A to 34C illustrate examples in which the cover part 200 and the container inlet 20, which have various structures, are coupled to each other.

FIG. 34A is an example of a structure in which the cover part 200 is coupled to the structure of the container inlet 20 illustrated in FIG. 32G, and thus, since the structure is similar to that shown in FIG. 28C, a detailed description thereof will be omitted.

FIG. 34B illustrates a structure in which the cover part 200 having a structure similar to that illustrated in FIG. 29A is coupled to the container inlet 20 modified from the structure of the container inlet 20 of FIG. 32A. Since the structure is similar to that illustrated in FIG. 29A, a detailed description thereof will be omitted.

The container inlet 20 illustrated in FIG. 34C may be provided with an inner upper end 222 and an outer upper end 221 at the upper end, and furthermore, an auxiliary upper end 220*d* and may be provided with an insertion protrusion ring 199 into which the cover part 200 is inserted into the concave groove 220 formed by the upper end 222 and the outer upper end 221.

The container inlet 20 may be provided with an auxiliary upper end 220*d*, which has a height less than that of each of the inner upper end 222 and the outer upper end 221, inside the inner upper end 222 to form an additional concave groove 220*c* together with the inner upper end 222.

Although the above description merely corresponds to some exemplary embodiments that may be implemented by the present invention, as well known, the scope of the present invention should not be interpreted as being limited to the above-described embodiments, and all technical spirits having the same basis as that of the above-described technical spirit of the present invention are included in the scope of the present invention.

The invention claimed is:

1. A container cap comprising:

a body part coupled to a container inlet of a container containing contents and having an opening at an upper side thereof;

a cover part coupled to the body part to open and close an upper opening of the body part; and a separation part integrally connected to the cover part by a first connection part and integrally and separably connected to the body part by a second connection part, wherein the second connection part is separated by a user's manipulation so that the cover part is separable from the body part, wherein the separation part connects the body part to the cover part in a vertical direction, wherein a first member is provided with a fixing part for fixing the separation part after the separation part is separated from a second member, wherein the container cap is made of plastic material, and the first connection part is formed as a thin film, and the second connection part is formed as a cut groove or a plurality of bridges, wherein the separation part is fitted into the fixing part so as to be fixed to the fixing part, wherein the fixing part comprises one or more second fitting parts formed on an outer circumferential surface of the first member and fitted with one or more first fitting parts provided in the separation part, wherein the first connection part is vertically folded and the separation part is coupled to the fixing part, wherein in the body part, a concave groove having a shape corresponding to a front shape of the separation part is formed to be recessed, and wherein the cover part includes an inner ring which protrudes from a bottom surface and is inserted into an inner circumferential surface of the container inlet in order to increase a sealing force of the container.

2. The container cap of claim 1, wherein the separation part connects the body part to the cover part in a circumferential direction.

3. The container cap of claim 1, wherein the cover part is integrally connected by a hinge part so that the cover part hingedly rotates when being separated from the body part.

4. The container cap of claim 1, wherein at least one of the separation part or the fixing part is disposed at a position opposite to the hinge part, and the cover part is used as a handle for opening the body part by the user's manipulation.

5. The container cap of claim 1, wherein the cover part comprises a plurality of close contact parts that are in contact with the container inlet, wherein the close contact part has a close curve surrounding the container inlet to prevent external air from being introduced from outside into the container.

6. A container comprising:

a container containing contents; and the container cap of claim 1, which is coupled to a container inlet of the container.

7. The container of claim 6, wherein at least one of the cover part or the container inlet comprises a plurality of close contact parts that are in close contact with the container inlet, and wherein the close contact part has a close curve surrounding the container inlet to prevent external air from being introduced from outside into the container.

* * * * *